US007174024B1

(12) United States Patent
Suzuki et al.

(10) Patent No.: US 7,174,024 B1
(45) Date of Patent: Feb. 6, 2007

(54) FLAT ACOUSTIC CONVERSION DEVICE

(75) Inventors: Takahisa Suzuki, Tokyo (JP); Masashi Hori, Tokyo (JP); Kunihiko Ohbayashi, Hiroshima (JP)

(73) Assignee: FPS, Inc., Tokyo (JP)

( * ) Notice: Subject to any disclaimer, the term of this patent is extended or adjusted under 35 U.S.C. 154(b) by 108 days.

(21) Appl. No.: 10/009,519

(22) PCT Filed: Jun. 9, 2000

(86) PCT No.: PCT/JP00/03755

§ 371 (c)(1),
(2), (4) Date: Dec. 11, 2001

(87) PCT Pub. No.: WO00/78095

PCT Pub. Date: Dec. 21, 2000

(30) Foreign Application Priority Data

| | | |
|---|---|---|
| Jun. 11, 1999 | (JP) | 11-165586 |
| Nov. 18, 1999 | (JP) | 11-328502 |
| Jan. 14, 2000 | (JP) | 2000-007217 |
| May 9, 2000 | (JP) | 2000-136338 |

(51) Int. Cl.
*H04R 25/00* (2006.01)

(52) U.S. Cl. ..... 381/152; 381/176; 381/399

(58) Field of Classification Search ..... 381/152, 381/176, 177, 182, 190–191, 399, 421, 431
See application file for complete search history.

(56) References Cited

U.S. PATENT DOCUMENTS 6,008,714 A 12/1999 Okuda et al.
6,480,614 B1 11/2002 Denda et al.

FOREIGN PATENT DOCUMENTS

| | | |
|---|---|---|
| JP | 52-089911 | 7/1977 |
| JP | 54-23722 | 2/1979 |
| JP | 59-94498 | 6/1984 |
| JP | 60-45588 | 3/1985 |
| JP | 62-115996 | 5/1987 |
| JP | 62-173899 | 7/1987 |
| JP | 62-161491 | 10/1987 |
| JP | 2-98776 | 8/1990 |
| JP | HEI 09-331596 | 12/1997 |
| WO | WO 99/03304 | 1/1999 |

*Primary Examiner*—Suhan Ni
(74) *Attorney, Agent, or Firm*—Jean C. Edwards, Esq.; Akerman Senterfitt

(57) ABSTRACT

A flat acoustic conversion device includes two magnets disposed so that their magnetic poles face upward arid are adjacent to or in contact with one another, and the magnetic pole faces of different polarities arc disposed alternately; a vibrating member disposed on the top surface of the yoke; coil pairs wound in helical form and disposed at front and reverse surfaces of the vibrating membrane; such that magnetic flux traveling in a direction substantially parallel to a surface of the vibrating membrane becomes a maximum, and interlinks with the coil pairs. When current is supplied to the coils, a direction of force which the current receives from a magnetic field is substantially orthogonal to the surface of the vibrating membrane, and force in a direction along the surface of the vibrating membrane becomes extremely low. Thus, noise components can be reduced such that sound quality can be improved.

13 Claims, 42 Drawing Sheets

FLAT ACOUSTIC CONVERSION DEVICE

BACKGROUND OF THE INVENTION

1. Field of the Invention

The present invention relates to a flat acoustic conversion device, and particularly to a flat acoustic conversion device such as a flat speaker which can be used as a flat speaker, a flat microphone, and a microphone.

2. Description of the Related Art

FIG. 1 is a diagram showing the basic structure of a conventional flat speaker. This flat speaker is provided with a plurality of bar magnets 1 which are arranged in parallel on a yoke 4, a vibrating membrane 2 disposed parallel and adjacent to a magnetic pole face of the bar magnets 1, and a plurality of coils 3 each formed at a position on the vibrating membrane which corresponds to the magnetic pole face of the bar magnets in such a manner that the electric current flows in a direction orthogonal to the magnetic field generated by the bar magnets 1. Each coil 3 is disposed at a position where the greater part of the inner periphery of each coil faces the magnetic pole face of a bar magnet and the remaining part is disposed outside a position corresponding to the outer edge of the bar magnets. The outer edge of the vibrating membrane is fixed by a fixing member in such a manner that the vibrating membrane is able to vibrate together with the coils. Because the current flowing through each coil 3 is affected by the force from the magnetic field of the bar magnets in accordance with Fleming's left-hand law when alternating current is fed to each coil 3, the vibrating membrane 2 is vibrated in a direction perpendicular to the surface of the vibrating membrane together with the energized coils which enables an electric signal to be converted into an acoustic signal.

Further, by vibrating the vibrating membrane 2 in a direction orthogonal to the surface of the vibrating membrane and converting an acoustic signal into an electric signal in accordance with Fleming's right-hand law, the device is able to be used as a microphone.

However, in the above conventional flat speaker, because a large portion of the coil is positioned facing the magnetic pole face of the bar magnets, a magnetic field acts on the coil portion positioned facing the magnetic pole face of the bar magnets in a direction perpendicular to the surface of the vibrating membrane. Therefore, force, which acts on the electric current flowing through the coil portion from the electric field, acts in a direction along the surface of the vibrating membrane. The problem then arises that this force in a direction along the surface of the vibrating membrane causes twisting in the surface of the vibrating membrane and becomes a noise component in the acoustic signal leading to a reduction in the sound quality.

Moreover, because the plurality of bar magnets are arranged in parallel longitudinally, the length of the portion of the coil which interlinks with the magnetic field is approximately twice the product obtained by multiplying the length of the bar magnets by the number of windings of the coil. Consequently, the proportion of the surface area of the vibrating membrane occupied by those portions of the coils interlinking with the magnetic field is low. Therefore, the problem has been that, not only has it not been possible to obtain sufficient volume due the deterioration in the efficiency of the acoustic conversion, but the sound quality has also been low.

Furthermore, the shape of the speakers has been determined by the length and number of the bar magnets used, which has placed limitations on freedom of the speaker design. Moreover, the problem has also existed that, because a coil is provided for each bar magnet along the longitudinal direction of the bar magnets, there has been a lack of flexibility in the setting of the speaker impedance to a suitable value.

In addition, in a conventional flat speaker, because the distance from the vibrating membrane to the magnetic pole face of the bar magnets is different by the thickness of the bar magnets from the distance from the vibrating membrane to the portions of the yoke between the bar magnets, a phase difference is caused in the sound generated from the vibrating membrane which is reflected from the rear magnetic pole face and the yoke so as to reach the vibrating membrane surface. Therefore, the further problem exists that, because the vibrating membrane is twisted due to the sound pressure distribution corresponding to this phase difference becoming a noise component in the acoustic signal, the sound quality is further deteriorated.

In order to solve these problems, the filling of the space between the vibrating membrane and the magnetic pole face with a pliable material such as sponge or the like can be considered. However, the vibration of the vibrating membrane is hindered by the pliable material so that the sound quality of low sounds in particular is deteriorated.

Because a plurality of bar magnets are disposed such that the longitudinal directions thereof are parallel, the lengths of the portions interlinking with the magnetic fields of the respective coils are about twice the product of the long side of the bar magnet and the number of windings of the coil. The proportion of the surface area occupied thereby with respect to the surface area of the vibrating membrane at the portion interlinking with the magnetic field of the coil is low. As a result, the efficiency of acoustic conversion is poor and a sufficient sound volume cannot be obtained, and in addition, sufficient sound quality cannot be obtained.

Further, the configuration of the speaker is determined by the length of the bar magnet and the number of bar magnets which are provided, such that the degrees in freedom in designing the configuration of the speaker are limited. Moreover, a coil is provided for each bar magnet along the longitudinal direction of the bar magnet. Thus, a problem arises in that there is little flexibility in setting the impedance of the speaker to an appropriate value.

Moreover, although, in conventional flat speakers, the vibrating membrane is placed adjacent to the magnetic pole face of the bar magnets, a gap exists between the vibrating membrane and the magnetic pole face. Therefore, the problem exists that the flat speaker itself is made too thick.

Furthermore, if the shape of a conventional flat speaker is made still larger and narrower, slackness develops in the vibrating membrane leading to the vibrating membrane and the yoke no longer being parallel to each other. Consequently, the distances from each point on the vibrating membrane to the yoke or the magnetic pole face of the bar magnets is not uniform. The result of this is that the drawback arises that a phase difference is generated in the reflected sound which is reflected by the yoke and the like so as to come back to the vibrating membrane, and twisting of the vibrating membrane is caused by the sound pressure distribution. This creates noise and a reduction in sound quality.

The present invention has been achieved in order to solve the above problems in the prior art and the first object of the present invention is to provide a flat acoustic conversion device in which twisting of the vibrating membrane is reduced and noise components are decreased.

The second object of the present invention is to provide a flat acoustic conversion apparatus in which the length of the portion of the coils intersecting the magnetic field is lengthened thus increasing the proportion of the surface of the vibrating membrane occupied by the coils and improving the acoustic conversion efficiency. This, in turn, leads to an improvement in sound quality.

The third object of the present invention is to provide a flat acoustic conversion device in which the lengths of the portions interlinking with the magnetic fields of the coils are long and the proportion of the surface area occupied by the coils on the surface of a vibrating membrane is increased, such that the efficiency of acoustic conversion is improved and sound quality is improved.

The fourth object of the present invention is to provide a flat acoustic conversion device which is even thinner than the prior art.

The fifth object of the present invention is to provide a flat speaker device which can always provide a high quality audio output regardless of the shape of the vibrating membrane.

SUMMARY OF THE INVENTION

In order to achieve the above objects, the first aspect of the present invention is a flat acoustic conversion device comprising: a first magnet disposed so that a first magnetic pole face is substantially parallel to a predetermined surface; a second magnet disposed adjacent to or in contact with the first magnet such that a second magnetic pole face having a polarity different from the polarity of the first magnetic pole face is substantially parallel to the predetermined surface and faces towards the same side as the first magnetic pole face of the first magnet; a vibrating member disposed so as to face towards the predetermined surface; a first coil which is helically wound and is disposed such that magnetic flux interlinks in a position on the vibrating member which corresponds to the first magnetic pole face; and a second coil which is helically wound and is disposed such that magnetic flux interlinks in a position on the vibrating member which corresponds to the second magnetic pole face.

The first magnet of the first aspect of the present invention is disposed such that a first magnetic pole face having a first polarity (e.g. N polarity) is substantially parallel to a predetermined surface. The second magnet is disposed either adjacent to or in contact with the first magnet such that a second magnetic pole face having a second polarity (e.g. S polarity) which is different from the first polarity is substantially parallel to the predetermined surface and faces the same side as the first magnetic pole face of the first magnet. Note that first magnet and second magnet can be disposed on the predetermined surface, or may be disposed so that the outer periphery thereof is supported by a frame or the like. Further, the vibrating member formed by a vibrating membrane or a vibrating plate may be disposed facing the predetermined surface. In all of the inventions, the vibrating member may be formed by a vibrating membrane or a vibrating plate.

A first coil and a second coil, both of which are formed in a helical shape, are provided on the vibrating member. The first coil is disposed such that the magnetic flux interlinks in a position on the vibrating member which corresponds to the first magnetic pole face. The second coil is disposed such that the magnetic flux interlinks in a position on the vibrating member which corresponds to the second magnetic pole face in the same way as the first coil.

As a result, the magnetic flux generated by each magnet travels from the first magnetic pole face to the second magnetic pole face or from the second magnetic pole face to the first magnetic pole face and the magnetic flux in the area between the first magnetic pole face and the second magnetic pole face, and accordingly, the magnetic flux in the area between the first magnet and the second magnet travels in a direction substantially parallel to the surface of the vibrating member. When the first magnet and second magnet are spaced a predetermined distance apart, the density of the magnetic flux in a direction parallel to the surface of the vibrating membrane in the area between the first magnet and second magnet decreases as the distance between the magnets increases. However, in the present invention, because the first magnet and second magnet are placed adjacent to or in contact with each other, the density of the magnetic flux in a direction parallel to the surface of the vibrating member can be set at the maximum enabling the sound pressure to be increased.

In order to achieve the above objects, the second aspect of the present invention is a flat acoustic conversion device comprising: a first magnet disposed so that a first magnetic pole face is substantially parallel to a predetermined surface; a second magnet disposed at a predetermined distance apart from the first magnet or in contact with the first magnet such that a second magnetic pole face having a polarity different from the polarity of the first magnetic pole face is substantially parallel to the predetermined surface and faces towards the same side as the first magnetic pole face of the first magnet; a vibrating member disposed so as to face towards the first magnetic pole face and the second magnetic pole face; a pliable air layer forming member disposed so as to form together with the vibrating member an air layer of a predetermined thickness on the first magnetic pole face and second magnetic pole face sides of the vibrating member; a first coil which is helically wound and is disposed such that magnetic flux interlinks in an area on the vibrating member which corresponds to the first magnetic pole face; and a second coil which is helically wound and is disposed such that magnetic flux interlinks in an area on the vibrating member which corresponds to the second magnetic pole face.

The first magnet and second magnet of the second aspect of the present invention are disposed in the same manner as the first magnet and second magnet of the first aspect of the present invention.

Furthermore, the first coil and second coil of the second aspect of the present invention are disposed on the vibrating member in the same manner as in the first aspect of the present invention.

In the present invention the first magnet and second magnet can be spaced a predetermined distance apart from each other or may be disposed either adjacent to (i.e. almost in contact with) or actually in contact with each other.

When the first magnet and second magnet are spaced a predetermined distance apart, it is effective if the first coil is disposed such that the inner periphery and outer periphery of the spiral coils are positioned on either side of a position corresponding to an outer edge of the first magnetic pole face of the vibrating member while, at the same time, the second coil is disposed such that the inner periphery and outer periphery of the spiral coils are positioned on either side of a position corresponding to an outer edge of the second magnetic pole face of the vibrating member. When the first magnet and second magnet are placed in contact with each other, the inner periphery of each coil is positioned to the outer side of an area which includes a position corresponding to the center of the magnetic pole faces of the vibrating member. Namely, it is effective if the first coil is disposed in an area on the vibrating member extending from a position corresponding to an outer edge of the first magnetic pole face to a position a predetermined distance in the direction of a position corresponding to the center of the first magnetic pole face, and if the second coil is disposed in an area on the vibrating member extending from a position corresponding to an outer edge of the second magnetic pole face to a position a predetermined distance in the direction of a position corresponding to the center of the second magnetic pole face.

A pliable air layer-forming member is disposed on the first magnetic pole face and second magnetic pole face sides of the vibrating member of the second aspect of the present invention so as to form together with the vibrating member an air layer of a predetermined thickness. When the air layer forming member is provided, sound generated from the vibrating member is still reflected by the air layer forming member and returned to the vibrating member. However, because an air layer of a predetermined thickness is formed between the vibrating member and the air layer forming member, no phase difference is generated in the reflected sound and no twisting in the vibrating member is consequently caused. Therefore, the sound quality is excellent.

Note that neither is there any twisting in the vibrating membrane caused by reflected sound when the first magnet and second magnet are disposed in contact with each other because no phase difference is generated in the reflected sound from the magnetic pole face, however, because the magnet itself is formed from a hard material, it has a high degree of reflectivity and the reflected sound increases. In the present invention, reflected sound can be reduced thanks to the provision of a pliable air layer-forming member.

In order to achieve the above objects, the third aspect of the present invention is a flat acoustic conversion device comprising: a vibrating body provided with a vibrating member, a helically shaped first coil disposed on the vibrating member, and a helically shaped second coil disposed on the vibrating member adjacent to the first coil; a first magnet which is provided with a first magnetic pole face and which is mounted to the vibrating body such that the first magnetic pole face corresponds to the first coil; and a second magnet which is provided with a second pole face having a polarity different to that of the first magnetic pole face and facing towards the same side as the first magnetic pole face and which second magnet is mounted to the vibrating body so as to be a predetermined distance apart from the first magnet or so as to be in contact with the first magnet and such that the second magnetic pole face corresponds to the second coil The vibrating body of the third aspect of the present invention is provided with a vibrating member, a helically shaped first coil disposed on the vibrating member, and a helically shaped second coil disposed on the vibrating member adjacent to the first coil. The first magnet is provided with a first magnetic pole face having a first polarity (e.g. N polarity) and is mounted to the vibrating body such that the first magnetic pole face corresponds to the first coil. The second magnet is provided with a second magnetic pole face having a second polarity (e.g. S polarity) which is different to the first polarity. The second magnet is mounted to the vibrating body so as to be a predetermined distance apart from the first magnet or so as to be in contact with the first magnet and so as to face towards the same side as the first magnetic pole face and in such a manner that the second magnetic pole face corresponds to the second coil. it is preferable that these magnets are mounted so as to be relatively movable with respect to the vibrating body.

As a result, the magnetic flux generated from each magnet travels from the first magnetic pole face towards the second magnetic pole face or from the second magnetic pole face towards the first magnetic pole face. Accordingly, the magnetic flux in the area between the first magnetic pole face and the second magnetic pole face, and consequently, the magnetic flux in the area between the first magnet and the second magnet travels in a direction substantially parallel to the surface of the vibrating member and interlinks with the first coil and the second coil. Therefore, by changing the current flowing through the first coil and second coil, the force acting on the current from the magnetic field is changed and the vibrating body, the first magnet, and the second magnet vibrate integrally together. In the third aspect of the invention, because the first magnet and the second magnet are mounted to the vibrating body, the thickness of the flat acoustic conversion device itself can be made thinner than in the prior art.

The fourth aspect of the present invention is a flat acoustic conversion device comprising: a vibrating body provided with a vibrating member, a helically shaped first coil disposed on the vibrating member, and a helically shaped second coil disposed on the vibrating member adjacent to the first coil; a holding member which is capable of holding a plurality of magnets between itself and the vibrating body and which is disposed so as to be facing the vibrating member; a first magnet which is provided with a first magnetic pole face and which is held between the vibrating body and the holding member such that the first magnetic pole face corresponds to the first coil; and a second magnet which is provided with a second pole face having a polarity different to that of the first magnetic pole face and facing towards the same side as the first magnetic pole face and which second magnet is held between the vibrating body and the holding member so as to be a predetermined distance apart from the first magnet or so as to be in contact with the first magnet and such that the second magnetic pole face corresponds to the second coil.

In the fourth aspect of the present invention, the first magnet and second magnet are held between (and preferably closely adhered to) the vibrating body and a holding member. By changing the current flowing through the first coil and second coil, the force acting on the current from the magnetic field is changed and the vibrating body, the first magnet, the second magnet, and the holding member vibrate integrally together. In the fourth aspect of the invention, because the first magnet and the second magnet are held between the vibrating body and the holding member, the thickness of the flat acoustic conversion speaker itself can be made thinner than in the prior art, in the same way as in the third aspect.

Note that, in the fourth aspect of the present invention, it is possible for the holding member to be formed from a thin membrane such as the vibrating member. However, by forming the holding member from a vibrating body provided with a vibrating member, a helically shaped first coil disposed on the vibrating member, and a helically shaped second coil disposed on the vibrating member adjacent to the first coil, and by positioning the first coil and second coil so that the first coil corresponds to a magnetic pole face opposite to the first magnetic pole face of the first magnet and the second coil corresponds to a magnetic pole face opposite to the second magnetic pole face of the second magnet, and by sandwiching the first magnet and second magnet (preferably in a state of close adhesion) between a pair of vibrating bodies, the number of interlinking magnetic fluxes increases and the sound pressure can also be increased.

Note also that the first magnet and the second magnet can be directly mounted to the vibrating body or can be directly held between a vibrating body and holding member as described above. However, it is also possible to mount the first and second magnets to the vibrating body with a non-magnetic pliable member between the two, or to hold the first and second magnets between the vibrating body and holding member with non-magnetic pliable members placed between the magnets and the vibrating body and holding member. Moreover, when the first and second magnets are to be mounted, it is preferable if the first and second magnets are mounted by a part of each magnet. When the first and second magnets are held between the vibrating body and the holding member, it is possible for the first and second magnets to be held with a part of the magnets mounted or for the first and second magnets to be held with out a ny part of the magnets being mounted. It is preferable if a non-magnetic sheet material that is pliable and porous is used for the pliable member, such as rock wool, glass wool, non-woven fabric, Japanese paper, or the like.

When the first and second magnets are spaced a predetermined distance apart, the density of the magnetic flux in a direction parallel to the surface of the vibrating member in the area between the first and second magnets decreases as the distance between the first and second magnets increases. If, however, the first and second magnets are placed adjacent to (i.e. almost in contact with) or in contact with each other, the density of the magnetic flux in the direction parallel to the surface of the vibrating member can be set at the maximum and the sound pressure increased even further.

When the first and second magnets are spaced a predetermined distance apart or when the first and second magnets are disposed in contact with each other, it is effective if the first and second coils are disposed as described in the second aspect of the present invention.

In the above described first through fourth aspects of the present invention, the first coil and second coil are both disposed such that their magnetic fluxes interlink at positions on the vibrating member corresponding to the first magnetic pole face and second magnetic pole face. Moreover, as described above, because the magnetic flux in the area between the first and second magnets travels in a direction substantially parallel to the surface of the vibrating member, the magnetic flux acts in a direction substantially parallel with the surface of the vibrating member on the portion extending from the inner periphery of the first coil adjacent to the second coil to the outer periphery and from the inner periphery of the second coil adjacent to the first coil to the outer periphery.

Therefore, when current is fed to the first and second coils, the direction of the force which the current receives from the magnetic field is substantially perpendicular to the surface of the vibrating member and the force in the direction of the surface of the vibrating member is decreased resulting in it being possible to reduce noise components and improve sound quality.

Note that, it is preferable if the vibrating member is placed adjacent to and facing the first magnetic pole face and second magnetic pole face because this allows the magnetic flux traveling in a direction substantially parallel to the surface of the vibrating member and acting on those portions of the first coil and the second coil adjacent to each other to be increased.

If current is fed in the same direction through the portion of the first coil adjacent to the second coil and through the portion of the second coil adjacent to the first coil, the direction of the force which the current flowing through the portion extending from the inner periphery of the first coil adjacent to the second coil to the outer periphery receives from the magnetic field, and the direction of the force which the current flowing through the portion extending from the inner periphery of the second coil adjacent to the first coil to the outer periphery receives from the magnetic field, are the same. Therefore, an acoustic signal having a large sound volume can be generated.

If current is fed in the same direction through the portion of the first coil adjacent to the second coil and through the portion of the second coil adjacent to the first coil in the same vibrating body used in both the third and fourth aspects of the present invention, the direction of the force which the current flowing through the portion extending from the inner periphery of the first coil adjacent to the second coil to the outer periphery receives from the magnetic field, and the direction of the force which the current flowing through the portion extending from the inner periphery of the second coil adjacent to the first coil to the outer periphery receives from the magnetic field, are the same. Therefore, a large sound volume acoustic signal can be generated.

When current is supplied in the same direction to each coil, the current may be fed to each coil independently. However, as described below, the first coil and second coil may be connected and the current fed in the same direction to the portion of the first coil adjacent to the second coil and to the portion of the second coil adjacent to the first coil. Namely, when the coil winding directions of the first and second coils are both the same from the outer peripheries to the inner peripheries thereof, as is shown in FIGS. 2A and 2B, either the inner peripheral sides of both the first coil L1 and the second coil L2 are connected or the outer peripheral sides of both the first coil L1 and the second coil L2 are connected.

If, however, the directions of the coils of the first and second coils are different going from the outer periphery to the inner periphery, as is shown in FIGS. 3A and 3B, the inner peripheral side of one of the first coil L1 and second coil L2 can be connected to the outer peripheral side of the other coil. Alternatively, as shown in FIG. 3C, the inner peripheral sides of both the first coil L1 and the second coil L2 can be connected to each other, and the outer peripheral sides of both the first coil L1 and the second coil L2 can be connected to each other. Note that the direction indicated by the arrows in FIGS. 2A, 2B, 3A, 3B and 3C is the direction traveled by the current.

Note also that in the third and fourth aspects of the present invention, when a first magnet and second magnet are held between a pair of vibrating bodies, if the direction of the current flowing through the portion of the first coil adjacent to the second coil and the portion of the second coil adjacent to the first coil is able to be reversed in each vibrating body, it is possible to make the direction of the force from the magnetic field received by the current flowing through the coils of each vibrating body the same.

The fifth aspect of the present invention is a flat acoustic conversion device comprising: a first magnet disposed so that a first magnetic pole face is substantially parallel to a predetermined surface; a second magnet disposed adjacent to or in contact with the first magnet such that a second magnetic pole face having a polarity different from the polarity of the first magnetic pole face is substantially parallel to the predetermined surface and faces towards the same side as the first magnetic pole face of the first magnet; a vibrating member disposed so as to face towards the predetermined surface; a first coil which is helically wound and is disposed such that magnetic flux interlinks in a position on the vibrating member which corresponds to the first magnetic pole face; a second coil which is formed in a helical shape wound in the opposite direction to the first coil and is disposed such that magnetic flux interlinks in a position on the vibrating member which corresponds to the first magnetic pole face, and which is provided at a position on the vibrating member overlapping with the first coil, and whose inner peripheral end is connected to an inner peripheral end of the first coil; a third coil which is formed in a helical shape wound in the same direction as the second coil, and which is disposed such that magnetic flux interlinks in a position on the vibrating member which corresponds to the second magnetic pole face, and whose outer peripheral end is connected to an outer peripheral end of the second coil; and a fourth coil which is formed in a helical shape wound in the same direction as the first coil, and which is disposed such that magnetic flux interlinks in a position on the vibrating member which corresponds to the second magnetic pole face, and which is provided at a position on the vibrating member overlapping with the third coil, and whose inner peripheral end is connected to an inner peripheral end of the third coil.

The sixth aspect of the present invention is a flat acoustic conversion device comprising: a vibrating body provided with a vibrating member, a first coil which is helically wound and is disposed on the vibrating member, a second coil which is helically wound in the opposite direction to the first coil and is disposed on the vibrating member so as to overlap with the first coil, and whose inner peripheral end is connected to an inner peripheral end of the first coil, a third coil which is formed in a helical shape wound in the same direction as the second coil, and is disposed on the vibrating member so as to be adjacent to the second coil, and whose outer peripheral end is connected to an outer peripheral end of the second coil, and a fourth coil which is formed in a helical shape wound in the same direction as the first coil, and is disposed on the vibrating member so as to be adjacent to the first coil and to overlap with the third coil, and whose inner peripheral end is connected to an inner peripheral end of the third coil; a first magnet which is provided with a first magnetic pole face and is mounted to the vibrating body such that the first magnetic pole face corresponds to the first coil and second coil; and a second magnet which is provided with a second magnetic pole face having a polarity different from the polarity of the first magnetic pole face and facing towards the same side as the first magnetic pole face, and which second magnet is disposed either a predetermined distance apart from the first magnet or in contact with the first magnet, and which is mounted to the vibrating body such that the second magnetic pole face corresponds to the third coil and fourth coil.

The seventh aspect of the present invention is a flat acoustic conversion device comprising: a vibrating body provided with a vibrating member, a first coil which is helically wound and is disposed on the vibrating member, a second coil which is helically wound in the opposite direction to the first coil and is disposed on the vibrating member so as to overlap with the first coil, and whose inner peripheral end is connected to an inner peripheral end of the first coil, a third coil which is formed in a helical shape wound in the same direction as the second coil, and is disposed on the vibrating member so as to be adjacent to the second coil, and whose outer peripheral end is connected to an outer peripheral end of the second coil, and a fourth coil which is formed in a helical shape wound in the same direction as the first coil, and is disposed on the vibrating member so as to be adjacent to the first coil and to overlap with the third coil, and whose inner peripheral end is connected to an inner peripheral end of the third coil; a holding member which is capable of holding a plurality of magnets between itself and the vibrating body and which is disposed so as to be facing the vibrating body; a first magnet which is provided with a first magnetic pole face and is held between the vibrating body and the holding member such that the first magnetic pole face corresponds to the first coil and second coil; and a second magnet which is provided with a second magnetic pole face having a polarity different from the polarity of the first magnetic pole face and facing towards the same side as the first magnetic pole face, and which second magnet is disposed either a predetermined distance apart from the first magnet or in contact with the first magnet, and which is held between the vibrating body and the holding member such that the second magnetic pole face corresponds to the third coil and fourth coil.

Namely, in the sixth and seventh aspects of the present invention, the vibrating body of the third and fourth aspects is provided with the following. Namely, the vibrating body is provided with a vibrating member, a first coil which is helically wound and is disposed on the vibrating member, a second coil which is formed in a helical shape wound in the opposite direction to the first coil and is disposed on the vibrating member so as to overlap with the first coil, and whose inner peripheral end is connected to an inner peripheral end of the first coil, a third coil which is formed in a helical shape wound in the same direction as the second coil, and is disposed on the vibrating member so as to be adjacent to the second coil, and whose outer peripheral end is connected to an outer peripheral end of the second coil, and a fourth coil which is formed in a helical shape wound in the same direction as the first coil, and is disposed on the vibrating member so as to be adjacent to the first coil and to overlap with the third coil, and whose inner peripheral end is connected to an inner peripheral end of the third coil.

In the eighth aspect of the present invention, the holding member of the seventh aspect of the present invention is formed from a vibrating body provided with a vibrating member, a first coil which is helically wound and is disposed on the vibrating member, a second coil which is formed in a helical shape wound in the opposite direction to the first coil and is disposed on the vibrating member so as to overlap with the first coil, and whose inner peripheral end is connected to an inner peripheral end of the first coil, a third coil which is formed in a helical shape wound in the same direction as the second coil, and is disposed on the vibrating member so as to be adjacent to the second coil, and whose outer peripheral end is connected to an outer peripheral end of the second coil, and a fourth coil which is formed in a helical shape wound in the same direction as the first coil, and is disposed on the vibrating member so as to be adjacent to the first coil and to overlap with the third coil, and whose inner peripheral end is connected to an inner peripheral end of the third coil.

The ninth aspect of the present invention is a flat acoustic conversion device comprising: a first magnet disposed so that a first magnetic pole face is substantially parallel to a predetermined surface; a second magnet disposed a predetermined distance apart from the first magnet or in contact with the first magnet such that a second magnetic pole face having a polarity different from the polarity of the first magnetic pole face is substantially parallel to the predetermined surface and faces towards the same side as the first magnetic pole face of the first magnet; a vibrating member disposed so as to face towards the first magnetic pole face and the second magnetic pole face; a pliable air layer forming member disposed so as to form together with the vibrating member an air layer of a predetermined thickness on the first magnetic pole face and second magnetic pole face sides of the vibrating member; a first coil which is helically wound and is disposed such that magnetic flux interlinks in an area on the vibrating member which corresponds to the first magnetic pole face; a second coil which is formed in a helical shape wound in the opposite direction to the first coil and is disposed such that magnetic flux interlinks in an area on the vibrating member which corresponds to the first magnetic pole face, and such that the second coil overlaps with the first coil in an area on the vibrating member which corresponds to the first magnetic pole face, and whose inner peripheral end is connected to an inner peripheral end of the first coil; a third coil which is formed in a helical shape wound in the same direction as the second coil, and which is disposed such that magnetic flux interlinks in an area on the vibrating member which corresponds to the second magnetic pole face, and whose outer peripheral end is connected to an outer peripheral end of the second coil; and a fourth coil which is formed in a helical shape wound in the same direction as the first coil, and which is disposed such that magnetic flux interlinks in an area on the vibrating member which corresponds to the second magnetic pole face, and such that the fourth coil overlaps with the third coil in an area on the vibrating member which corresponds to the second magnetic pole face, and whose inner peripheral end is connected to an inner peripheral end of the third coil.

In the fifth to ninth aspects of the present invention, a first coil is provided on one surface of the vibrating member and a second coil is provided on another surface of the vibrating member. The inner peripheral end of the second coil is passed through the vibrating member and connected to the internal peripheral end of the first coil. A third coil is provided on the other surface of the vibrating member and a fourth coil is provided on the one surface of the vibrating member. The inner peripheral end of the fourth coil is passed through the vibrating member and connected to the inner peripheral end of the third coil. By providing coils on both surfaces of the vibrating member in this manner, the vibrating member can be used efficiently.

Moreover, because the inner peripheral ends of the first and second coils are connected to each other, and because the inner peripheral ends of the third and fourth coils are connected to each other, and because the outer peripheral ends of the second and third coils are connected to each other, the coils can be formed from a single continuous wire.

In the fifth to ninth aspects, the first coil, the second coil, the third coil, and the fourth coil form one coil group and the outer peripheral end of the first coil of one coil group can be connected to the outer peripheral end of the fourth coil of the adjacent coil group. In this way, it is possible to arrange a plurality of coil groups. In this case as well, because the current flows in the same direction through each coil of adjacent coil groups disposed on the same surface, the efficiency can be improved and noise generation can be reduced to an absolute minimum.

It is possible to superpose a plurality of these coil groups in the direction of the coil thickness.

In the sixth to ninth aspects of the present invention as well, as in the second to fourth aspects, when the first magnet and second magnet are positioned a predetermined distance apart, it is effective if the coils are disposed such that the inner and outer peripheries of the spiral coils are positioned at positions on the vibrating body sandwiching a position corresponding to the outer edge of the first magnetic pole face. When the first magnet and second magnet are positioned in contact with each other, it is effective if the coils are positioned such that the inner peripheries of the spiral coils are each positioned on the vibrating body outside an area which includes a position corresponding to the center of the magnetic pole faces, and such that the outer peripheries of the spiral coils do not overlap each other.

Note that in the sixth to eighth aspects of the present invention, when the first magnet and second magnet are sandwiched between a pair of vibrating bodies, the direction of the current flowing through the coils corresponding to the respective magnets is reversed for each of the vibrating bodies. As a result, the directions of the forces from the magnetic fields acting on the current flowing through the coils of the respective vibrating bodies are made the same and the numbers of interlinking magnetic fluxes increased, thus enabling the sound pressure to be increased.

The tenth aspect of the present invention is a flat acoustic conversion device comprising: a first magnet disposed so that a first magnetic pole face is substantially parallel to a predetermined surface; a second magnet disposed adjacent to or in contact with the first magnet such that a second magnetic pole face having a polarity different from the polarity of the first magnetic pole face is substantially parallel to the predetermined surface and faces towards the same side as the first magnetic pole face of the first magnet; a vibrating member provided with a conductor placement portion and having a conductor which interlinks with magnetic flux from the first and second magnets disposed on the conductor placement portion; a housing member for housing the conductor and the vibrating member together; and a pliable supporting member for enveloping the conductor placement portion of the vibrating member together with the conductor and thereby supporting the conductor placement portion of the vibrating member together with the conductor such that the conductor placement portion of the vibrating member is capable of vibrating together with the conductor without the conductor placement portion of the vibrating member and the conductor coming into contact with the inner surface of the housing member.

A conductor is placed on the conductor placement portion of the vibrating member of the tenth aspect of the present invention. The vibrating member and the conductor are supported inside a housing member by being enveloped by a pliable supporting member such that the vibrating member is capable of vibrating together with the conductor without the vibrating member and conductor coming into contact with the internal surface of the housing member. Therefore, when current is supplied to a conductor with which magnetic flux interlinks, the current flowing through the conductor receives force from the magnetic flux and the conductor placement portion of the vibrating member is energized so as to vibrate together with the conductor, thus producing sound. Ester wool, a non-woven fabric made from urethane, cloth, cotton, or the like can be used for the pliable supporting member. In addition to the coils formed in a helical shape that are described below, it is also possible to use as the conductors conducting wires and the like positioned where the magnetic flux interacts.

According to the tenth aspect of the present invention, because the peripheral ends of the conductor placement portion of the vibrating member act as a free terminal, it is possible to cause the entire conductor placement portion of the vibrating member to vibrate at a large amplitude. As a result, the vibrating member can be made to vibrate efficiently.

The eleventh aspect of the present invention is a flat acoustic conversion device comprising: a first magnet disposed so that a first magnetic pole face is substantially parallel to a predetermined surface; a second magnet disposed adjacent to or in contact with the first magnet such that a second magnetic pole face having a polarity different from the polarity of the first magnetic pole face is substantially parallel to the predetermined surface and faces towards the same side as the first magnetic pole face of the first magnet; a vibrating member provided with a coil placement portion and having a coil which interlinks with magnetic flux from the first and second magnets disposed on the coil placement portion; a housing member for housing the coil and the vibrating member together; and a pliable supporting member for enveloping the coil placement portion of the vibrating member together with the coil and thereby supporting the coil placement portion of the vibrating member together with the coil such that the coil placement portion of the vibrating member is capable of vibrating together with the coil without the coil placement portion of the vibrating member and the coil coming into contact with the inner surface of the housing member.

A coil is placed on the coil placement portion of the vibrating member of the eleventh aspect of the present invention. The vibrating member and the coil are supported inside a housing member by being enveloped by a pliable supporting member such that the vibrating member is capable of vibrating together with the coil without the vibrating member and coil coming into contact with the internal surface of the housing member. Accordingly, the peripheral ends of the vibrating member are supported in a state of being a free end which can vibrate. Therefore, when current is supplied to a coil with which magnetic flux interlinks, the current flowing through the coil receives force from the magnetic flux and the coil placement portion of the vibrating member is energized so as to vibrate together with the coil, thus producing sound. Ester wool, a non-woven fabric made from urethane, cloth, cotton, or the like can be used for the pliable supporting member.

According to the eleventh aspect of the present invention, because the peripheral ends of the coil placement portion of the vibrating member act as a free end, it is possible to cause the entire coil placement portion of the vibrating member to vibrate at a large amplitude. As a result, the vibrating member can be made to vibrate efficiently.

Note that it is preferable if the coil placement portion is disposed adjacent to and facing the first magnetic pole face and second magnetic pole face because, in that case, the magnetic flux traveling in a direction substantially parallel with the vibrating member surface and acting on those portions of the first and second coils which are adjacent to each other can be increased.

Moreover, in the tenth and eleventh aspects of the present invention, it is possible to place the first and second magnets on a flexible member such as cloth, flexible plastic, or the like and to form the housing member from a flexible member of the same material as that used above. By using this structure, it is possible to make the flat acoustic conversion device itself flexible which makes it possible to accommodate the flat acoustic conversion device inside clothing, or inside a shoulder pad, or the like. Note that it is also possible to form the flexible member from a plurality of small rigid pieces connected together.

In the twelfth aspect of the present invention, a speaker edge is used which is provided with a curved portion comprising an elastic member having a portion between an outer peripheral portion and an inner peripheral portion thereof formed in a curved shape, and an outer peripheral portion of which speaker edge is fixed to a frame, and an outer peripheral portion of a vibrating member is fixed to an inner peripheral portion of the speaker edge, wherein a high elastic modulus portion whose modulus of elasticity is higher than a modulus of elasticity of surrounding portions is formed in at least one portion in the longitudinal direction of the curved portion thus reducing the amount the high elastic modulus portion is displaced by external force.

When the speaker edge is supporting a vibrating member, the load of the vibrating member is borne by the curved portion. The load on the curved portion differs depending on the size and shape of the vibrating member. The load also differs depending on the location of the curved portion. If the vibrating member has a narrow, elongated shape, the load is particularly large on the curved portion near the center in the longitudinal direction of the vibrating member, leading to the vibrating member sagging. As a result, the vibrating member cannot be kept parallel to the main surface of the frame. Therefore, high elastic modulus portions are provided in the curved portion at positions where the load is thought to be great, preventing the vibrating member from sagging. When sound is output, because the vibrating member starts vibrating from this state, a flat wave with no phase difference can be output.

It is also possible to provide the high elastic modulus portion by thickening at least one portion in the longitudinal direction of the curved portion, or by increasing the density of the elastic member forming that one portion.

The thirteenth aspect of the present invention is a flat acoustic conversion device comprising: a frame provided with a base on which a plurality of magnets are arranged such that a direction faced by a predetermined polarity of one magnet is the opposite of a direction faced by a predetermined polarity of a magnet adjacent to the one magnet, and a peripheral wall provided on the base so as to surround the plurality of magnets; a vibrating member facing the base and provided with a first helically wound coil and a second helically wound coil whose coil winding directions differ in accordance with a polarity of whichever of the plurality of magnets the coil is facing; and a speaker edge provided with a curved portion comprising an elastic member having a portion between an outer peripheral portion and an inner peripheral portion thereof formed in a curved shape, and an outer peripheral portion of the speaker edge is fixed to a frame, and an outer peripheral portion of the vibrating member is fixed to an inner peripheral portion of the speaker edge, and a high elastic modulus portion whose modulus of elasticity is higher than a modulus of elasticity of surrounding portions is formed in at least one portion in the longitudinal direction of the curved portion thus reducing the amount the high elastic modulus portion is displaced by external force.

The speaker edge supports the vibrating member such that the first and second helically wound coils are positioned above the plurality of magnets which have different polarities in a direction perpendicular to the surface of the base. Each of the magnets is positioned on the base such that the orientation of the polarity of one magnet is different from the orientation of the polarity of a magnet adjacent to the one magnet. Accordingly, the direction of a magnetic flux (magnetic field) is from a particular magnet to a magnet adjacent to that particular magnet so that the magnetic flux between magnets increases. When current for a sound signal is supplied to the first and second helical coils, a force is generated in the first and second helical coils in accordance with Fleming's left-hand law. As a result, the vibrating member is displaced in a direction perpendicular to the surface thereof, thus producing a sound. In this case, the curved portion of the speaker edge provided with a higher modulus of elasticity at portions where the load is likely to be great, thus preventing the vibrating member from sagging. When sound is output, because the vibrating member starts vibrating from this state, a flat wave with no phase difference can be output.

It is also possible to provide the high elastic modulus portion in the speaker edge by thickening at least one portion in the longitudinal direction of the curved portion, or by increasing the density of the elastic member forming that one portion. Alternatively, it is possible to provide a plurality of high elastic modulus portions in the longitudinal direction of the curved portion.

In each of the above aspects, a plurality of magnet rows comprising alternate first and second magnets in one direction can be arranged such that the first and second magnets are alternated in a second direction at a right angle to the first direction. By using this type of arrangement, a plurality of first magnets and a plurality of second magnets can be arranged in a matrix pattern. Moreover, when the magnets are arranged in a matrix pattern, it is possible to provide first and second coils or first to fourth coils to correspond to each of the first and second magnets thus positioned.

Moreover, in the third and fourth aspects of the invention, when the magnets are arranged in a matrix pattern, as described above, it is possible to position each of the first and second magnets so as to correspond to each of the first and second coils or first to fourth coils.

By arranging each of a plurality of first magnets and a plurality of second magnets in a matrix formation, as described above, it is possible to increase the number of magnets in comparison with when bar magnets are arranged in rows. Moreover, because the number of coils provided is the same as or a multiple of the number of magnets, the overall length of the portions of the coils interlinking with the magnetic flux can be lengthened. Further, the proportion of the surface of the vibrating member occupied by the coils is increased, thereby improving the sound conversion efficiency and further improving the sound quality.

As described above, when a plurality of first magnets and a plurality of second magnets are arranged in a matrix pattern, the first coils L1 and the second coils L2 can be connected as is shown in FIGS. 2 and 3 described above.

Furthermore, when a plurality of first magnets and a plurality of second magnets are used, coil group units each comprising first and second coils connected together in series, as shown in FIGS. 2 and 3, can be connected in parallel, as shown in FIG. 3C.

By connecting together a plurality of coils in series or in parallel, or in a combination of serial and parallel connections, the impedance of the flat speaker can be set to an appropriate value. Moreover, because the coils can be freely connected in this way, it is possible to form a coil group from either one coil or from a plurality of coils connected together. As a result, by providing a plurality of coil groups inside a flat speaker unit and connecting a separate signal source to each coil group, multi-channel sound sources or stereophonic sound sources can be obtained using a single flat speaker. It is, of course, also possible to connect a single signal source to all of the coil groups.

At least one of the first and second magnets can be made in a plurality of types of shape. In this case, the first and second coils can be wound in shapes which are the same as the outlines of the first and second magnets. By forming magnets in a plurality of different shapes, it is possible to arrange the first and second magnets to match the shape of the flat acoustic conversion apparatus. Therefore, any shape can be given to the flat acoustic conversion device allowing increased freedom when designing the shape of the overall acoustic conversion device.

The above magnets and coils can be formed in free shapes such as triangles, quadrangles, pentagons, hexagons, or other polygons, circles, ellipses, or even in irregular shapes. It is possible, for example, to arrange triangular and quadrangular or other polygonally shaped magnets m in a matrix pattern where each magnet is either in contact with adjacent magnets, is very close to adjacent magnets, or is a predetermined distance apart from adjacent magnets, as is shown in FIG. 4. By then positioning helically wound coils L on the vibrating member surface to correspond to each magnet so as to intersect magnetic flux directed along the surface of the vibrating member and along the directions of the gaps between each magnet, the shape of the overall acoustic conversion device can be designed with a degree of freedom. Thus acoustic conversion devices having shapes unlike such devices hitherto can be formed and the setting of the impedance becomes flexible.

By combining such shapes and patterns of arrangement, a plurality of magnets having small magnetic pole faces can be provided and the area occupied by coils surrounding each magnet can be increased, as compared with when bar magnets are arranged in a plurality of parallel rows. In addition, the driving force directed at the vibrating member can be increased and made more uniform, compared with when bar magnets are used.

As is shown in FIG. 5, when magnets shaped as equilateral triangles are arranged adjacent to each other, in contact with each other, or a predetermined distance apart from each other in the shape of an equilateral triangle so as to form a speaker (i.e. an acoustic conversion device) having the outline of an equilateral triangle, because there is no mutual interference between sound waves reflected from each side of the speaker, the sound quality can be particularly improved. Note that the shape of the triangle is not limited to the above equilateral triangle and a right angle triangle shape may also be employed.

The above first and second magnets can be placed on a plate-shaped member made from a magnetic body. If the magnets are placed on a member made from a magnetic body, the plate-shaped member acts as a magnetic path and almost all the magnetic flux travels only within this magnetic path and does not leak to the outside. Therefore, high density magnetic flux can be generated on the first magnetic pole face and second magnetic pole face sides enabling a high volume sound signal to be generated. In this case, if the peripheral edges of the magnetic body are bent in the direction of the magnet placement surface so as to form an angle relative to the magnet placement surface, magnetic flux exits the N pole, travels along the magnet placement surface from the bent portion, and enters into the S pole. Therefore, there is no leakage of magnetic flux to the outside from the side surfaces and the magnetism can be shielded even more efficiently.

Note that, if a second plate-shaped member made from a magnetic body is provided on the opposite side of the plate-shaped member with the vibrating member sandwiched in-between, magnetic flux passes through the middle of the second plate-shaped member, thereby enabling leakage of the magnetic flux to the outside to be prevented. In this case, it is preferable to form at least one hole for allowing sound to pass through, in at least one of these plate members.

In the present invention, the vibrating member is vibrated due to force which the current flowing through the coils receives from the magnetic field. However, if the portion of the vibrating member where the same coil group is placed does not vibrate as an integral entity, a large sound output cannot be obtained and sound distortion and noise are generated. Therefore, it is preferable if the hardness of the vibrating member at the placement portion where the coils are placed is increased. On the other hand, because the vibrating member as a whole needs to be able to vibrate freely in a direction perpendicular to the surface of the vibrating member, it is preferable if the hardness of portions of the vibrating member other than the placement portions where coils are placed is decreased making it easier for the coil placement portion of the vibrating member to be displaced in a direction perpendicular to the surface of the vibrating member. For this reason, in the present invention, it is preferable if the hardness of the placement portion of the vibrating member is made harder than the hardness of portions other than the placement portion. Therefore, because the hardness of the portion supporting the vibrating member surrounding the placement portion is decreased, the vibrating member can be efficiently vibrated.

The structure where the vibrating member is harder in the coil placement portion can be obtained by coating the coil placement portion of the vibrating member to make it harder than the vibrating member surrounding the coil placement portion. It is also possible to make the hardness of the coil placement portion harder than that of portions surrounding the coil placement portion by placing coils on the coil placement portion of the vibrating member and adhering the vibrating member on which the coils have been placed to another vibrating member not as hard as the vibrating member.

Moreover, if an elastic portion surrounding the coil placement portion is provided between the supporting portion for supporting the support member and the placement portion where coils are placed of the vibrating member, the entire coil placement portion is able to move parallel to a direction perpendicular to the surface of the vibrating member. Therefore, it is possible to vibrate the vibrating member more efficiently.

In the present invention, as is shown in FIGS. 6A and 6B, when magnets m are arranged such that the polarities of adjacent magnets are different from each other, because the magnetic flux between adjacent magnets flows from the N pole into two S poles, the magnetic flux in the area between magnets travels in a direction substantially parallel to the surface of the vibrating member. However, if the polarities of adjacent magnets are the same, or, as is shown in FIG. 7, the polarities are different, but a portion of magnetic pole faces having the same polarity are adjacent to each other, positions are created in the central portions of the N poles where the direction of the magnetic flux is reversed. Because of this, the position where the direction of the current flowing through the coil is reversed needs to be designed with an extremely high degree of accuracy, and therefore, the above arrangement is not practical. Furthermore, as is shown in FIG. 8, if an odd number of triangular magnets m are arranged in a type of circle, it is inevitable that two adjacent magnets will have the same polarities. Because the direction of the magnetic flux between the two adjacent magnets having the same polarity is reversed, this arrangement is not practical. Accordingly, as is shown in FIGS. 6A and 6B, it is preferable if adjacent magnets are placed such that there is no irregular positioning between adjacent magnets.

As described above, according to the first, fifth, tenth, and eleventh aspects of the present invention, because a first magnet and a second magnet are placed on a predetermined surface so as to be a slight distance from each other or in contact with each other such that the magnetic pole faces facing in the same direction of the first magnet and second magnet have different polarities, the magnetic flux traveling in a direction substantially parallel to the surface of the vibrating member is at the maximum value. Moreover, because a first coil and second coil are both positioned such that there is interlinking magnetic flux, the magnetic flux traveling in a direction substantially parallel to the surface of the vibrating member interlinks with the first coil and second coil. Accordingly, when current is supplied to the first coil and second coil, the direction of the force from the magnetic field acting on the current is substantially perpendicular to the surface of the vibrating member and the force in a direction along the surface of the vibrating member is extremely small. As a result, the effect is obtained that noise components are reduced and the sound quality can be improved.

According to the second and ninth aspects of the present invention, because a first magnet and a second magnet are placed on a predetermined surface so as to be a predetermined distance from each other or in contact with each other such that the magnetic pole faces facing in the same direction of the first magnet and second magnet have different polarities, the magnetic flux travels in a direction substantially parallel to the surface of the vibrating member. Moreover, because a first coil and second coil are both positioned such that there is interlinking magnetic flux, the magnetic flux traveling in a direction substantially parallel to the surface of the vibrating member interlinks with the first coil and second coil. Accordingly, when current is supplied to the first coil and second coil, the direction of the force from the magnetic field acting on the current is substantially perpendicular to the surface of the vibrating member and the force in a direction along the surface of the vibrating member is extremely small. In addition, the phase of sound reflected in the direction of the vibrating member is made uniform by the pliable air layer-forming member. As a result, the effect is obtained that noise components are reduced and the sound quality can be improved.

Furthermore, if a plurality of first magnets and a plurality of second magnets are arranged in a matrix pattern adjacent to each other or in contact with each other, more magnets can be positioned than when bar magnets are arranged in parallel rows. The number of coils can also be made either the same as or a multiple of the number of magnets. Therefore, the effects are obtained that the overall length of the portion of the coil which interlinks with the magnetic flux can be lengthened, the proportion of the surface area of the vibrating member occupied by the coils can be increased, the acoustic conversion efficiency improved, and the sound quality further improved.

In addition, if the shape of at least one of the first and second magnets is made in a plurality of types, it is possible to arrange the first and second magnets to match the shape of the flat speaker. Therefore, the effect is obtained that the flat acoustic conversion device can have any shape allowing increased freedom when designing the shape of the overall speaker.

Note that, in each of the above-described aspects, examples were described of when a flat acoustic conversion device was used as a speaker. However, by vibrating the vibrating membrane and generating an induction current in the conductor and coil, the flat acoustic conversion device may also be used as a microphone, or as an ordinary acoustic conversion device other than a flat acoustic conversion device, or a vibration actuator for vibrating a member which can be vibrated.

According to the third, fourth, and sixth to eighth aspects of the present invention, because a plurality of first magnets and a plurality of second magnets are fixed on a vibrating body or held between a vibrating body and a holding member so as to be a predetermined distance from each other or in contact with each other such that the magnetic pole faces facing in the same direction of the first magnet and second magnet have different polarities, the flat speaker unit can be made thinner. Furthermore, because the magnetic flux travels in a direction substantially parallel to the surface of the vibrating member, and because the magnetic flux traveling in a direction substantially parallel to the surface of the vibrating member interlinks in the first coil and second coil, when current is supplied to the first coil and second coil, the direction of the force from the magnetic field acting on the current is substantially perpendicular to the surface of the vibrating member and the force in a direction along the surface of the vibrating member is extremely small. As a result, the effect is obtained that noise components are reduced and the sound quality can be improved.

Furthermore, if a plurality of first magnets and a plurality of second magnets are arranged in a matrix pattern either a predetermined distance from each other or in contact with each other, more magnets can be positioned than when bar magnets are arranged in parallel rows. The number of coils can also be made either the same as or a multiple of the number of magnets. Therefore, the effects are obtained that the overall length of the portion of the coil which interlinks with the magnetic flux can be lengthened, the proportion of the surface area of the vibrating member occupied by the coils can be increased, the acoustic conversion efficiency improved, and the sound quality further improved.

In addition, if the shape of at least one of the first and second magnets is made in a plurality of types, it is possible to arrange the first and second magnets to match the shape of the flat speaker. Therefore, the effect is obtained that the flat acoustic conversion device can have any shape allowing increased freedom when designing the shape of the overall speaker.

Note that, in the above aspects, when the magnet is mounted to the vibrating body, its preferable to dispose a non-magnetic pliable member between the vibrating body and the magnet.

BRIEF DESCRIPTION OF THE DRAWINGS

FIG. 23A is a graph showing the magnetic flux distribution when permanent magnets are placed in contact with each other with no gaps in between.

DESCRIPTION OF THE PREFERRED EMBODIMENTS

Embodiments of the application of the present invention to a speaker will now be described in detail with reference made to the drawings.

First Embodiment

Figure 1:
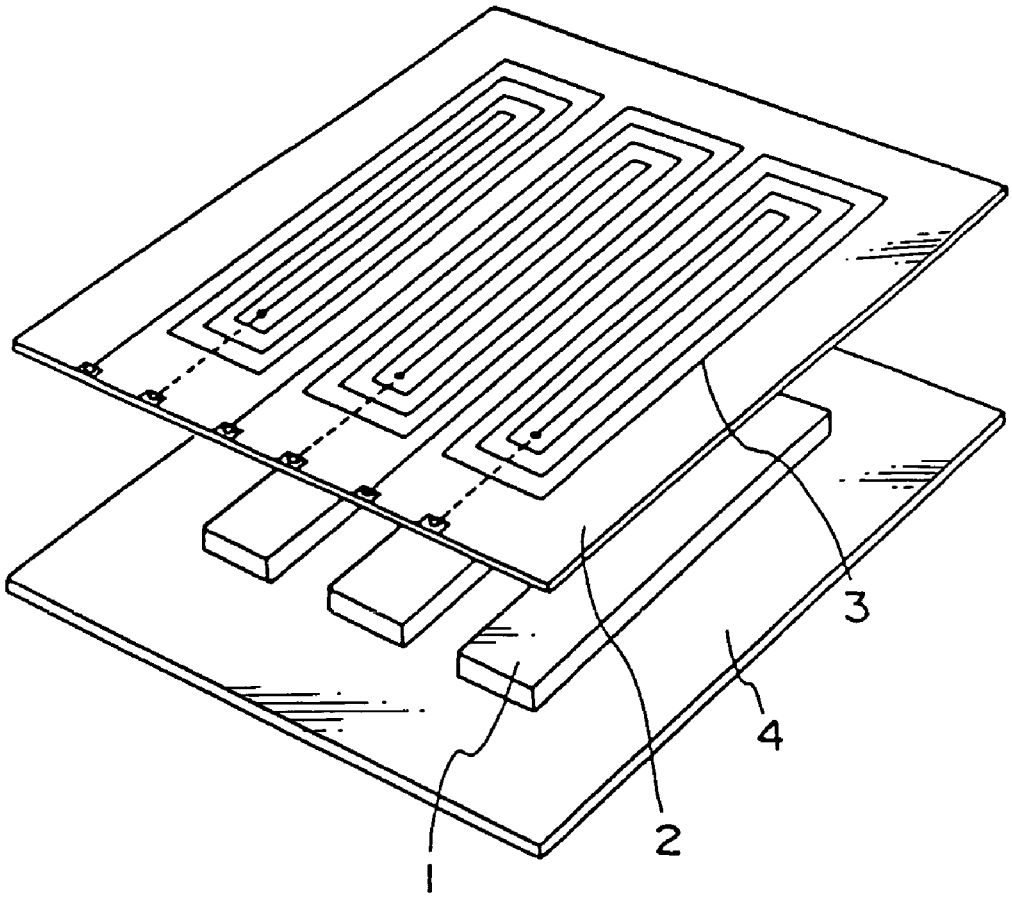
FIG. 1 is an exploded perspective view showing a conventional flat speaker.
Figure 2A:
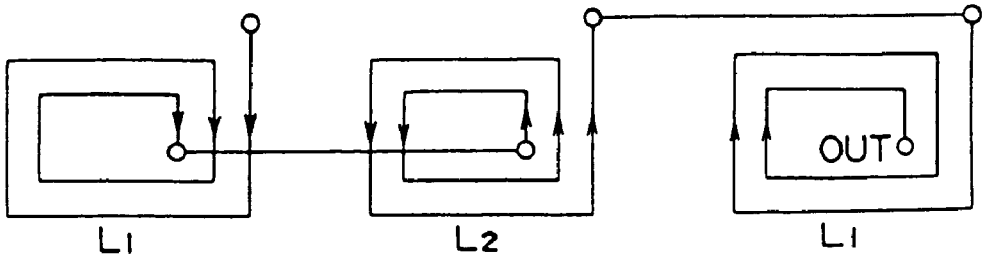
FIGS. 2A and 2B are explanatory diagrams showing connections between a first coil and a second coil when the coil winding directions are the same in the present invention.
Figure 2B:
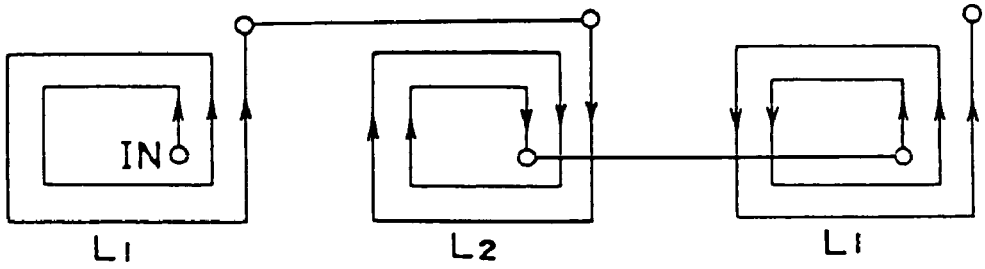
Figure 3A:
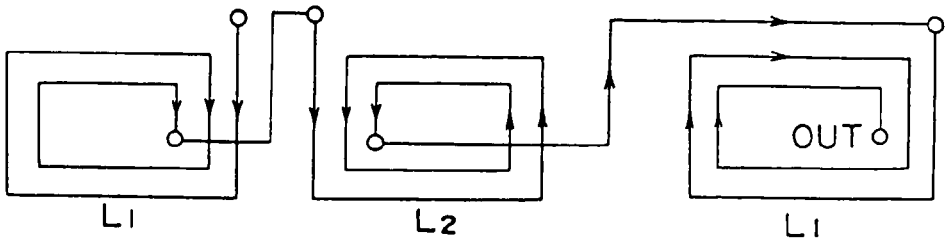
FIGS. 3A, 3B and 3C are explanatory diagrams showing connections between a first coil and a second coil when the coil winding directions are different in the present invention.
Figure 3B:
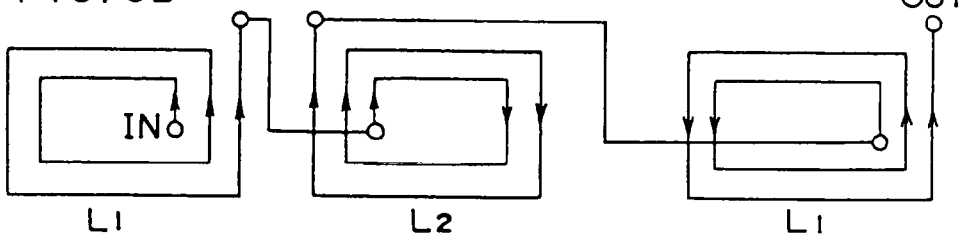
Figure 3C:
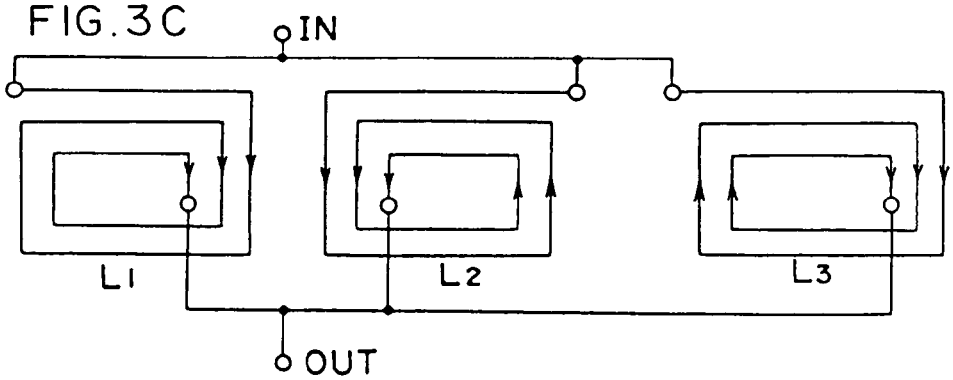
Figure 4:
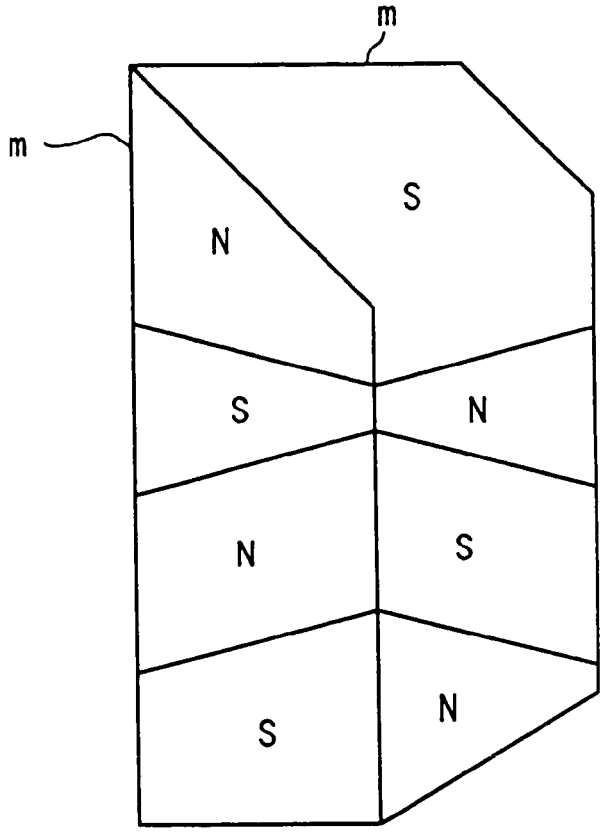
FIG. 4 is a plan view showing the disposition of magnets which have been positioned so that the polarities of the magnetic pole faces of adjacent permanent magnets are different to each other.
Figure 5:
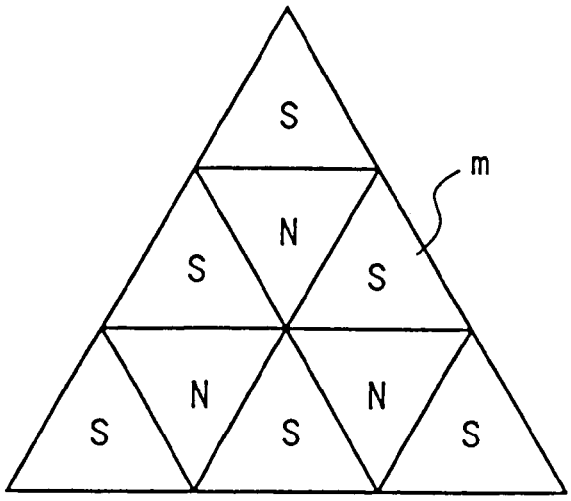
FIG. 5 is a plan view showing the disposition of magnets which have been positioned in a regular pattern so that the polarities of the magnetic pole faces of adjacent permanent magnets are different to each other.
Figure 6A:
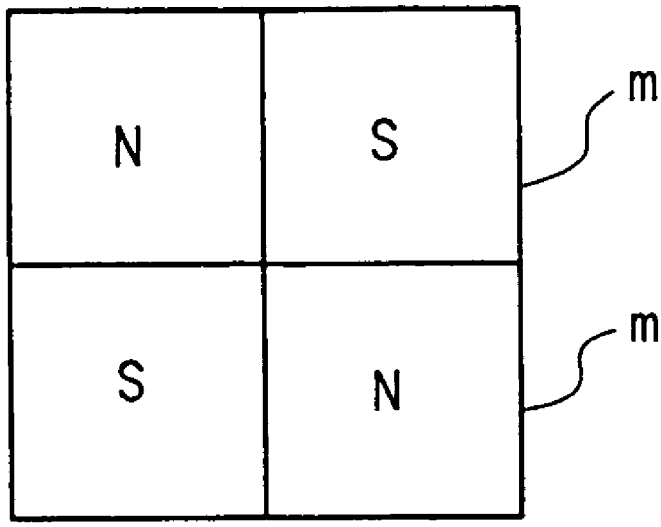
FIGS. 6A and 6B are plan views showing examples of the disposition of magnets when there is no irregular positioning between adjacent magnets of the present invention.
Figure 6B:
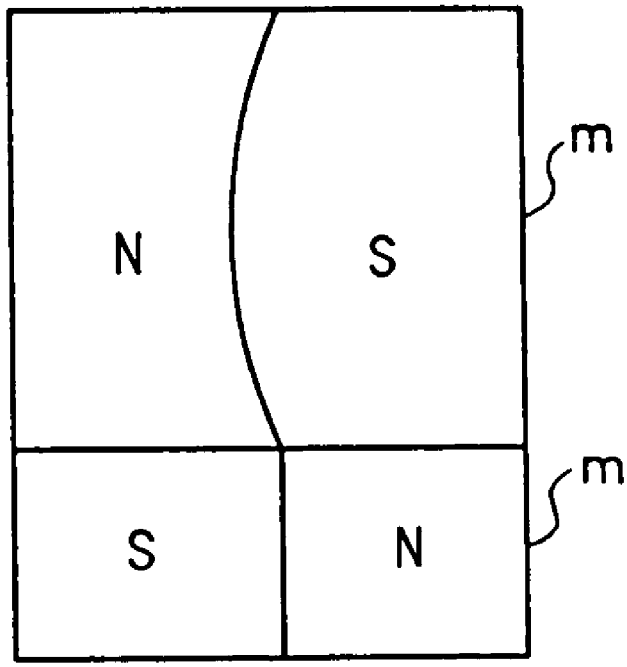
Figure 7:
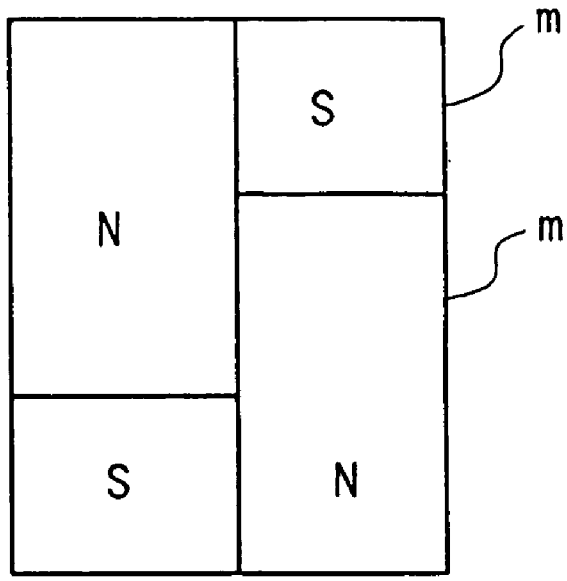
FIG. 7 is a plan view showing the disposition of magnets when there is irregular positioning between adjacent magnets of the present invention.
Figure 8:
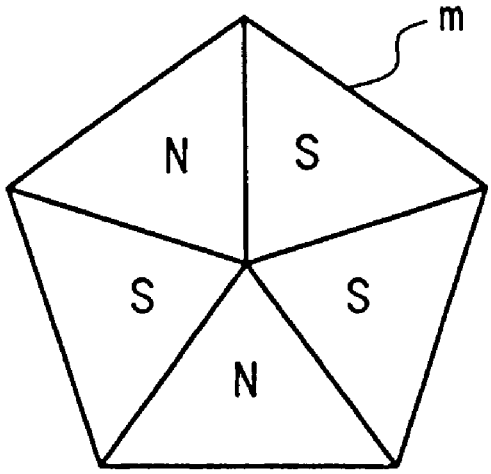
FIG. 8 is a plan view showing the disposition of an odd number of magnets arranged in a circular configuration.
Figure 9:
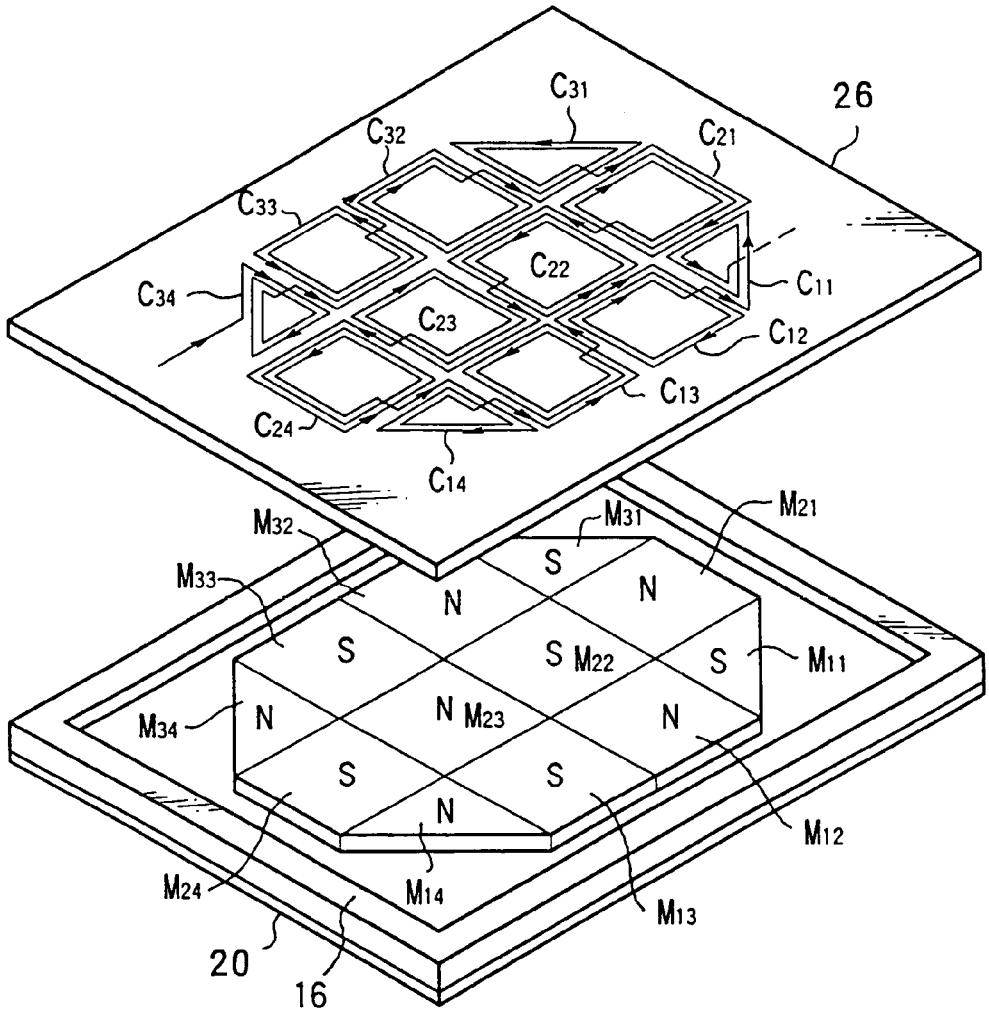
FIG. 9 is an exploded perspective view of a first embodiment of the present invention.

As is shown in FIG. 9, the flat speaker unit of the first embodiment is provided with a yoke 20 comprising a rectangular plate-shaped member formed from a magnetic body. A flat, triangular permanent magnet M11 is disposed at one corner portion of the top surface of the yoke 20 with the S polarity magnetic pole face thereof facing upwards and with the oblique line of the triangle facing towards the corner of the yoke 20. The permanent magnet M11 is fixed in place using an adhesive. A ferrite based magnet or neodymium based magnet can be used for the permanent magnet.

A flat, quadrangular permanent magnet M12 is disposed at a position adjacent to the permanent magnet M11 along the longitudinal side of the yoke 20 with the N polarity magnetic pole face thereof facing upwards and with the surface of one side thereof in contact with the surface of one side of the permanent magnet M11.

A flat, quadrangular permanent magnet M13 is disposed at a position adjacent to the permanent magnet M12 along the longitudinal side of the yoke 20 with the S polarity magnetic pole face thereof facing upwards. A flat, triangular permanent magnet M14 is disposed at a position adjacent to the permanent magnet M13 with the N polarity magnetic pole face thereof facing upwards and with each side surface thereof in contact with the adjacent two permanent magnets.

Three permanent magnets are positioned with magnetic pole faces of alternating polarities facing upwards at adjacent positions in the direction of the transverse sides of each of the permanent magnets M11, M12, M13, and M14 in the yoke 20 and with the side surfaces thereof in contact with the adjacent permanent magnet. Because the permanent magnets M11 to M34 are flat with parallel front and rear surfaces, each magnetic pole face is parallel with the top surface of the yoke 20 and faces in the same direction.

Consequently, a combination of 12 triangular and quadrangular permanent magnets are disposed in a matrix pattern with no gap between magnets and with adjacent permanent magnets having different polarities facing upwards and also with the triangular permanent magnets positioned in the four corner portions. Because the permanent magnets have been positioned with no gap between magnets such that the polarities of adjacent permanent magnets are different, the magnetic flux in a direction substantially parallel to the surface of the vibrating membrane is greatest between adjacent permanent magnets.

Note that when a permanent magnet Mij, whose upwards facing magnetic pole face has a first polarity (wherein, when i=1 or 3, then j=1 or 3 and when i=2, then j=2 or 4), corresponds to one of the first and second magnets of the present invention, then a permanent magnet Mij, whose upwards facing magnetic pole face has a second polarity (wherein, when i=1 or 3, then j=2 or 4 and when i=2, then j=1 or 3), corresponds to the other one of the first and second magnets of the present invention. Accordingly, a plurality of rows of magnets with each row comprising a plurality of magnets arranged so that magnetic pole faces of alternating polarities face upwards along one of either the longitudinal or transverse sides of the yoke are arranged parallel to each other such that magnetic pole faces of alternating polarities face upwards along the other of either the longitudinal or transverse sides of the yoke.

A frame-shaped spacer 16 whose thickness is thicker than that of the permanent magnets is disposed on the top surface of the yoke 20 such that all of the permanent magnets are positioned inside the frame opening.

The peripheral portions of the membrane surface of the vibrating membrane 26 are fixed to the top surface of the spacer 16 such that the membrane surface is parallel to magnetic pole faces of the permanent magnets and, accordingly, to the top surface of the yoke. A predetermined tensional force is also applied to the membrane surface and the membrane surface is disposed facing and adjacent to the magnetic pole faces of the permanent magnets. The vibrating membrane 26 is formed from a high polymer film or the like such as polyimide, polyethylene terephthalate, or the like. An octagonal coil placement portion whose hardness has been increased through a coating of ceramic or resist (e.g., epoxy based) is provided in the central portion of the vibrating membrane 26. Accordingly, the hardness of the area surrounding the coil placement portion of the vibrating membrane 26 is less than that of the coil placement portion. The vibrating membrane 26 is fixed to the top surface of the spacer 16 via these portions with a lower degree of hardness.

Helically wound coils C11 to C34 are disposed on one surface of the coil placement portion of the vibrating membrane 26 so as to correspond to each of the permanent magnets M11 to M34. Each coil C11 to C34 is substantially the same shape as the outer edge of each of the permanent magnets M11 to M34. Moreover, each coil C11 to C34 is formed such that coils which correspond to magnetic pole faces having the same polarity are wound in the same winding direction from the outer periphery to the inner periphery.

Namely, the coils C11, C14, C31, and C34 which correspond to the triangular shaped permanent magnets are wound in a triangular shape, while the coils C12, C13, C21 to C24, C32, and C33 which correspond to the quadrangular shaped permanent magnets are wound in a quadrangular shape.

This type of coil can be formed as a voice coil by depositing a thin copper film on the coil placement area of the vibrating membrane 26 and by etching the thin copper film so that the planar surface thereof is formed in a coil shape. Instead of depositing the thin copper film, it is also possible to form a coil by press adhering or bonding copper foil or by laminating copper plating. Each coil is then covered with an insulating material.

Figure 10:
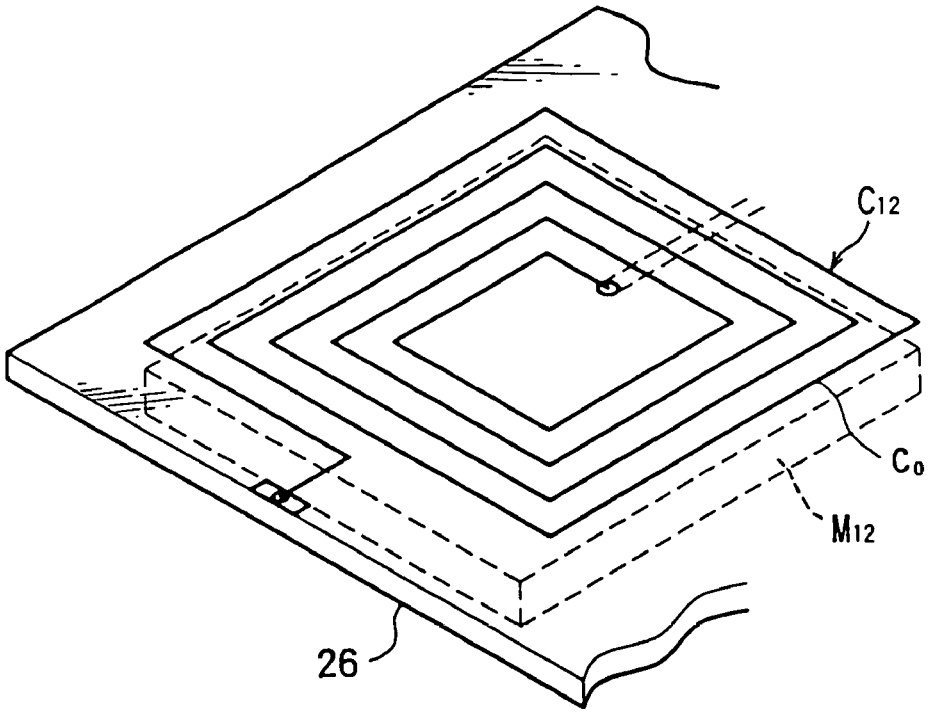
FIG. 10 is a partial perspective view showing a helically wound coil disposed outside a position on the vibrating membrane of the above first embodiment which corresponds to the outer peripheral portion of a permanent magnet.

Further, as is shown in FIG. 10, the coil C12 is positioned in an area on the vibrating membrane such that the outer periphery of the coil, namely, the outer periphery Co, substantially matches a position corresponding to the outer edge of the magnetic pole face. Moreover, as is shown in FIG. 9, the coil C12 is positioned such that the outer peripheral portion thereof (i.e. the coiled wiring thereof) does not overlap outer peripheral portions of other coils. Each of the coils C11 to C34 is disposed in the same way as the coil C12, namely, such that the outer periphery of each coil is positioned at an area on the vibrating membrane substantially matching a position corresponding to the outer edge of the magnetic pole face, and such that the outer peripheral portions of each coil do not overlap each other. Note that, because the size of the magnetic flux in predetermined areas, which include the portions of the vibrating membrane corresponding to the center of each magnetic pole face, is small, it is possible to reduce the weight of the vibrating membrane by not providing coils in these areas.

The external peripheral ends and internal peripheral ends of adjacent coils in the direction of a row of permanent magnets are then connected. Thus a coil row of coils connected in series in the order of C34 to C31, a coil row of coils connected in series in the order of C21 to C24, and a coil row of coils connected in series in the order of C14 to C11 are formed. These coil rows are connected together in series in the above order.

The above yoke 20 to which the plurality of permanent magnets are fixed, and the spacer 16 to which is fixed the vibrating membrane 26 on which are disposed the plurality of coils, are assembled together by the peripheral edges thereof being supported by an unillustrated supporting member to form a flat speaker unit.

Because the coils have been disposed in the above described way on the vibrating membrane which is positioned so as to be adjacent to and parallel with the magnetic pole faces of the permanent magnets, the magnetic flux interlinks in a direction along the surface of the vibrating membrane in adjacent portions of each coil. Magnetic flux also interlinks in a direction perpendicular to the surface of the vibrating membrane, however, the force from that magnetic flux is small and is cancelled out because it acts in opposite directions in symmetrical coil positions. Accordingly, when current is supplied from one end of a coil group connected in series in a flat speaker unit to the other end, the current flows in the same direction in adjacent coil portions of adjacent coils. Moreover, the current flowing in the adjacent portions of adjacent coils is affected by unidirectional force from the magnetic field in a direction perpendicular to the surface of the vibrating membrane. The result of this is that the vibrating membrane is hardly affected at all by force in a direction along the surface of the vibrating membrane and vibrates in a direction orthogonal to the surface membrane. Therefore, noise components can be greatly reduced and the sound quality improved. Furthermore, in the above embodiment, because the coil placement portion of the vibrating membrane is ceramic coated, the ceramic coated portion vibrates as an integral unit. Therefore, there is no distortion in the sound and a high volume can be output.

Moreover, in the present embodiment, because a plurality of permanent magnets are disposed in the longitudinal direction of conventional bar magnets, namely, in the row direction of the present embodiment, and a plurality of coils are disposed on the vibrating membrane at positions corresponding to the permanent magnets, the combined length of the outer edge portions of the plurality of permanent magnets is longer than the length of the outer edges of the bar magnets, so that the overall length of the coil portions interlinking with the magnetic flux is longer than when bar magnets are used. The result of this is that, compared with when a plurality of rows of bar magnets are provided, it is possible to improve the proportion of the surface area of the vibrating membrane occupied by the coils surrounding each magnet. It is also possible to increase the effective magnetic flux compared to the prior art. As a result, it is possible to improve the efficiency of converting an electrical signal to a sound signal and the sound quality can be improved.

Furthermore, because a combination of different triangular and quadrangular shaped permanent magnets and coils are used for the permanent magnets and coils, the speaker can be formed in shapes different from those of conventional speakers.

Second Embodiment

Figure 11:
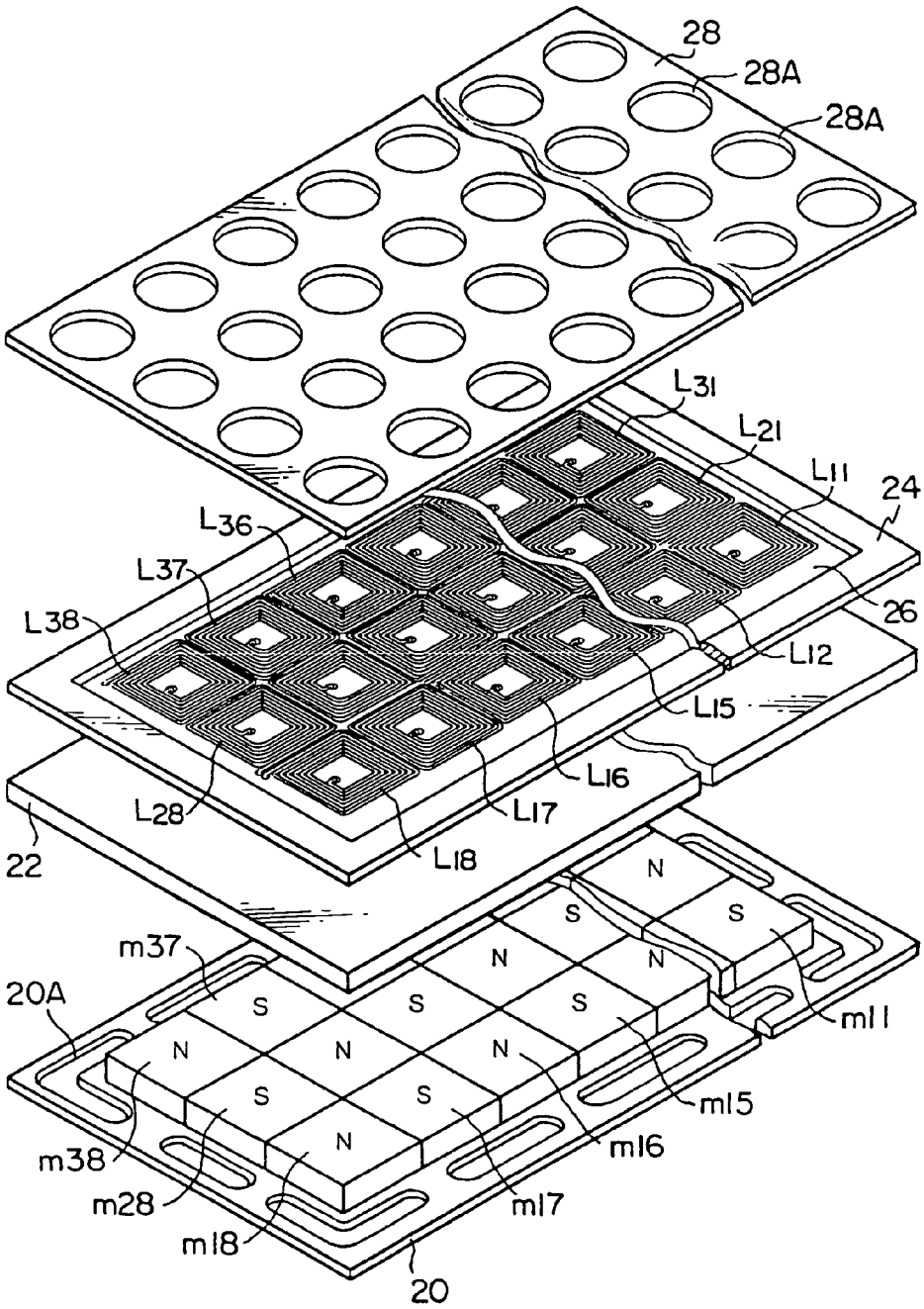
FIG. 11 is an exploded perspective view of a second embodiment of the present invention.

The second embodiment of the present invention will now be described with reference made to FIG. 11. The acoustic conversion device according to the second embodiment is formed from a magnetic material and is provided with a yoke 20 comprising a rectangular plate-shaped member in the outer peripheral portions of which are punched a plurality of holes 20A. Magnet fixing portions to which are fixed permanent magnets are formed in the area of the yoke 20 surrounded by the holes 20A.

Flat, quadrangular permanent magnets m11 to m38 are fixed to the magnet fixing portions with an adhesive with the side surfaces of each magnet in contact with the adjacent permanent magnets with no gaps between each magnet such that the upward facing magnetic pole faces of adjacent permanent magnets have alternating polarities. Namely, permanent magnets mij (wherein when i=1 or 3, then j=1, 3, 5, or 7 and when i=2, then j=2, 4, 6, or 8) are fixed in place such that S polarity magnetic pole faces thereof face upwards, and permanent magnets mij (wherein when i=1 or 3, then j=2, 4, 6, or 8 and when i=2, then j=1, 3, 5, or 7) are fixed in place such that N polarity magnetic pole faces thereof face upwards. Note that the permanent magnets may also be fixed in place with the S and N polarities thereof reversed.

A vibrating membrane 26 is disposed on the top surface of the yoke 20 so as to be adjacent to and parallel with the magnetic pole faces of the permanent magnets and, consequently, the top surface of the yoke. As in the first embodiment, the vibrating membrane 26 is formed from a high polymer film or the like such as polyimide, polyethylene terephthalate, or the like. A rectangular coil placement portion on which coils are placed and whose hardness has been increased through a coating of ceramic is provided in the central portion of the vibrating membrane 26. Accordingly, the hardness of the area surrounding the coil placement portion is less than that of the coil placement portion.

The vibrating membrane 26 is fixed to a frame 24 by fixing the entire peripheral edge portions of the vibrating membrane 26 which have a lower degree of hardness to the frame 24. The size of the opening of the frame 24 is a size slightly larger than a size large enough to contain all of the permanent magnets fixed to the yoke.

Coil pairs L11 to L38, each comprising a pair of helically shaped coils positioned on both front and rear surfaces of the coil placement portion, are disposed on the coil placement portion of the vibrating membrane 26 at positions corresponding to each of the permanent magnets m11 to m38. Each coil pair L11 to L38 is helically wound in substantially the same shape as the outer edges of each of the permanent magnets m11 to m38. Moreover, each coil is positioned in an area on the vibrating membrane such that the outer periphery of the coiling (namely, the outer periphery of the spirally coiled wiring) substantially matches a position corresponding to the outer edge of the magnetic pole face. Moreover, the coils are positioned such that the outer peripheral portions of each coil do not overlap.

In the same way as in the first embodiment, this type of coil can be formed by press adhering or bonding a thin copper film on the coil placement portion of the vibrating membrane 26 and etching the thin copper film so that the planar surface thereof is formed in a coil shape. Each coil is then covered with an insulating material.

A pliable material 22 which is made from a soft material such as non-woven fabric, sponge, glass wool, urethane foam or the like is interposed between the vibrating membrane 26 and the plurality of magnetic pole faces in order to prevent the coils being brought into contact with the magnetic pole faces by the vibration of the vibrating diaphragm.

In the same way as the yoke 20, a magnetic shield member 28 formed from a magnetic material is disposed at the top surface of the vibrating membrane 26. The magnetic shield member 28 is formed from a rectangular plate-shaped member in which a plurality of holes 28A (in the present embodiment 4×9=36 holes) are punched in a matrix pattern.

Figure 12:
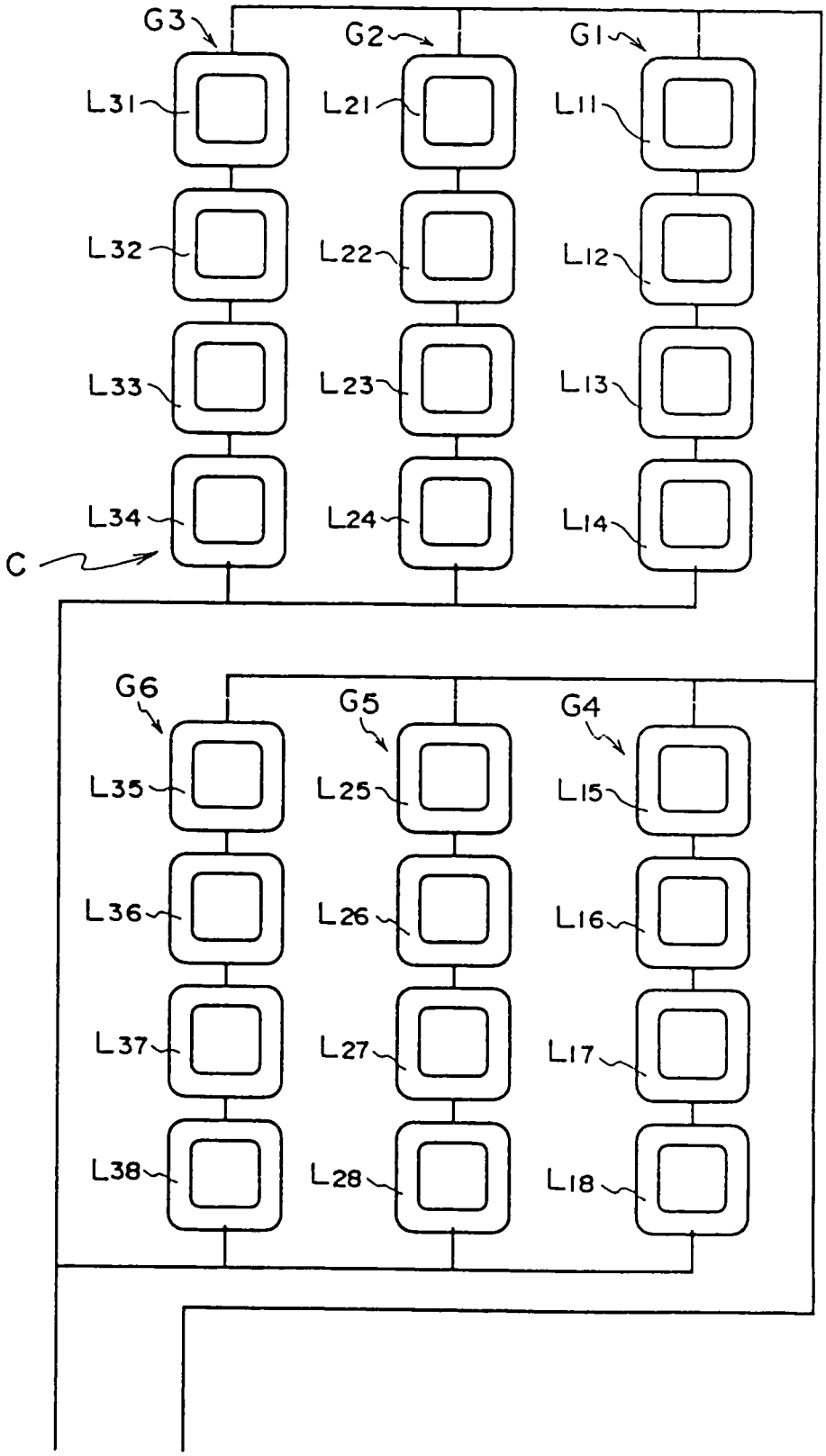
FIG. 12 is a plan view showing connections between coils in the above second embodiment.

As shown in FIG. 12, a plurality (six in the present embodiment) of coil groups G1 to G6 are formed by connecting a plurality (four in the present embodiment) of the coil pairs L11 to L38 together in series. These coil groups G1 to G6 are connected together in parallel.

A description of the coil winding directions and connections of the coil groups G1 to G6 will now be given with reference made to FIG. 13. Note that, the description given below is for coil pairs which are connected to each other in series and are adjacent to each other in the longitudinal direction of the vibrating membrane, and because the winding direction and connections of each coil are the same, a description of the winding directions and connections of other coil pairs is omitted. Moreover, the coil of one coil pair which is positioned on the front surface of the coil placement portion (and which corresponds to the first coil of those aspects of the invention in which coils 1 to 4 are used) is referred to as LA1, while the coil which is positioned on the rear surface of the coil placement portion (and which corresponds to the second coil of those aspects of the invention in which coils 1 to 4 are used) is referred to as LB1. The coil of the other coil pair which is positioned on the front surface of the coil placement portion (and which corresponds to the third coil of those aspects of the invention in which coils 1 to 4 are used) is referred to as LA2, while the coil which is positioned on the rear surface of the coil placement portion (and which corresponds to the fourth coil of those aspects of the invention in which coils 1 to 4 are used) is referred to as LB2. Note also that all the winding directions of the coils are those seen when viewed from the rear side of the vibrating membrane.

Coil LA1 is wound from the external periphery to the internal periphery thereof in a clockwise direction. Coil LB1 is wound from the internal periphery to the external periphery thereof in a clockwise direction. Coil LB2 is wound from the external periphery to the internal periphery thereof in an anticlockwise direction. Coil LA2 is wound from the internal periphery to the external periphery thereof in an anticlockwise direction. Accordingly, the winding direction of coils which are disposed on one surface of the coil placement portion is the same, namely, from the internal periphery to the outer periphery (or from the outer periphery to the inner periphery).

The internal peripheral end of the coil LA1 passes vertically through the coil placement portion of the vibrating membrane 26 from the front surface to the rear surface and is connected with the inner peripheral end of the coil LB1. The external peripheral end of the coil LB1 extends along the rear surface of the coil placement portion and is connected with the outer peripheral end of the coil LB2. The internal peripheral end of the coil LB2 passes vertically through the coil placement portion of the vibrating membrane 26 from the rear surface to the front surface and is connected with the inner peripheral end of the coil LA2. The external peripheral end of the coil LA2 extends along the front surface of the coil placement portion and is connected with the outer peripheral end of an unillustrated adjacent coil.

Note that the coils within each group of coils are connected to each other in series by repeating the above winding directions and connections.

Figure 13:
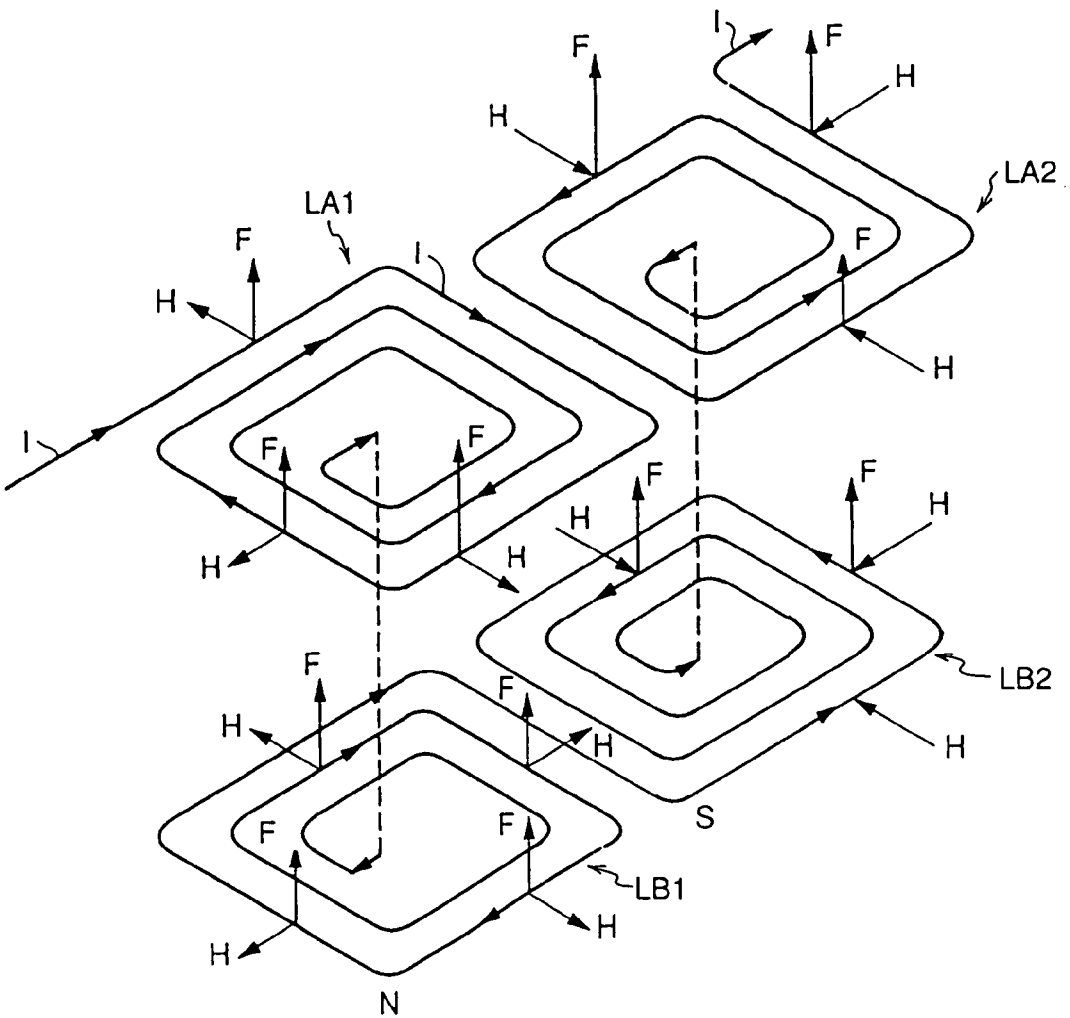
FIG. 13 is an explanatory view showing connections between coils positioned on both front and rear surfaces of the vibrating membrane of the above second embodiment.

When current I is supplied from the external peripheral end of the coil LA1 of the coil groups which are connected to each other in series, the current I flows in the direction shown by the arrow in FIG. 13. Therefore, the current flows in the same direction in the mutually adjacent portions extending from the internal periphery to the external periphery of the coils LA1 and LA2 and in the same direction in the mutually adjacent portions extending from the internal periphery to the external periphery of the coils LB1 and LB2.

Further, the winding directions of adjacent coil groups, namely, the coil groups G1 and G2, the coil groups G2 and G3, the coil groups G4 and G5, and the coil groups G5 and G6 are formed so as to be mutually reversed.

The above described yoke 20 to which are fixed the plurality of permanent magnets, the pliable material 22, the frame 24 to which is fixed the vibrating membrane 26 provided with the plurality of coils, and the magnetic shield member 28 are assembled as a flat speaker unit whose peripheral edge is supported by an unillustrated supporting member such that the pliable material 22 and the frame 24 to which is fixed the vibrating membrane 26 provided with the plurality of coils are interposed between the yoke 20 and the magnetic shield member 28.

Figure 14:
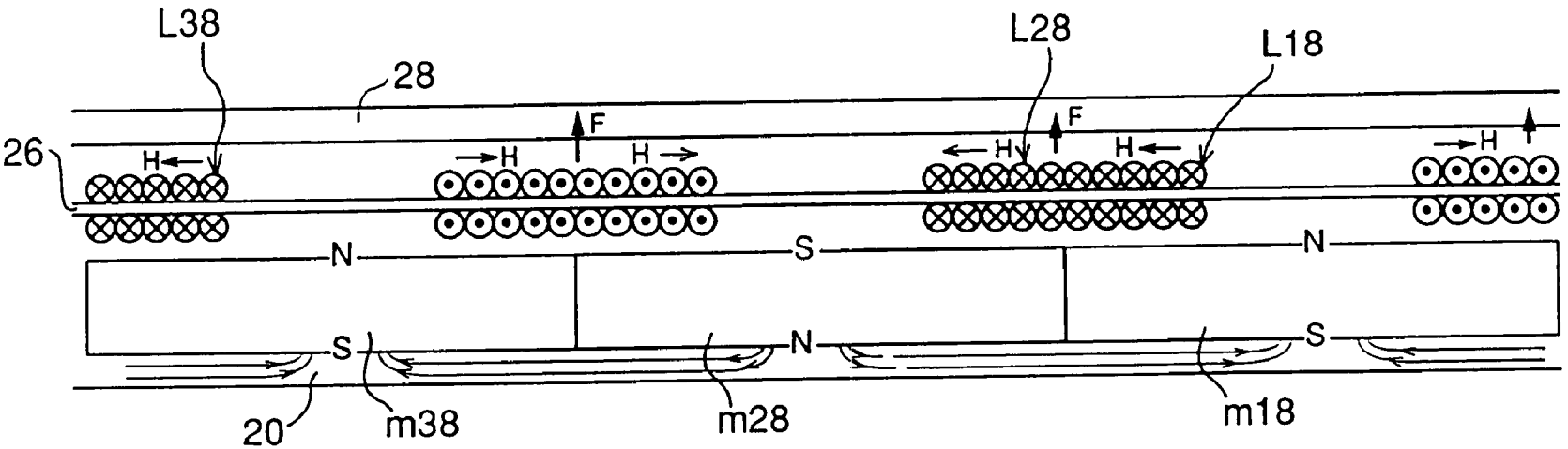
FIG. 14 is a cross-sectional view taken along a plane passing through permanent magnets m18 to m38 of the above second embodiment.

FIG. 14 is a cross-sectional view of the flat speaker unit assembled as described above with the pliable material omitted. Permanent magnet m18 is adjacent to permanent magnet m28 and permanent magnet m28 is adjacent to permanent magnet m38 with the side surfaces of adjacent permanent magnets placed in contact with each other with no gap in between. The polarities of the top magnetic pole faces of adjacent magnets are different to each other in the same direction. As a result, the magnetic flux generated from each permanent magnet is directed from an N polarity magnetic pole face to an S polarity magnetic pole face and the magnetic flux in the area between adjacent permanent magnets is directed in a direction substantially parallel to the vibrating membrane and is at the maximum above the areas of contact between permanent magnets.

Because the coil pairs L18, L28, and L38 are disposed on the front and rear surfaces of the vibrating membrane, the magnetic flux which is directed in a direction substantially parallel to the surface of the vibrating membrane interlinks in each coil. When current I is supplied to each coil in the directions shown in FIG. 13, then, as is shown in FIG. 14, the current flows in the same direction in adjacent coil portions extending from the inner peripheries to the outer peripheries of adjacent coils. Moreover, all of the coils are affected by a unidirectional force F acting in a direction perpendicular to the surface of the vibrating membrane so that the vibrating membrane is displaced in a direction perpendicular to the surface of the vibrating membrane. Consequently, by feeding an electrical signal representing the sound to be generated to a coil, the vibrating membrane vibrates in accordance with this electrical signal and a sound signal is able to be generated. Note that, in FIGS. 13 and 14, H indicates the direction of the magnetic flux.

At this time, as is shown in FIG. 14, the magnetic flux of the magnetic pole face on the bottom surface of the permanent magnets exits from the N pole, passes through the magnetic path within the yoke 20, and enters into the N pole. Therefore, a magnetic flux having a higher density can be generated on the magnetic pole face of the top surface. As a result, it is possible to efficiently convert an electric current having a small amplitude into a sound signal and to reduce magnetic flux leakages to the outside of the bottom surface.

As shown in FIG. 14, because the magnetic flux which reaches the shield member of the magnetic pole face of the upper surface of the permanent magnets exits from the N pole, passes through the magnetic path within the magnetic shield member 28, and enters into the S pole, there is little leakage of magnetic flux to the outside and the magnetism can be shielded.

Further, because a plurality of holes are punched in the magnetic shield member 28, the sound signals pass through these holes and are output from the flat speaker unit. Note that the sound signals are also output from the holes formed in the yoke 20.

Figure 15:
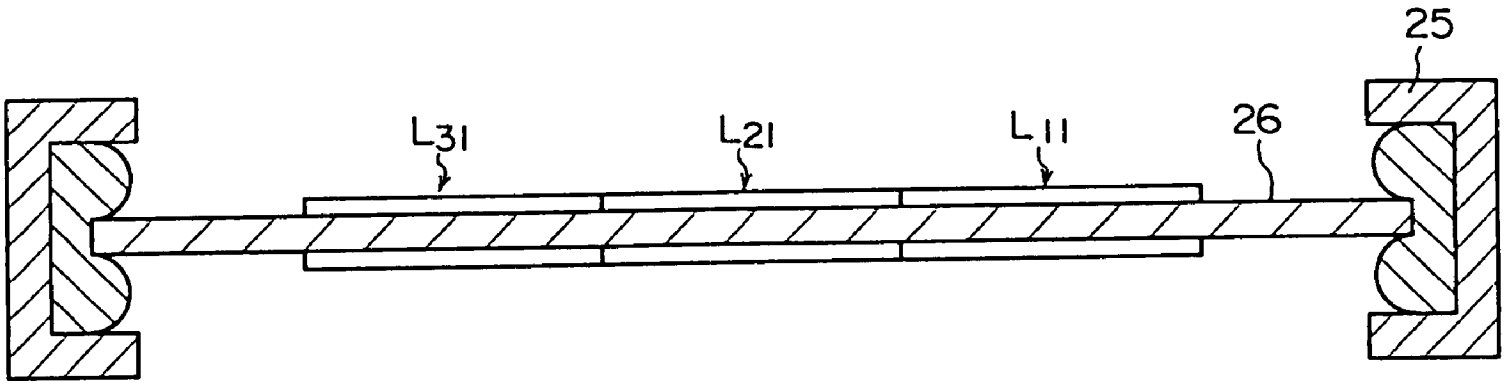
FIG. 15 is a cross-sectional view taken along a plane passing through coil pairs L11 to L31 showing another example of fixing a vibrating membrane.

In the above description, an example was given of when the periphery of the vibrating membrane 26 was fixed to the frame 24, however, as is shown in FIG. 15, it is also possible to hold the vibrating membrane in a frame 25. This is accomplished by forming a U-shaped groove in the frame 25 and holding the periphery of the vibrating membrane 26 in the U-shaped groove using fabric that has been impregnated with urethane foam or synthetic resin.

Figure 16:
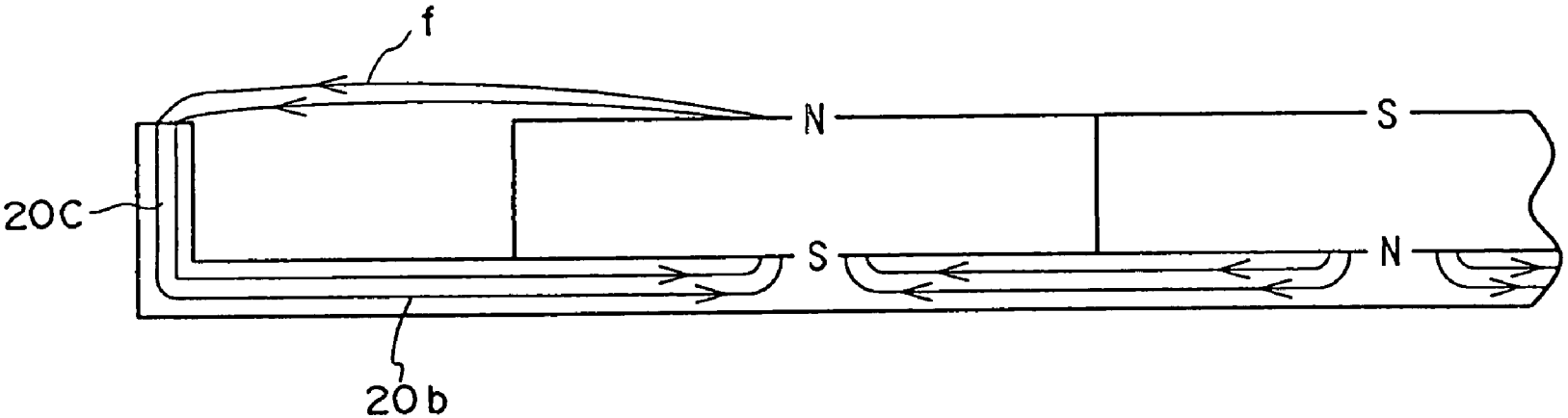
FIG. 16 is a cross-sectional view showing a variant example when a peripheral wall formed from magnetic members and of approximately the same height as the permanent magnets is provided on a plate-shaped member.

As is shown in FIG. 16, a peripheral wall 20*c* formed from a magnetic material and erected from the peripheral edge of the bottom surface 20*b* so as to have substantially the same height as the permanent magnets can be provided on the yoke 20 of each embodiment so as to surround the permanent magnets. The permanent magnet m38 positioned in a corner portion shown in FIG. 11 has two side surfaces which are not in contact with adjacent permanent magnets. If, however, the peripheral wall 20*c* formed from a magnetic material is provided at the periphery of the permanent magnets in this way, it is possible to interlink the magnetic flux f generated in a direction from the N polarity magnetic pole face of the permanent magnet 38 towards the peripheral wall 20*c* in a coil. Furthermore, because the magnetic flux exiting from the N pole passes from the peripheral wall 20*c* through the bottom surface 20*b* and enters into the S pole, no magnetic flux leakage from the side surfaces to the outside occurs and the magnetism can be shielded even more efficiently.

In the coils of the above embodiments, the direct current resistance value can be set to a predetermined value by connecting coils to each other in series or in parallel or by connecting coils to each other in a combination of serial and parallel connections. By connecting the coils freely in this way, it is possible to group voice coils together and vibrate each group as an integrated whole.

Third Embodiment

Figure 17:
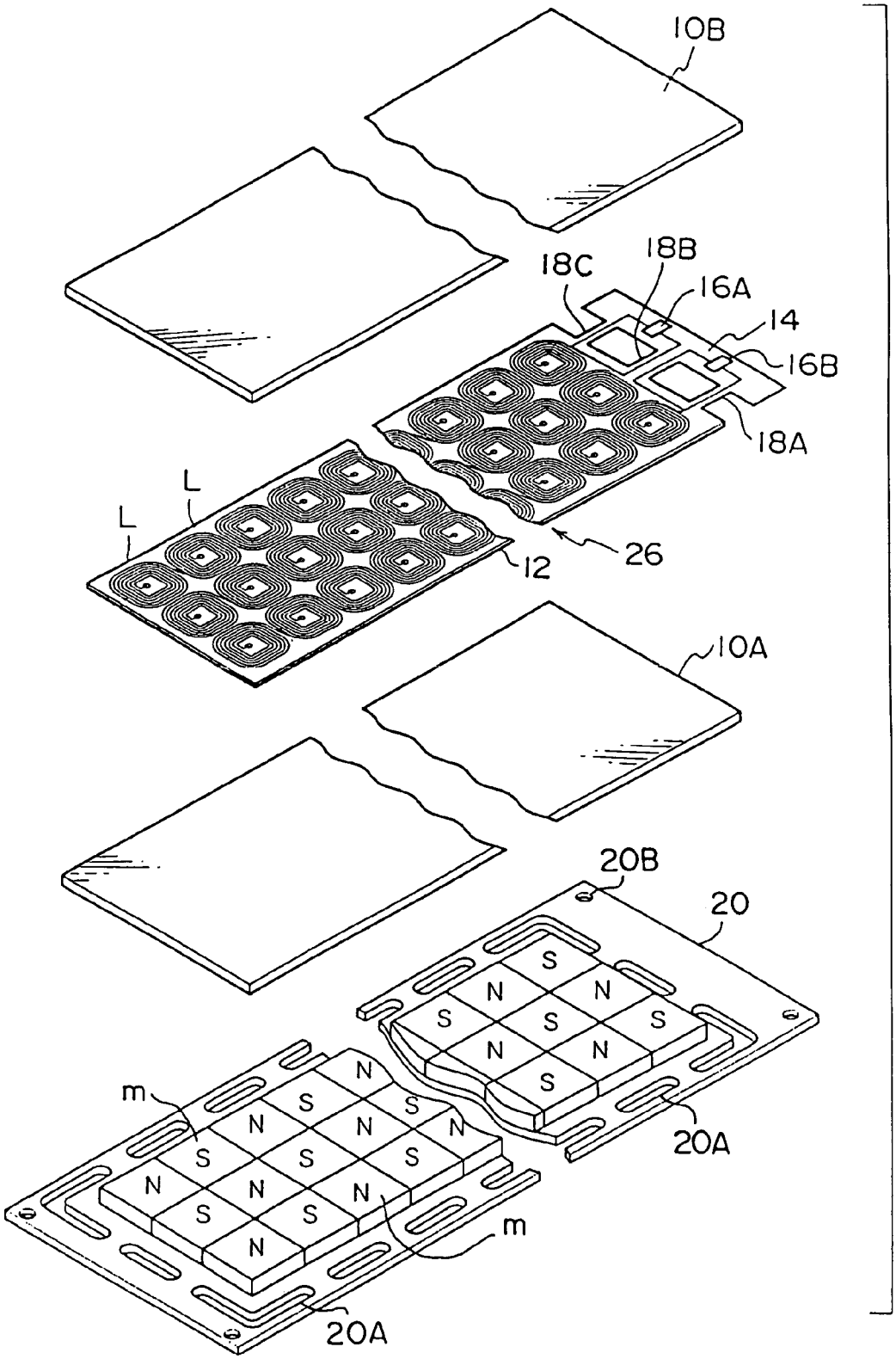
FIG. 17 is an exploded perspective view showing a third embodiment of the present invention.
Figure 18:
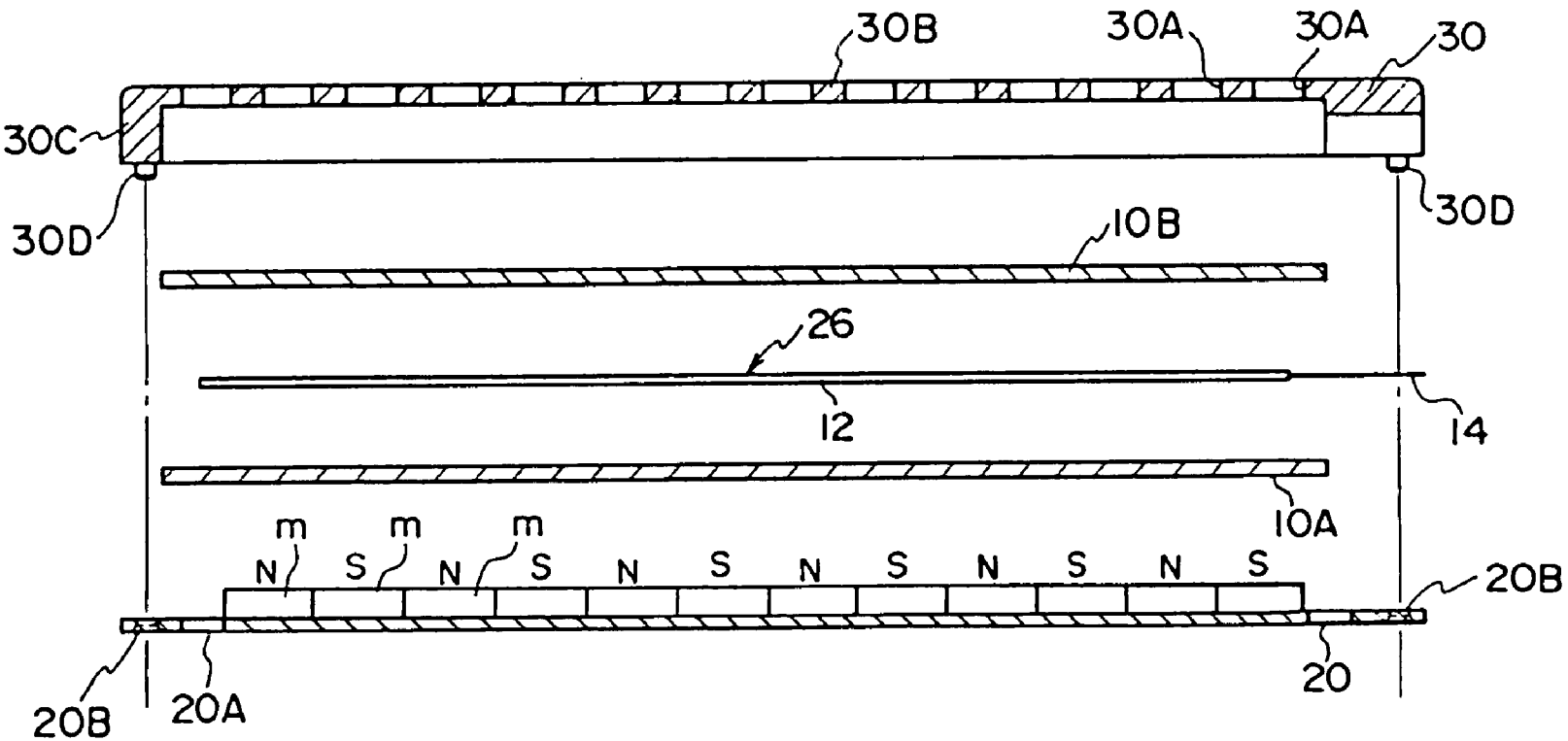
FIG. 18 is an exploded view of the third embodiment of the present invention.

The third embodiment of the present invention will now be described with reference made to FIGS. 17 and 18. As is shown in FIGS. 17 and 18, the acoustic conversion device according to the third embodiment is formed from a magnetic material and is provided with a yoke 20 comprising a rectangular plate-shaped member in the outer peripheral portions of which are punched a plurality of holes 20A. Magnet fixing portions to which are fixed permanent magnets are formed in the area of the yoke 20 surrounded by the holes 20A. Small boss insertion holes 20B for inserting bosses formed in a case are punched in the four corners of the yoke 20.

One of a plurality of flat, quadrangular permanent magnets m is fixed to each of the magnet fixing portions with an adhesive with the magnet side surfaces in contact with the adjacent permanent magnets with no gaps between each magnet such that the upward facing magnetic pole faces of adjacent permanent magnets have alternating polarities. Namely, a plurality of rows of magnets are fixed in place with one magnet row in the direction of the longitudinal side of the yoke 20 having permanent magnets with the N polarity magnetic pole face facing upwards alternating with permanent magnets having the S polarity magnetic pole face facing upwards in an alternating row pattern with another magnet row in the direction of the transverse side of the yoke 20 having permanent magnets with the N polarity magnetic pole face facing upwards alternating with permanent magnets having the S polarity magnetic pole face facing upwards. Note that each permanent magnet may also be fixed in place with the above S and N polarities reversed.

A vibrating membrane 26 is disposed on the top surface of the yoke 20 so as to be parallel with the magnetic pole faces of the permanent magnets and, consequently, the top surface of the yoke. The vibrating membrane 26 is provided with a coil placement portion 12 on which coils are placed, a terminal attachment portion 14 to which terminals are attached, and connecting portions 18A, 18B, and 18C for connecting the coil placement portion 12 with the terminal attachment portion 14. The vibrating membrane 26 is formed from a high polymer film or the like such as polyimide, polyethylene terephthalate, or the like.

A plurality of coil pairs L, each comprising a pair of helically shaped coils positioned on both front and rear surfaces of the coil placement portion, are disposed on the coil placement portion 12 of the vibrating membrane 26 at positions corresponding to each of the permanent magnets m. As was shown in FIG. 10, each coil pair L is wound in a helical shape and in approximately the same shape as the outer edges of the magnetic pole faces of each of the permanent magnets m. Moreover, each coil is positioned in an area on the vibrating membrane such that the outer peripheries of the coils (namely, the outer peripheries of the coiled wiring) substantially match positions corresponding to the outer edges of the magnetic pole faces. Moreover, as is shown in FIG. 17, the coils are positioned such that the outer peripheral portions of each coil (namely, the outer peripheries of the coiled wiring) do not overlap.

Figure 19:
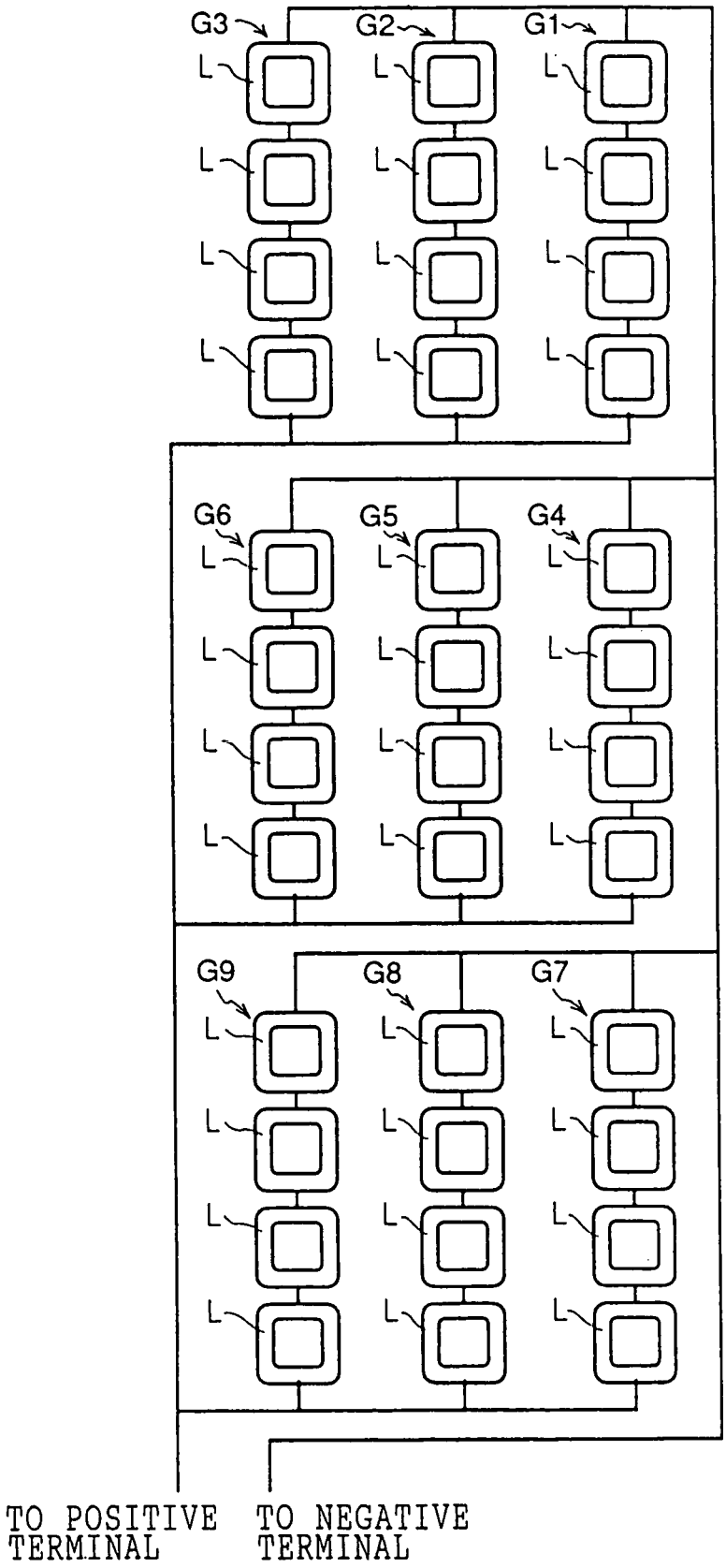
FIG. 19 is a plan view showing connections between coils in the above third embodiment.

As is shown in FIG. 19, a plurality (nine in the present embodiment) of coil groups G1 to G9 are formed by connecting a plurality (four in the present embodiment) of the coil pairs L together in series. These coil groups G1 to G9 are connected together in parallel in the same way as the coil groups shown in FIG. 12. Note that the coil winding directions and connections of the coil groups G1 to G9 are the same as those shown in FIG. 13 and a description thereof is omitted here. Note also that the coil winding directions of adjacent coil groups, namely, the coil groups G1 and G2, the coil groups G2 and G3, the coil groups G4 and G5, the coil groups G5 and G6, the coil groups G7 and G8, and the coil groups G8 and G9 are formed so as to be mutually reversed.

The coils of these coil pairs can be formed by depositing a thin copper film on the coil placement portion 12 of the vibrating membrane 26 and etching the thin copper film so that the planar surface thereof is formed in a coil shape. Each coil is then covered with an insulating material such as resist.

A positive terminal 16A and a negative terminal 16B are fixed in place with a predetermined gap between each to the terminal attachment portion 14 of the vibrating membrane 26. The positive terminal 16A is connected via two wires provided on top of the connecting portions 18B and 18C to one end of a coil group that is connected in parallel. The negative terminal 16B is connected via two wires provided on top of the connecting portions 18B and 18A to the other end of the coil group that is connected in parallel. Because the positive terminal and negative terminal are each connected in this way to a coil group via two wires, even if the wiring on the top of the connecting portions 18A and 18C is cut, current can still be supplied to the coil group via the wiring on the connecting portion 18B. Consequently, the operational reliability of the flat speaker can be improved.

Further, as is shown in FIG. 18, a resin case 30 is provided for housing the coil groups and the vibrating membrane 26. The case 30 is formed with a U-shaped cross section, inside which is provided housing space, by forming a bottom surface 30B, in which are punched a plurality of through holes 30A, and a peripheral wall 30C erected from the peripheral edges of the bottom surface 30B. Bosses 30D are formed in each corner of the peripheral wall 30C.

Figure 20:
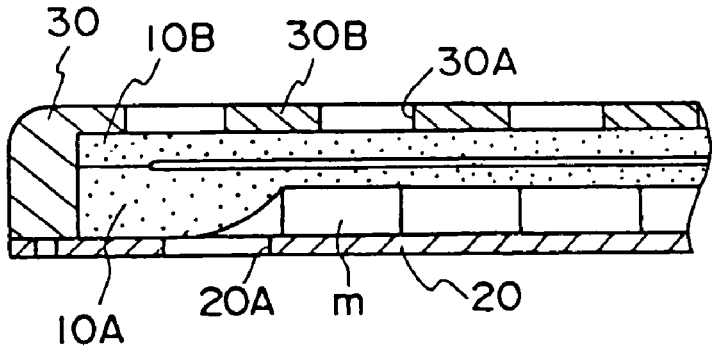
FIG. 20 is a partial cross-sectional view of the third embodiment of the present invention.

The coil placement portion 12 of the vibrating membrane 26 as well as the coil groups are sandwiched from both the front and rear surface sides by pliable supporting members 10A and 10B made from a polyester non-woven fabric. Accordingly, the coil placement portion 12 and the coil groups are enveloped by the supporting members 10A and 10B so as to be housed within the housing space inside the case 30. The yoke 20 on which the permanent magnets are fixed is then used to close off the housing space from the peripheral wall 30C side of the case 30. By then inserting the bosses 30D into the small holes 20B of the yoke 20 and welding those portions of the bosses 30D protruding from the small holes 20B, the flat speaker shown in FIG. 20 is assembled. At this time, the terminal attachment portion 14 of the vibrating membrane is sandwiched in a state of being press-adhered between the supporting members 10A and 10B when the case 30 and the yoke 20 are assembled together and are left exposed from the case 30 so that they can be connected to a signal source.

The result of this is that, as is shown in FIG. 20, the coil placement portion 12 of the vibrating membrane 26 can vibrate together with the coil groups and, moreover, the coil placement portion 12 of the vibrating membrane 26 together with the coil groups are supported within the housing space inside the case without being in contact with the internal surface of the case.

A cross-sectional view of the flat speaker unit assembled in the above way with the supporting members omitted is the same as that shown in FIG. 14. Adjacent permanent magnets m are positioned such that their side surfaces are in contact with the adjacent permanent magnets with no gap between the magnets. Moreover, the upwards facing magnetic pole faces of adjacent magnets have alternating polarities facing the same direction. Therefore, the magnetic flux generated from each permanent magnet travels from the N polarity magnetic pole face to the S polarity magnetic pole face. The magnetic flux in the areas between adjacent permanent magnets travels in a direction substantially parallel to the surface of the vibrating membrane and is at the maximum in the areas between permanent magnets.

Because coil pairs L formed from coils provided on both the front and rear surfaces are disposed on the coil placement portion of the vibrating membrane, magnetic flux in a direction substantially parallel to the surface of the vibrating membrane interlinks in each coil. When current I is supplied to the coils in the direction shown in FIG. 13, then, as is shown in FIG. 14 as well, the current flows in the same direction in adjacent coil portions extending from inner peripheries to the outer peripheries of adjacent coils and all the coils are affected by a unidirectional force F acting in a direction perpendicular to the membrane surface of the vibrating membrane. As a result, the vibrating surface is displaced in a direction perpendicular to the membrane surface.

Accordingly, when an electrical signal representing the sound to be generated is supplied to a coil, the coil placement portion of the vibrating membrane vibrates in accordance with this signal together with the coil enabling a sound signal to be generated. At this time, the peripheral edge of the coil placement portion of the vibrating membrane is acting as a free end, therefore it is possible to vibrate the entire coil placement portion thus improving the vibration efficiency of the vibrating membrane.

Furthermore, at this time, as is shown in FIG. 14, the magnetic flux at the magnetic pole faces on the bottom surface side of the permanent magnets exits from the N poles, passes along a magnetic path inside the yoke 20, and enters into the S poles. Therefore, because it is possible to generate magnetic flux of a higher density at the magnetic pole faces of the upper surface side, an electric signal of a small amplitude can be efficiently converted into a sound signal and leakages of magnet flux to the outside of the bottom surface side can be reduced.

Moreover, because a plurality of holes 30A are punched in the bottom surface 30B of the case, the sound signals are output from the front surface of the flat speakers via these holes.

Fourth Embodiment

Figure 21:
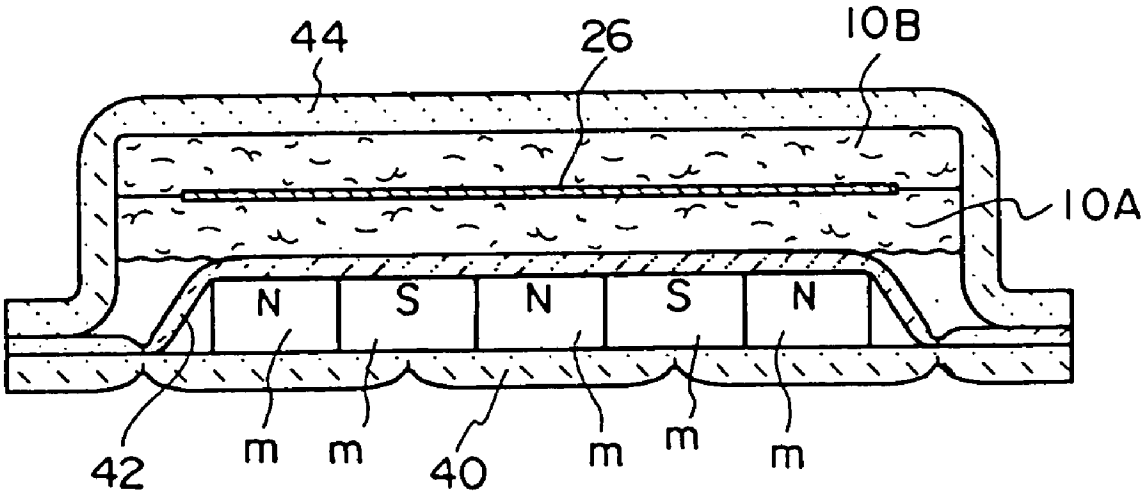
FIG. 21 is a cross-sectional view of the fourth embodiment of the present invention.

The fourth embodiment of the present invention will now be described with reference made to FIG. 21. In this embodiment, a permanent magnet m group comprising a plurality of permanent magnets m, as in the third embodiment, is disposed on a fabric supporting member 40 made from a flexible material. The entire permanent magnet m group is then covered with a fixing cloth 42, and the permanent magnet m group is fixed to the top of the fabric supporting member 40 by sewing together the portions of the fabric supporting member 40 and the fixing cloth 42 on both sides of the permanent magnet m group.

A vibrating membrane 26, on which are placed coil groups the same as in the third embodiment, is disposed on top of the permanent magnet m group and enveloped by the supporting members 10A and 10B.

The vibrating membrane which is enveloped by the supporting members is covered with a fabric cover 44. The fabric cover 44 and the fabric supporting member 40 are sewn together and the coil placement portion of the vibrating membrane and the coils are enveloped and supported inside a fabric case in such a manner that the coil placement portion of the vibrating membrane and the coils are able to vibrate and without the coil placement portion of the vibrating membrane and the coils coming into contact with the inner surface of the case.

In the present embodiment, a sound signal can be generated in the same way as in the third embodiment. However, because all portions other than the vibrating membrane, the coils, and the permanent magnets are made from fabric, the speaker has great pliability and can be housed inside clothing or inside shoulder pads or the like. Further, the flat speaker or the flat speaker unit can be disposed in the pockets of clothes, at portions of clothes corresponding to bones such as a collarbone, at the front surfaces of clothes, or at the reverse surfaces of clothes, so as to be wearable. Further, by making the flat speaker or the flat speaker unit wearable, blood circulation can be improved due to the action of the vibrations generated at the time the vibrating membrane is vibrated and due to the action of the magnetism from the permanent magnets.

In each of the above embodiments, examples were described of when coil pairs were placed on a vibrating membrane, however, it is also possible to use coils provided on one surface only of the vibrating membrane. Moreover, in the above embodiments, examples were described of when helically shaped coils were fixed on the vibrating membrane, however, instead of the coils, it is also possible to use either one or a plurality of conducting wires fixed to those portions of the vibrating membrane which correspond to areas between permanent magnets.

Note that, in each of the above embodiments, examples were described of when each of the permanent magnets was positioned in contact with other permanent magnets, however, it is also possible to position each permanent magnet a slight distance from other permanent magnets. When flat, square magnets are used, it is preferable if the gap between magnets is not more than approximately one third of the permanent magnet width. It is also possible to use a combination of permanent magnets which are in contact with other magnets and permanent magnets which are a small distance away from other magnets.

Moreover, in each of the above embodiments, descriptions were given of speakers which output sound when current is fed to a coil, however, if induction current is supplied to a coil and a vibrating membrane is vibrated according to Fleming's right-hand law, the speakers can also be used as microphones.

Figure 22A:
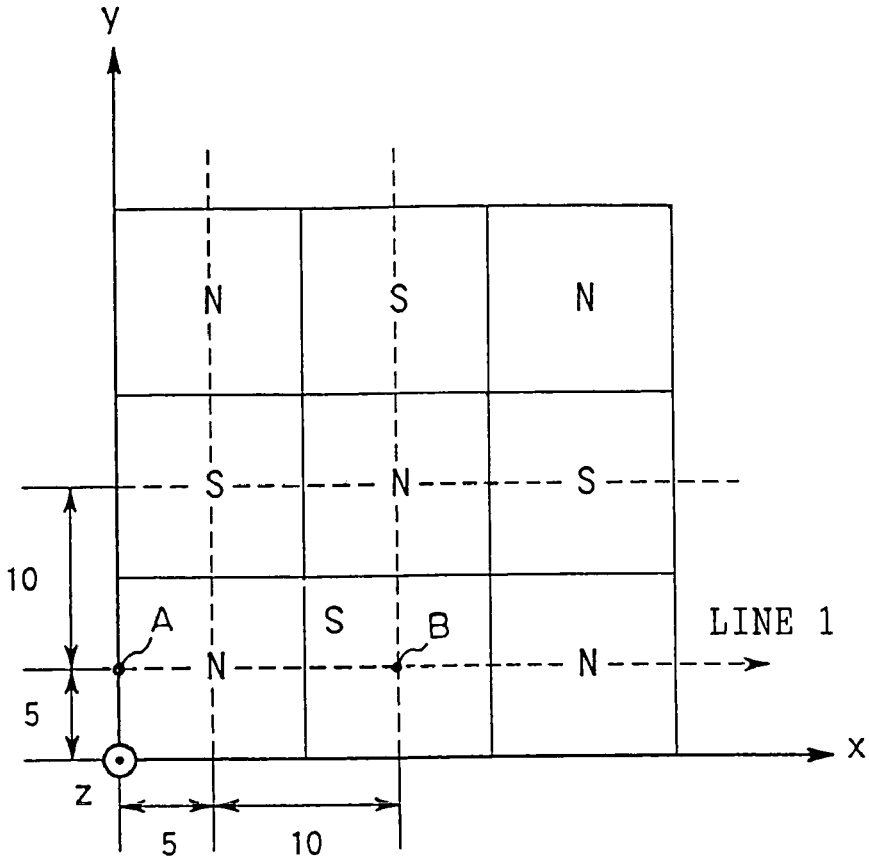
FIG. 22A is a plan view and FIG. 22B is a cross-sectional view of the disposition of the permanent magnets whose magnetic flux distribution is measured in FIG. 23.
Figure 22B:
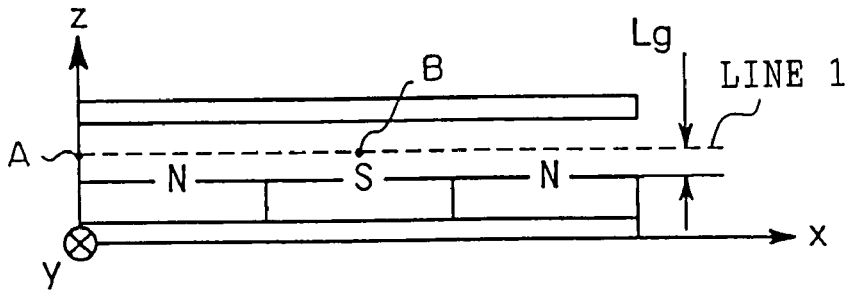
Figure 23A:
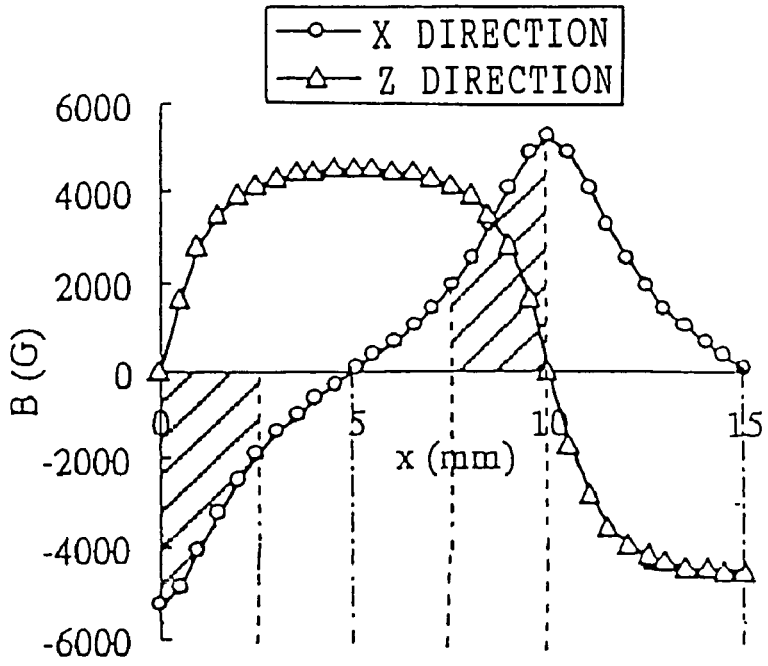
Figure 23B:
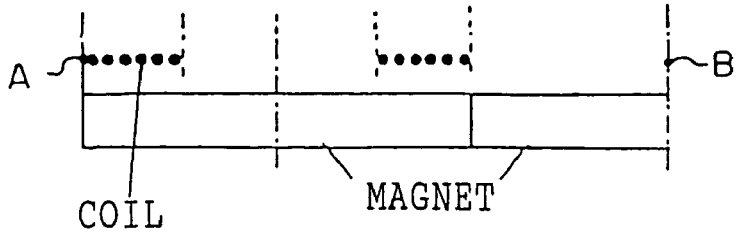
FIG. 23B is an explanatory view showing the disposition of the coils corresponding to the magnetic flux distribution of FIG. 23A.

Nine flat, square permanent magnets of a size 10 mm high by 10 mm wide by 3 mm deep were actually placed in contact with each other in a matrix formation on a yoke, as shown in FIG. 22A, with no gaps between the permanent magnets. The magnetic flux density on the line 1 whose distance (Lg) from the magnetic pole face is 1.0 mm, as shown in FIG. 22B, was measured. Note that a magnetic shield member was placed above the magnetic pole face. The magnetic flux density in a direction parallel to the magnetic pole face (x direction) between the point A and the point B on the line 1 and the magnetic flux density in a direction perpendicular to the magnetic pole face (Z direction) are shown in FIG. 23.

The magnetic flux density in the x direction was zero at a position corresponding to the center of the magnetic pole face and the absolute value of the magnetic flux density increased the further from this point. The absolute value of the magnetic flux density in the x direction was at the maximum (5000 G) at the boundary of the permanent magnet with the adjacent permanent magnet. In particular, when the permanent magnets were placed in contact with each other, the increase in the magnetic flux density in the x direction at the boundary was remarkable in comparison with when the permanent magnets were positioned with a slight gap between them, as described below. The magnetic flux density in the z direction was at the maximum 4000 G at a position facing the region around the center point of the magnetic pole face of the permanent magnet and was zero at the point A and at the boundary between contiguous permanent magnets.

It is possible to decide the coil placement positions by considering magnetic flux distribution such as that described above. When a coil is positioned in the magnetic flux distribution shown in FIG. 23, it is possible to place the coils on the area of the slanting line at which a magnetic field of a predetermined magnetic flux density or greater (e.g. 2000 G) sufficient to drive the vibrating diaphragm acts on the coils (e.g. in an area corresponding to the area from the outer periphery of the permanent magnet extending 2.5 mm towards the inner periphery). Force in a vertical direction acts on the vibrating membrane in those areas where the magnetic flux density is less than the predetermined magnetic flux density, however, when the weight of the coils is considered, this force cannot be considered sufficient to vibrate the vibrating membrane holding the coils. Therefore, by placing the coils in an area where the magnetic flux density is at a predetermined level or greater, the vibrating membrane can be efficiently vibrated.

Note that the magnetic flux density in the z direction is not zero in the areas of the slanting line where the coil is placed, however, forces act in reverse directions in symmetrical coil positions and the force in a direction parallel to the vibrating surface is cancelled out. Therefore, there is no twisting or the like of the coil.

Figure 24A:
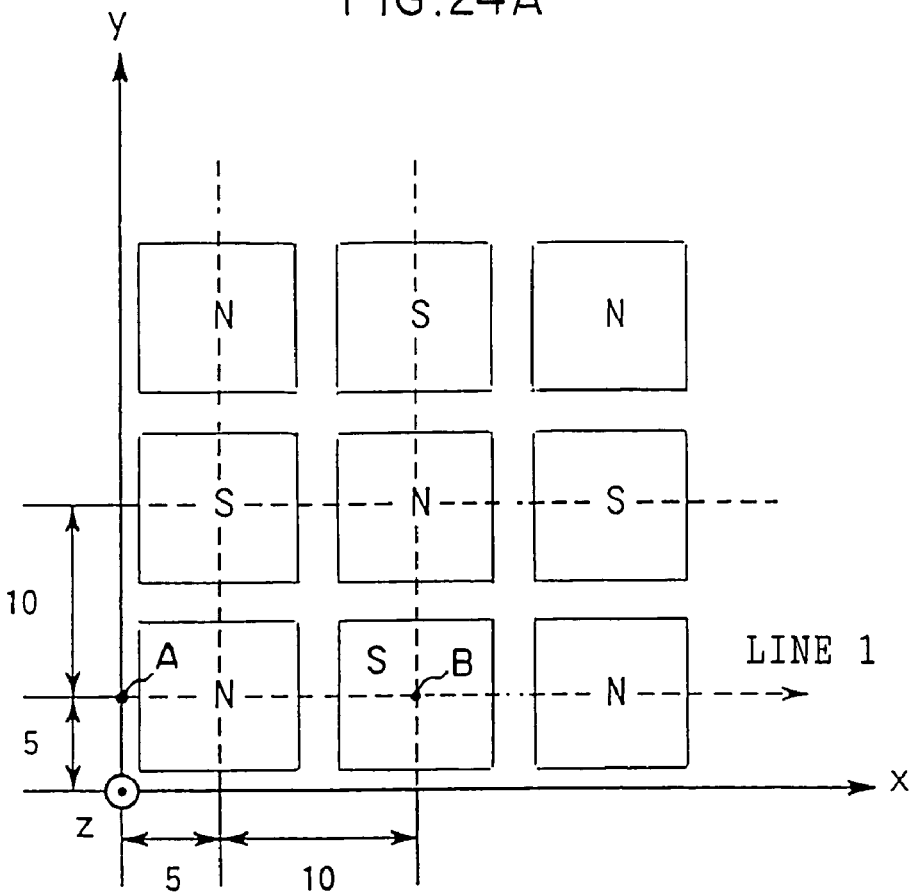
FIG. 24A is a plan view and FIG. 24B is a cross-sectional view of the disposition of the permanent magnets whose magnetic flux distribution is measured in FIG. 25.
Figure 24B:
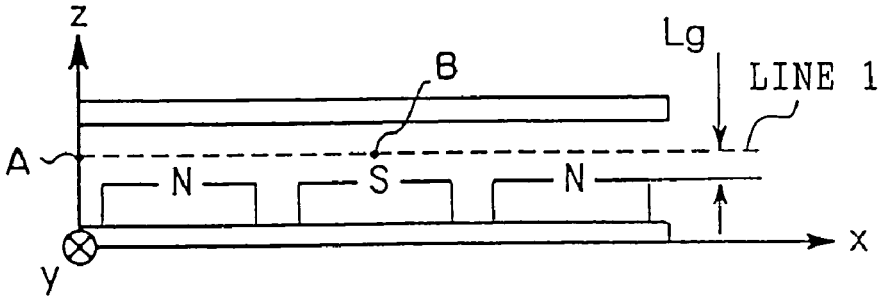
Figure 25A:
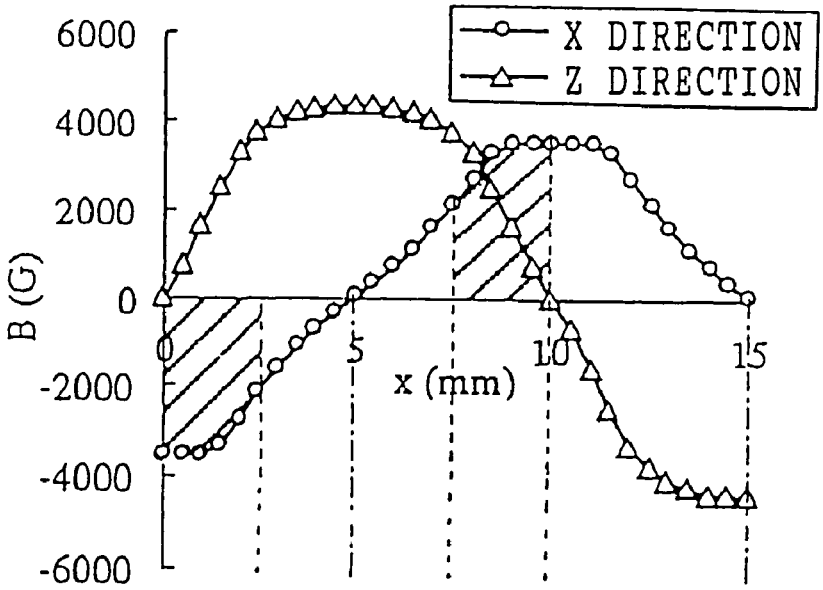
FIG. 25A is a is a graph showing the magnetic flux distribution when permanent magnets are placed with a gap between each other.
Figure 25B:
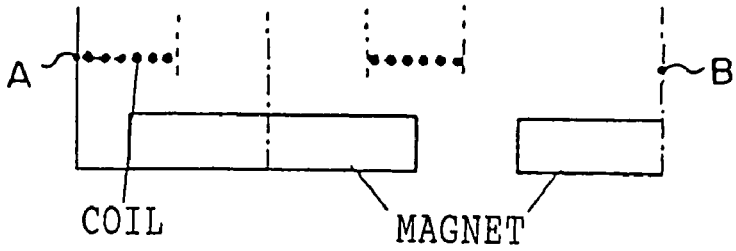
FIG. 25B is an explanatory view showing the disposition of the coils corresponding to the magnetic flux distribution of FIG. 25A.

Next, nine permanent magnets of a size 7.5 mm high by 7.5 mm wide by 3 mm deep were placed on a yoke in a matrix formation with a 2.5 mm gap between each magnet, as shown in FIG. 24A. The magnetic flux density on the line 1 whose distance (Lg) from the magnetic pole face is 1.0 mm, as shown in FIG. 24B, was measured. Note that a magnetic shield member was placed above the magnetic pole face. The magnetic flux density in a direction parallel to the magnetic pole face (x direction) between the point A and the point B on the line 1 and the magnetic flux density in a direction perpendicular to the magnetic pole face (Z direction) are shown in FIG. 25.

The magnetic flux density in the x direction and z direction was substantially the same as when the permanent magnets of a size 10 mm high by 10 mm wide by 3 mm deep were placed in contact with each other in a matrix formation with no gaps between the permanent magnets. However, in the area between a position 8.75 mm distant from the A point and a position 11.25 mm distant from the A point, namely, in the area above a gap where no permanent magnets were positioned, it was possible to maintain the magnetic flux density in the x direction at a maximum value of approximately 4000 G.

In the same way as when the permanent magnets were positioned with no gaps between each permanent magnet, it is possible to efficiently vibrate the vibrating membrane by placing the coils on the area of the slanting line at which a magnetic field of a predetermined magnetic flux density or greater sufficient to drive the vibrating diaphragm acts on the coils (e.g. in an area corresponding to the area from a position a predetermined distance inwards from the outer periphery of the magnetic pole face extending to a position midway between magnets).

Fifth Embodiment

Figure 26:
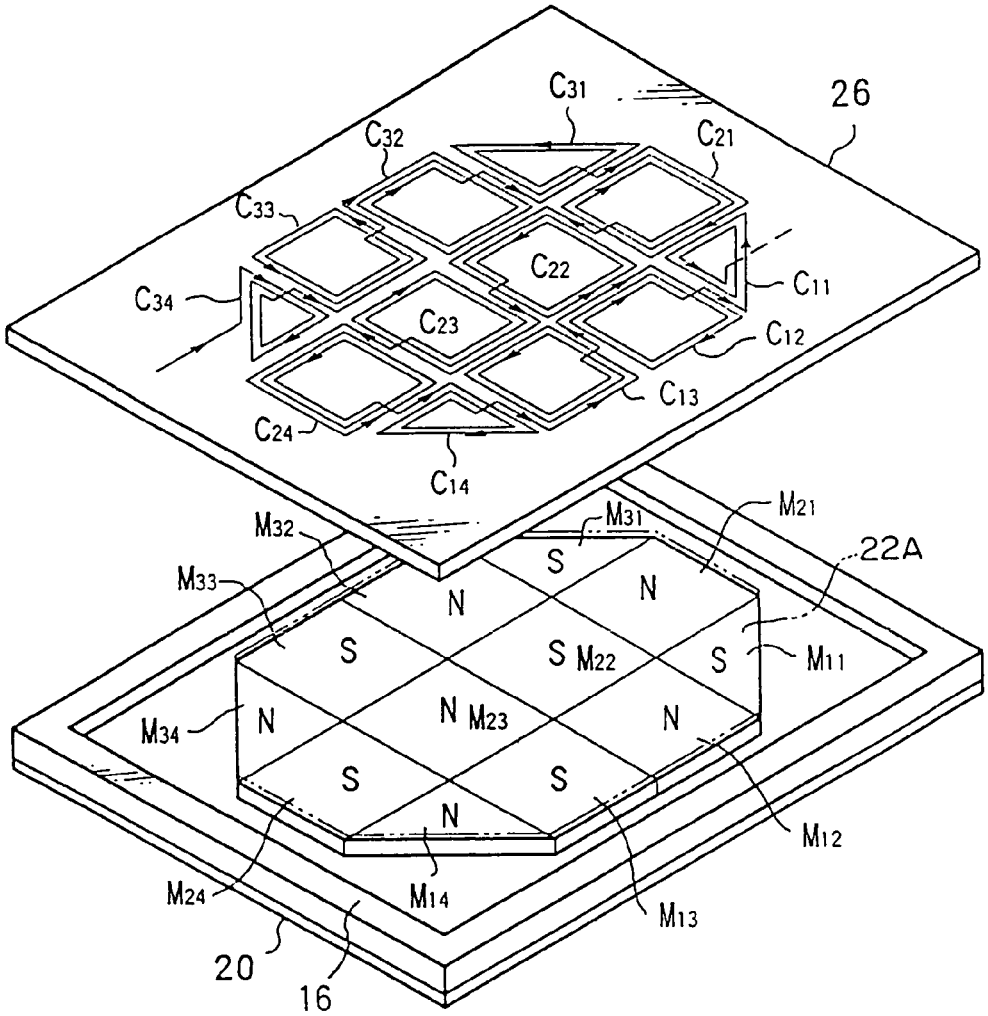
FIG. 26 is an exploded perspective view showing the fifth embodiment of the present invention.

The fifth embodiment of the present invention will now be described. As is shown in FIG. 26, in the flat speaker unit of the fifth embodiment, a sheet member 22A made from a non-magnetic material is adhered to the entire surface of a magnetic pole face of the plurality of permanent magnets of the speaker unit of the first embodiment shown in FIG. 9, thus covering the entire surface of the magnetic pole face with the sheet member 22A. The sheet member 22A may be made from a material having pliability and a degree of porousness such as rock wool, glass wool, non-woven fabric, Japanese paper, or the like. Because the remaining parts are the same as those of the first embodiment, identical parts are given the same descriptive symbols and a description thereof is omitted.

A frame-shaped spacer 16 whose thickness is thicker than that of the permanent magnets is disposed on the top surface of the yoke 20 such that all of the permanent magnets are positioned inside the frame opening. This spacer can be made from a magnetic material or a non-magnetic material, however, making the spacer from a magnetic material enables magnetic flux leaks in a transverse direction to be prevented.

The peripheral portions of the membrane surface of the vibrating membrane 26 are fixed to the top surface of the spacer 16 such that the membrane surface is parallel to a magnetic pole face of the permanent magnet and, accordingly, to the top surface of the yoke. A predetermined tensional force is also applied to the membrane surface and the membrane surface is disposed facing and adjacent to the sheet member 22A.

As a result of this, an air layer of a predetermined thickness is formed between the sheet member 22A and the vibrating membrane 26 due to the spacer 16 being interposed between the sheet member 22A and the vibrating membrane 26. It is preferable that the thickness of this air layer is such that the vibrating membrane 26 makes slight contact with the sheet member 22A when the vibrating membrane 26 is vibrating at the maximum amplitude.

Because coils are placed in the above manner on the vibrating membrane positioned parallel and adjacent to the sheet member in this way, while magnetic flux traveling in a direction along the surface of the vibrating membrane interlinks in the adjacent portions of each coil, magnetic flux also interlinks in a direction perpendicular to the surface of the vibrating membrane. However, the force of the latter magnetic flux is small and is cancelled out because it acts in reverse directions in symmetrical coil positions. Accordingly, when current is supplied from one end of a coil group connected in series in a flat speaker unit flowing towards the other end, the current flows in the same direction in adjacent coil portions of adjacent coils and the current flowing in adjacent coil portions of adjacent coils is affected by unidirectional force from the magnetic field in the direction perpendicular to the surface of the vibrating membrane. As a result, because the vibrating membrane receives almost no force in a direction along the surface of the vibrating membrane and vibrates in a direction perpendicular to the membrane surface, noise components are greatly reduced and the sound quality can be improved. Moreover, in the above embodiment, because the coil placement portion of the vibrating membrane is coated with a ceramic coating, the ceramic coated portion vibrates as an integral whole allowing a high volume to be output without any sound distortion.

Further, in the present embodiment, because a plurality of permanent magnets are disposed in the longitudinal direction of conventional bar magnets, namely, in the row direction of the present embodiment, and a plurality of coils are disposed on the vibrating membrane at positions corresponding to the permanent magnets, the combined length of the outer edge portions of the plurality of permanent magnets is longer than the length of the outer edges of the bar magnets so that the overall length of the coil portions interlinking with the magnetic flux is longer than when bar magnets are used. The result of this is that, compared with when a plurality of rows of bar magnets are provided, it is possible to improve the proportion of the surface area of the vibrating membrane occupied by the coils surrounding each magnet. It is also possible to increase the effective magnetic flux compared to the prior art. As a result, it is possible to improve the efficiency of converting an electrical signal to a sound signal and the sound quality improved.

Furthermore, because a combination of different triangular and quadrangular shaped permanent magnets and coils are used for the permanent magnets and coils, the speaker can be formed in shapes different from those of conventional speakers.

Moreover, because the magnetic pole face which has a high degree of hardness is covered with a pliable sheet material, reflected sound from the sheet material is reduced and reflected sound can be prevented from becoming noise. In addition, because an air layer of a predetermined thickness is interposed between the vibrating membrane and the sheet member, twisting of the vibrating membrane is prevented by making the phases of the reflected sounds from the sheet material identical.

Sixth Embodiment

Figure 27:
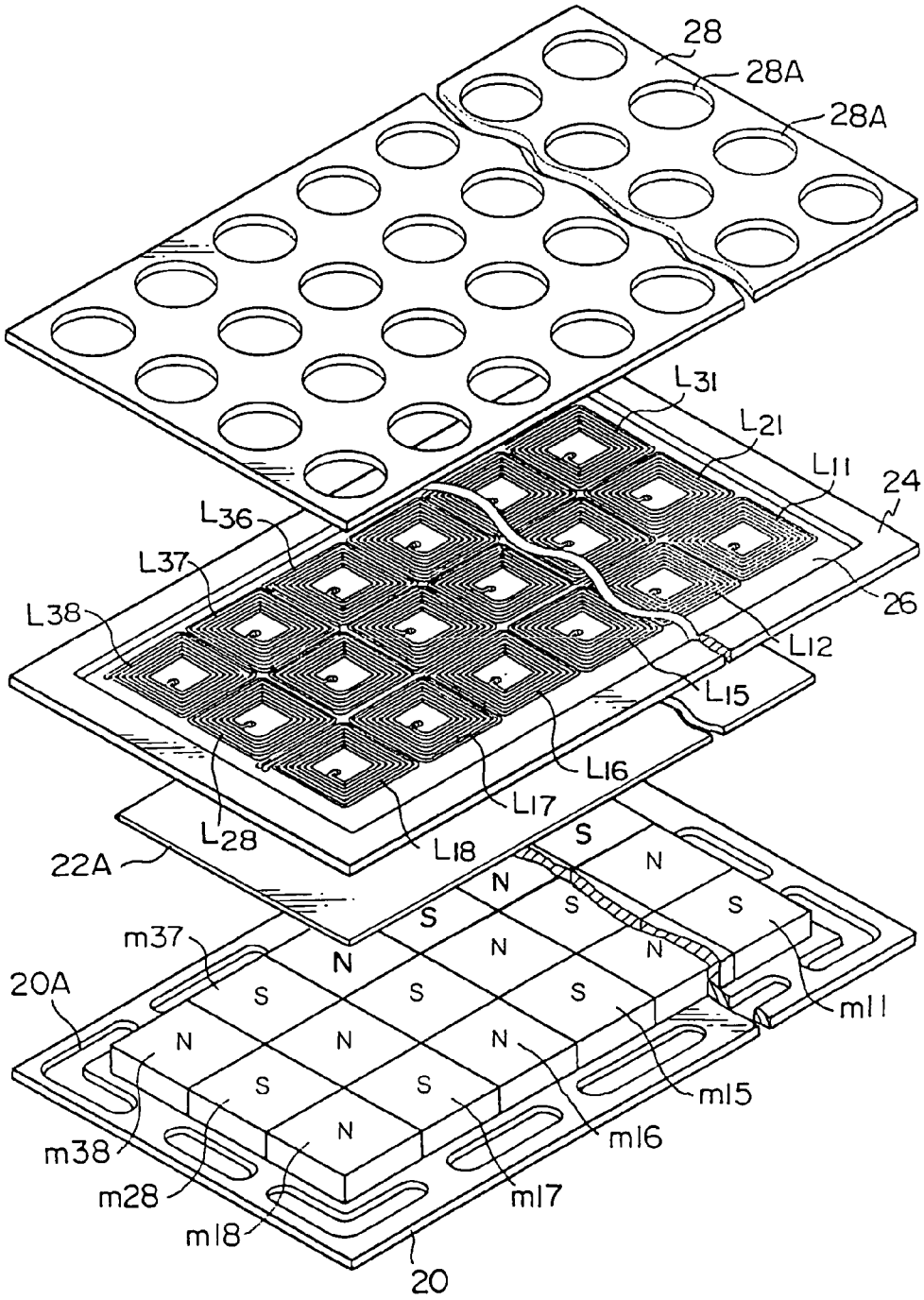
FIG. 27 is an exploded perspective view showing the sixth embodiment of the present invention.
Figure 28:
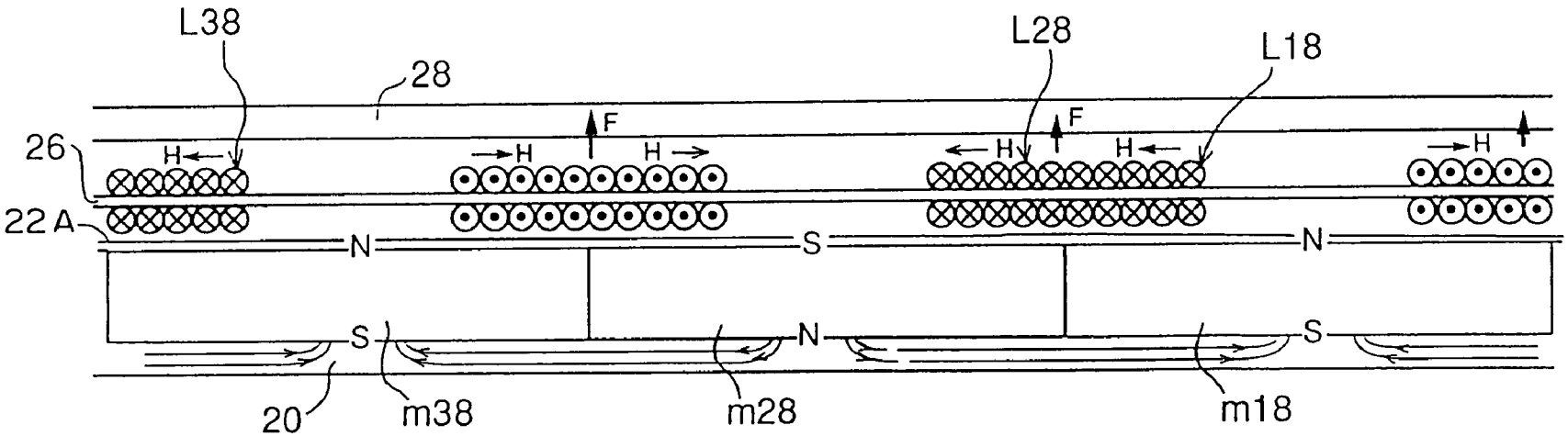
FIG. 28 is a cross-sectional view taken along a plane passing through the permanent magnets m18 to m38 of the above sixth embodiment.

The sixth embodiment of the present invention will now be described with reference made to FIGS. 27 and 28. The sixth embodiment uses the sheet material 22A instead of the pliable material 22 of the second embodiment. Because the remaining parts are the same as in the second embodiment, identical parts are given the same descriptive symbols and a description thereof is omitted.

Namely, as was described in the fifth embodiment, in the sixth embodiment as well, magnetic pole faces of a plurality of permanent magnets are covered with a sheet member 22A, which is adhered thereto, in order to form an air layer of a predetermined thickness between the vibrating membrane 26 and the sheet member 22A.

A yoke 20 to which are fixed a plurality of permanent magnets whose magnetic pole faces are covered by the above sheet member 22A, a frame 24 to which is fixed a vibrating membrane 26 on which are placed a plurality of coils, and a magnetic shield member 28 are assembled as a flat speaker unit. The frame 24, to which is fixed the vibrating membrane 26 on which are placed the plurality of coils, is sandwiched between the yoke 20 and the magnetic shield member 28, and a spacer is interposed between the vibrating membrane and the sheet member such that an air layer of a predetermined thickness is formed.

In the present embodiment, because the magnetic pole face which has a high degree of hardness is covered with a pliable sheet material, reflected sound from the sheet material is reduced and reflected sound can be prevented from becoming noise. In addition, because an air layer of a predetermined thickness is interposed between the vibrating membrane and the sheet member, twisting of the vibrating membrane is prevented by making the phase of the reflected sound from the sheet material identical.

Note that, in the above fifth and sixth embodiments, examples were described of when each permanent magnet was placed in contact with other permanent magnets, however, it is also possible to place the permanent magnets with a slight gap between each permanent magnet, and, as shown in the embodiments described below, it is also possible to place the magnets a predetermined distance apart from each other. When flat, square magnets are used, it is preferable if the distance between magnets is less than approximately one third the width of the permanent magnets. It is also possible to use a combination of permanent magnets placed in contact with each other with permanent magnets having a slight gap between magnets or permanent magnets placed a predetermined distanced apart from each other.

Seventh Embodiment

Figure 29:
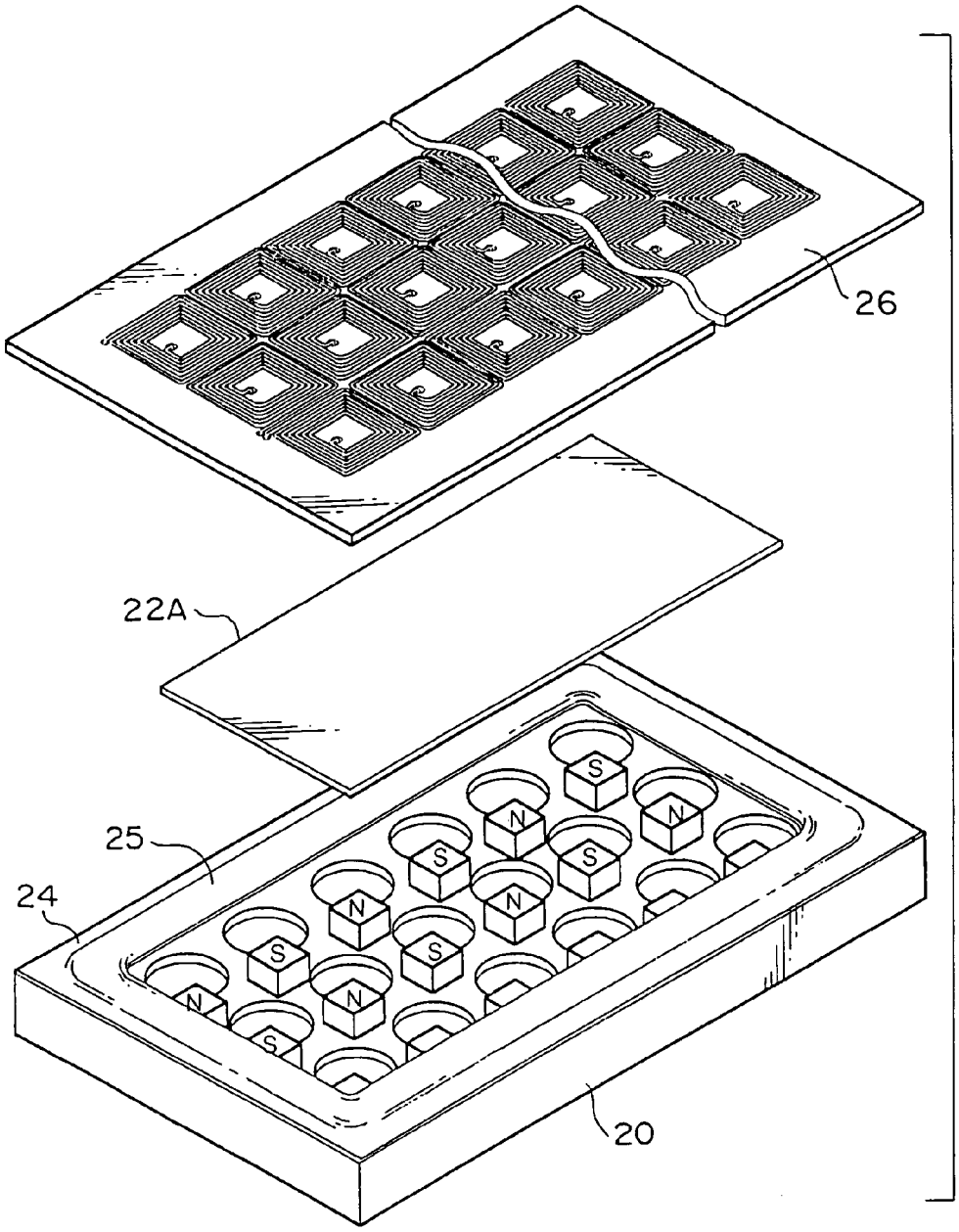
FIG. 29 is an exploded perspective view showing the seventh embodiment of the present invention.
Figure 30:
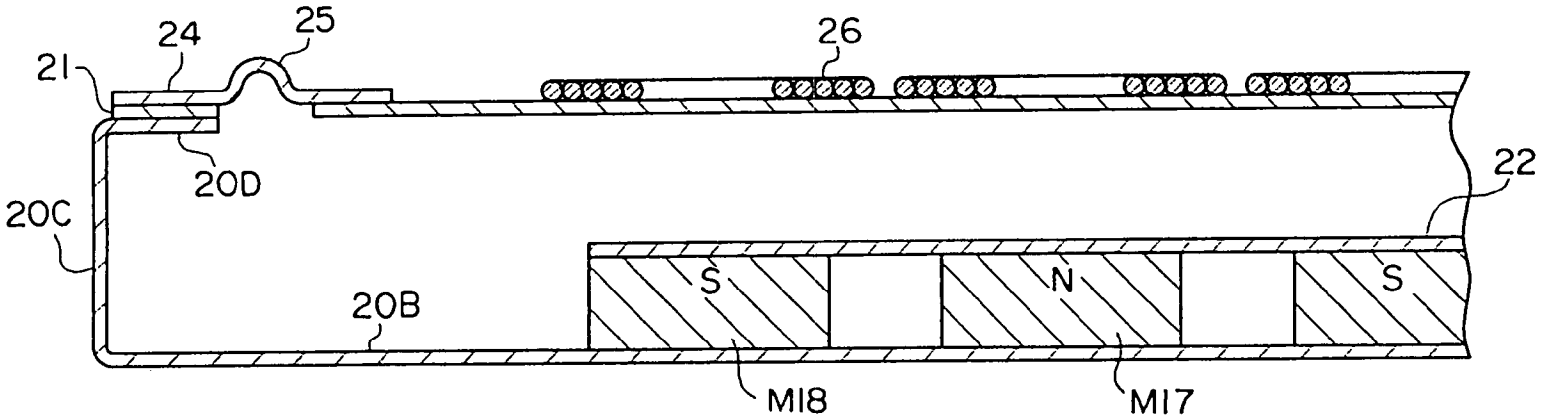
FIG. 30 is a partial cross-sectional view of the seventh embodiment of the present invention.
Figure 31:
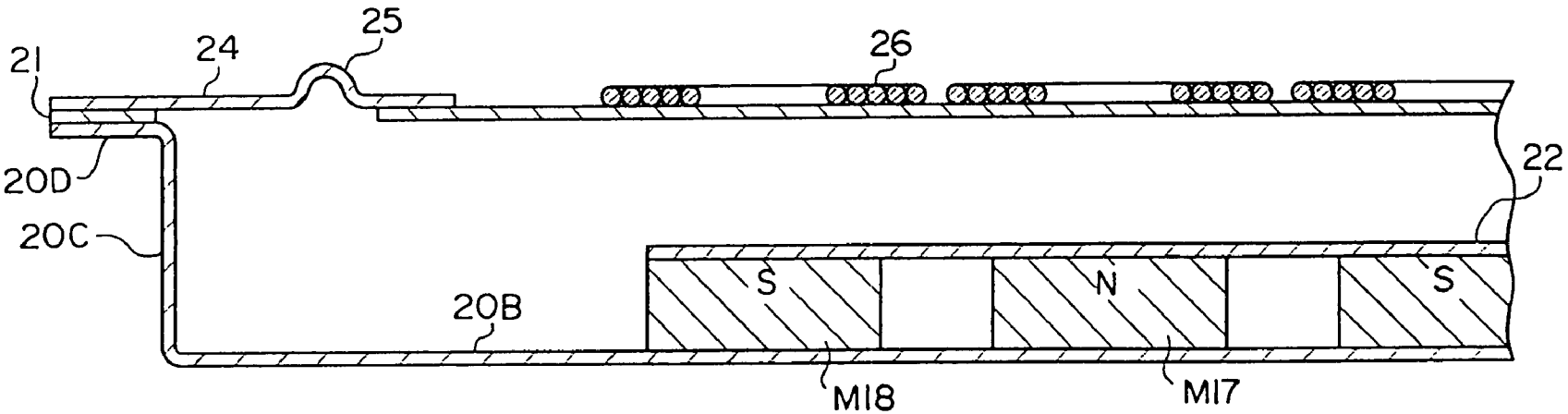
FIG. 31 is a partial cross-sectional view of a variant example of the seventh embodiment.

The seventh embodiment of the present invention will now be described with reference made to FIGS. 29 to 31. In the seventh embodiment, the magnets of the sixth embodiment are placed a predetermined distance apart, as is also shown in FIG. 30. Perpendicular portions 20C are formed by bending the peripheral edges of the yoke 20 substantially perpendicular relative to the magnet placement surface 20B. The peripheral edges of the yoke are then bent again parallel to the magnet placement surface thus forming vibrating membrane mounting portions 20D. Note that, in FIG. 30, the vibrating membrane mounting portions 20D are bent inwards, however, as shown in FIG. 31, the vibrating membrane mounting portions 20D may also be bent outwards. By bending the vibrating membrane mounting portions outwards like this, the vibrating membrane mounting portions can also be used as mounting portions for the flat speaker unit.

The outer peripheral edge of a rectangular frame-shaped frame 24 is fixed to the vibrating membrane mounting portion 20D with spacers 21 made from paper or the like interposed between the two. The frame member 24 is an edge formed from an elastic protruding portion 25 having a semi-circular cross-section running unbroken around the outer peripheral edge. The outer peripheral edge of a vibrating membrane on whose central portion the coils are placed is welded to the inner peripheral edge of the frame 24. As a result, the entire periphery of the coil placement portion of the vibrating membrane is surrounded by an elastic portion 25 whose hardness is less than the hardness of the coil placement portion. As is explained below, it is preferable if the modulus of elasticity of a portion of the elastic portion 25 along the longitudinal side of the frame 24 is higher than the modulus of elasticity of surrounding portions.

A sheet member 22A described above, which is formed from a non-magnetic material, is adhered to the entire surface of the magnetic pole faces of a plurality of permanent magnets, thus covering the entire surface of the magnetic pole face with the sheet member 22A. As a result, the spaces between magnets is covered by the sheet member 22A and an air layer of a predetermined thickness is formed between the vibrating membrane and the sheet member.

According to the present embodiment, the effects are achieved that the formation of the perpendicular portions 20C enables leakages of magnetic flux from the sides to the outside to be prevented. Moreover, the provision of the sheet member 22A enables the phase of reflected sound from the sheet member to be made uniform, thus preventing the vibrating membrane from twisting. In addition, because the vibrating membrane is surrounded by an elastic portion having a degree of elasticity, the vibrating membrane can be vibrated parallel to a direction perpendicular to the surface of the vibrating membrane.

As described above, according to the present embodiment the effects are achieved that, because pliable air layer forming members are placed on the first and second magnetic pole face sides of the vibrating membrane so as to form, together with the vibrating membrane, air layers of a predetermined thickness, air layers of a predetermined thickness are formed between the vibrating membrane and the air layer forming members and no phase difference is generated in the reflected sound. Therefore, there is no twisting in the vibrating membrane and the sound quality can be improved.

Eighth Embodiment

Figure 32:
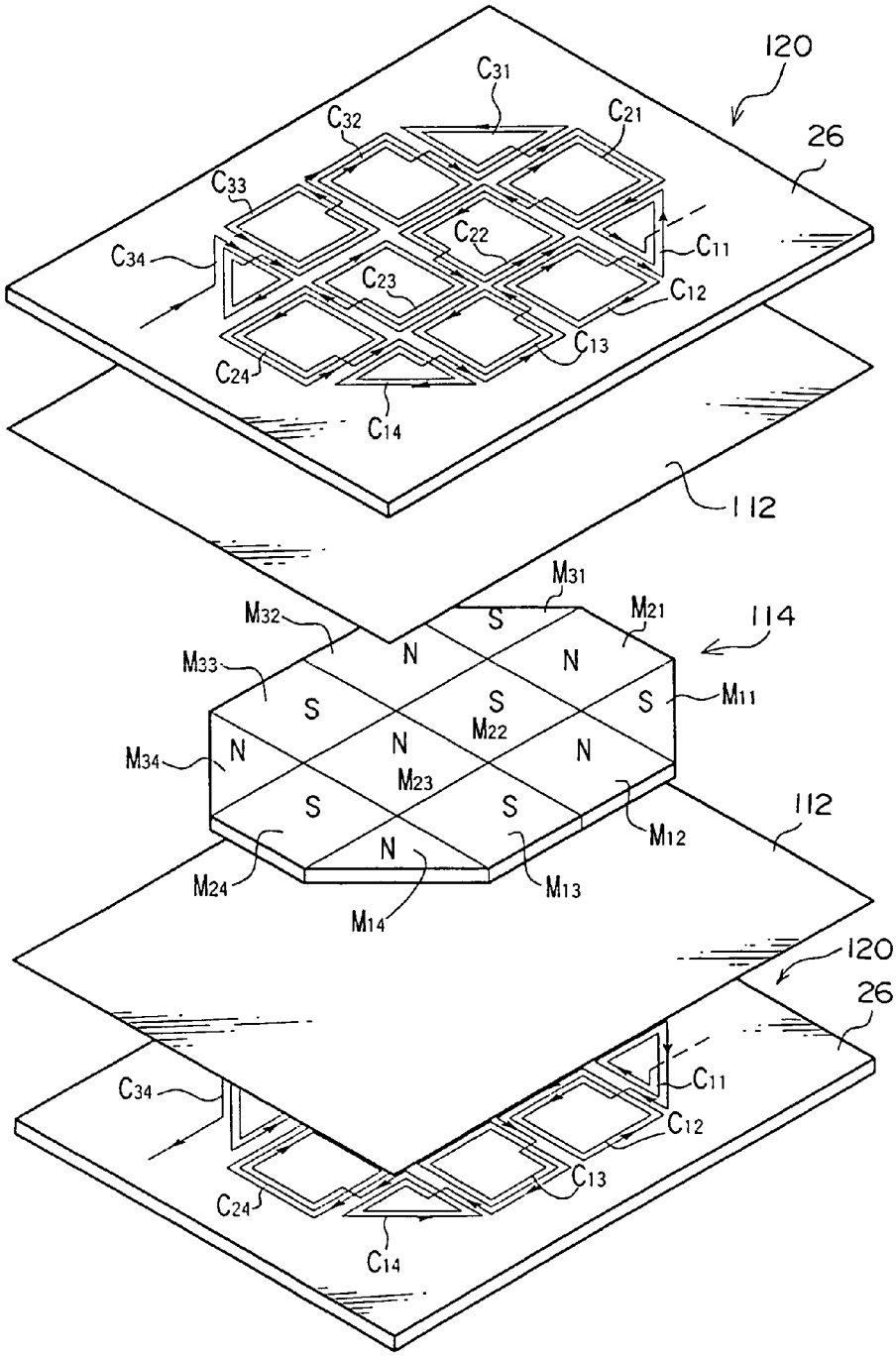
FIG. 32 is an exploded perspective view showing the eighth embodiment of the present invention.
Figure 33:
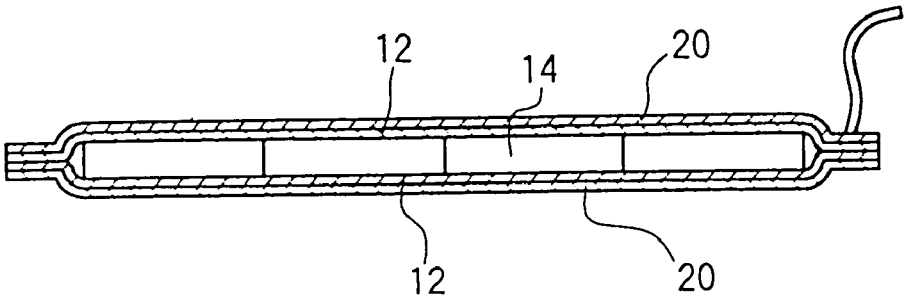
FIG. 33 is a cross-sectional view of the eighth embodiment.

The eighth embodiment of the present invention will now be described. As is shown in FIG. 32, the flat speaker unit of the eighth embodiment is constructed by sandwiching a permanent magnet group 114, comprising flat permanent magnets M11 to M34 placed so that their side faces are in contact with each other, between a pair of vibrating bodies 120. Sheet members 112, made from non-magnetic material, are also interposed between the permanent magnet group 114 and each of the pair of vibrating bodies 120. This structure is then closely adhered together so as to form a flat (e.g. having a thickness of approximately 1 mm) overall structure, as is shown in FIG. 33.

As is shown in FIG. 32, in the same way as shown in FIG. 9, a flat, triangular permanent magnet M11 is mounted, so as to be movable with respect to a sheet 112, at a position corresponding to one of the corner portions of the lower vibrating body 120 to the sheet 112 interposed therebetween such that the S plurality magnetic pole face thereof faces upwards and such that the oblique side of the triangle faces the corner portion. A ferrite based magnet or an NdFeB based magnet can be used as the permanent magnet.

A flat, quadrangular permanent magnet M12 is mounted, so as to be movable with respect to the sheet 112, at a position adjacent to the permanent magnet M11 in the longitudinal direction of the vibrating body 120 to the sheet 112 interposed therebetween such that the N polarity magnetic pole thereof faces upwards and such that one side face of the permanent magnet M12 is contact with a side face of the permanent magnet M11.

A flat, quadrangular permanent magnet M13 is mounted at a position adjacent to the permanent magnet M12 in the longitudinal direction of the vibrating body 120 with the S polarity magnetic pole thereof facing upwards and a flat, triangular permanent magnet M14 is mounted at a position adjacent to the permanent magnet M13 in the longitudinal direction of the vibrating body 120 with the N polarity magnetic pole thereof facing upwards such that one side face of each of these magnets is in contact with side faces of adjacent magnets.

Three permanent magnets are positioned with magnetic pole faces of different polarities positioned alternately at adjacent positions in the direction of the short sides of the sheet members of each of the permanent magnets M11, M12, M13, and M14, and are mounted with the side surfaces thereof in contact with the adjacent permanent magnet. Because the permanent magnets M11 to M34 are flat with parallel front and rear surfaces, each magnetic pole face is parallel with the top surface of the vibrating body and faces in the same direction.

The result of positioning the magnets in this way is that, in the same way as in the first embodiment, the permanent magnets Mij are positioned as follows. Namely, a magnet row comprising a plurality of magnets is arranged such that magnetic pole faces of alternating polarities face upwards going along one of the longitudinal or transverse sides of the vibrating body and a plurality of these magnet rows are arranged in parallel such that magnetic pole faces of alternating polarities face upwards going along the other of the longitudinal or transverse sides of the vibrating body.

Both of the vibrating bodies 120 have the same structure. Namely, coils C11 to C34 wound in a helical shape are positioned in the central portion of a vibrating membrane 26 made from a high polymer film or the like such as polyimide, polyethylene terephthalate, or the like so as to correspond to each of the permanent magnets M11 to M34. Coils C11 to C34 are formed in substantially the same shape as the outer edges of the magnetic pole faces of the permanent magnets M11 to M34. Each coil that corresponds to a magnetic pole face of the same polarity is wound in the same winding direction from the outer periphery of the coil to the inner periphery thereof.

Namely, the coils C11, C14, C31, and C34 that correspond to triangular permanent magnets are wound into triangular shapes, while the coils C12, C13, C21 to C24, C32, and C33 that correspond to quadrangular permanent magnets are wound into quadrangular shapes.

As described above, this type of coil can be formed as a voice coil by press adhering or bonding a thin copper film on the vibrating membrane 26 and by etching the thin copper film so that the planar surface thereof is formed in a coil shape. Instead of press adhering or bonding a thin copper film, it is also possible to form a coil by press adhering or bonding copper foil or by laminating copper plating. Each coil is then covered with an insulating material.

The sheet member 112 may be made from a material having pliability and a degree of porousness such as rock wool, glass wool, non-woven fabric, Japanese paper, or the like. Note that it is also possible to mount the permanent magnets directly to the vibrating body without providing a sheet member.

The placement and connections of the coils are the same as in the first embodiment and therefore a description thereof is omitted here.

As is shown in FIG. 33, the permanent magnet group 114 comprising a plurality of permanent magnets placed in contact with each other, the pair of sheet members 112, and the pair of vibrating bodies 120 formed from the coils and the vibrating membranes form a flat speaker unit by the peripheral edges of the sheet members and the vibrating members being bonded together such that the permanent magnet group is placed in the center. In addition, the coils of the upper vibrating body and the coils of the lower vibrating body are connected together such that the directions of the currents flowing through the coils corresponding to each magnet are reversed in each vibrating body.

Figure 34:
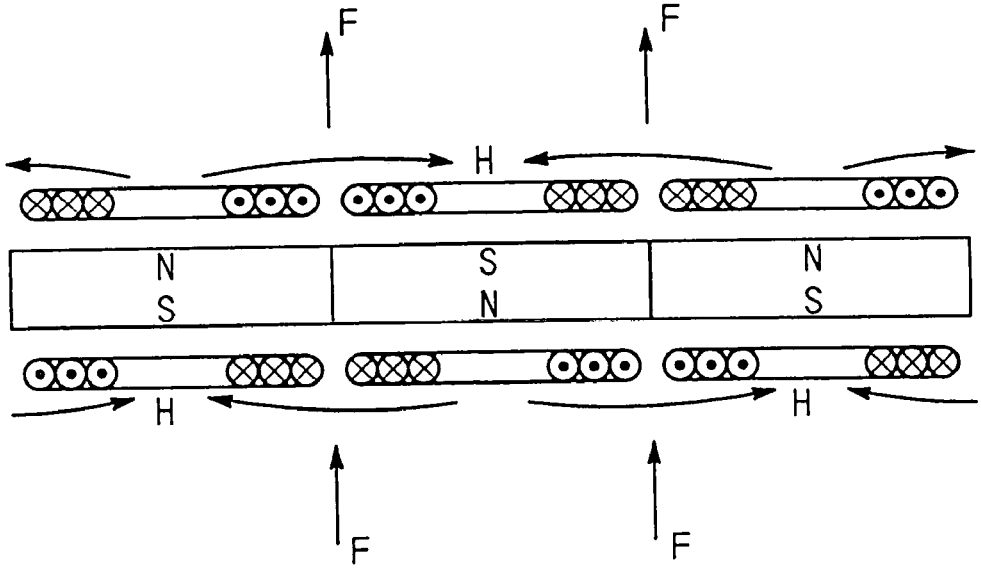
FIG. 34 is a schematic view showing directions of forces acting on the current flowing through coils in the eighth embodiment.

Because the coils have been disposed in the above described way on the vibrating membrane, the magnetic flux interlinks in a direction along the surface of the vibrating membrane in adjacent portions of each coil. Magnetic flux also interlinks in a direction perpendicular to the surface of the vibrating membrane. However, the force from that magnetic flux is small and is cancelled out because it acts in opposite directions in symmetrical coil positions. Accordingly, when current is supplied from one end of a coil group connected in series in a flat speaker unit to the other end, the current flows in the same direction in adjacent coil portions of adjacent coils on the vibrating body, as is shown in FIG. 34. Moreover, the current flowing in the adjacent portions of adjacent coils is affected by unidirectional force F from the magnetic field H in the direction perpendicular to the surface of the vibrating membrane. The result of this is that the vibrating membrane is hardly affected at all by force in a direction along the surface of the vibrating membrane and the pair of vibrating bodies, the pair of sheet members, and the permanent magnet group vibrate as an integral structure in a direction orthogonal to the surface membrane. Therefore, noise components can be greatly reduced and the sound quality improved.

Moreover, in the present embodiment, because a plurality of permanent magnets are disposed in the longitudinal direction of conventional bar magnets, namely, in the row direction of the present embodiment, and a plurality of coils are disposed on the vibrating membrane at positions corresponding to the permanent magnets, the combined length of the outer edge portions of the plurality of permanent magnets is longer than the length of the outer edges of the bar magnets so that the overall length of the coil portions interlinking with the magnetic flux is longer than when bar magnets are used. The result of this is that, compared with when a plurality of rows of bar magnets are provided, it is possible to improve the proportion of the surface area of the vibrating membrane occupied by the coils surrounding each magnet. It is also possible to increase the effective magnetic flux compared to the prior art. As a result, it is possible to improve the efficiency of converting an electrical signal to a sound signal and the sound quality can be improved.

Furthermore, because a combination of different triangular and quadrangular shaped permanent magnets and coils are used for the permanent magnets and coils, the speaker can be formed in shapes different from those of conventional speakers.

Ninth Embodiment

Figure 35:
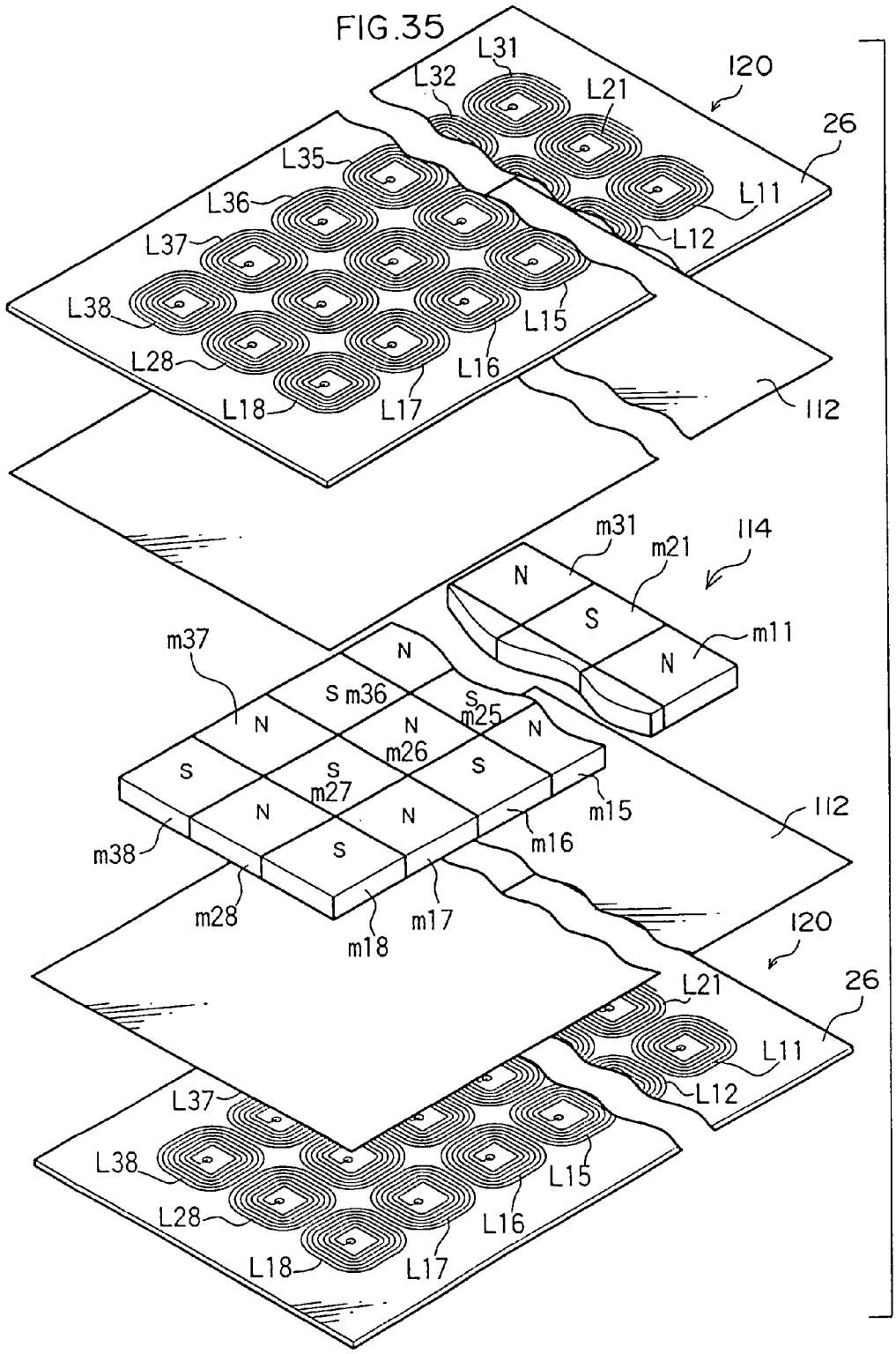
FIG. 35 is an exploded perspective view showing the ninth embodiment of the present invention.

The ninth embodiment of the present invention will now be described with reference made to FIG. 35. In the ninth embodiment, flat, quadrangular permanent magnets m11 to m38 are fixed using an adhesive with sheet members 112 interposed between the magnets and the vibrating body. In addition, the magnet side surfaces are placed in contact with adjacent permanent magnets with no gaps between each magnet such that the upward facing magnetic pole faces of adjacent permanent magnets have different polarities. Namely, permanent magnets mij (wherein when i=1 or 3, then j=1, 3, 5, or 7 and when i=2, then j=2, 4, 6, or 8) are disposed on a vibrating body 120 with a sheet member 112 interposed therebetween at positions corresponding to each coil of the vibrating body 120 such that an N polarity magnetic pole face faces upwards, and permanent magnets mij (wherein when i=1 or 3, then j=2, 4, 6, or 8 and when i=2, then j=1, 3, 5, or 7) are disposed on a vibrating body 120 with a sheet member 112 interposed therebetween at positions corresponding to each coil of the vibrating body 120 such that an S polarity magnetic pole face faces upwards. Note that the permanent magnets may also be disposed with these S and N polarities thereof reversed.

The vibrating membrane 26 forming the vibrating body 120 is formed from a high polymer film or the like such as polyimide, polyethylene terephthalate, or the like, in the same way as in the eighth embodiment. A coil placement portion on which coils are positioned is formed in the central portion of the vibrating membrane 26.

Coil pairs L11 to L38, each comprising a pair of helically shaped coils positioned on both front and rear surfaces of the coil placement portion, are disposed on the coil placement portion of the vibrating membrane 26 at positions corresponding to each of the permanent magnets m11 to m38. Each coil pair L11 to L38 is helically wound in approximately the same shape as the outer edges of each of the permanent magnets m11 to m38. Moreover, each coil is positioned at an area on the vibrating membrane such that the outer periphery of the coils (namely, the outer periphery of the spirals) substantially matches a position corresponding to the outer edge of the magnetic pole face. Moreover, the coils are positioned such that the outer peripheral portions of each coil (namely, the outer peripheral portions of the spirals) do not overlap. Note that because the size of the magnetic flux in predetermined areas of the vibrating body that include those portions corresponding to the centers of each magnetic pole face is small, the weight of the vibrating body can be lightened by not placing coils in those areas.

The connections of the coil pairs L11 to L38 and the coil groups G1 to G6 are the same as is described in FIGS. 12 and 13.

Figure 36:
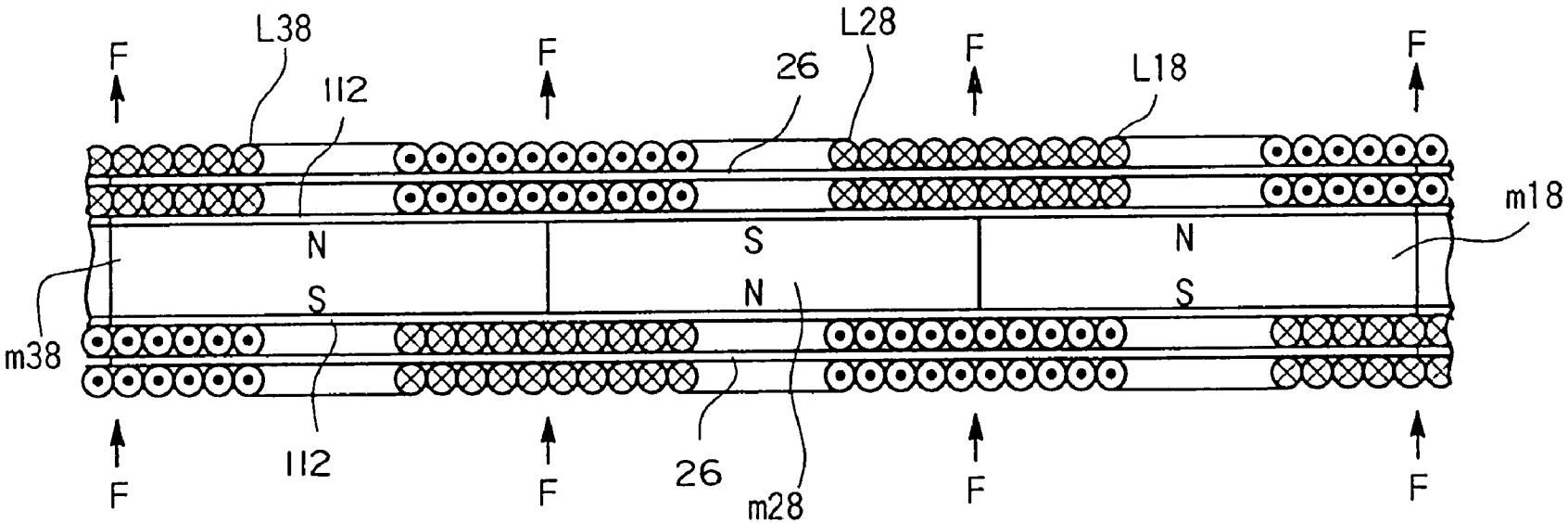
FIG. 36 is a cross-sectional view taken along a plane passing through the permanent magnets m18 to m38 of the above ninth embodiment.

The plurality of permanent magnets are disposed at the lower vibrating body 120 with the lower sheet member interposed in between, and the upper vibrating body 120 is mounted to the plurality of permanent magnets with the upper sheet member 112 interposed in between. At this time, as is shown in FIG. 36, the coil groups of the upper vibrating body are mounted so as to correspond to each of the permanent magnets, as are the coil groups of the lower vibrating body. The peripheral edges of the sheet members and the vibrating membranes are then bonded together with the plurality of permanent magnets sandwiched between the vibrating bodies. In this way, a flat speaker unit is assembled.

Note that, in the above description, an example was described of when the permanent magnets were mounted to a vibrating body with a sheet member interposed between each. However, it is also possible to sandwich the plurality of permanent magnets between vibrating bodies by mounting the peripheral edges of the sheet members and vibrating membranes together without mounting the permanent magnets to the vibrating body.

FIG. 36 is a schematic cross-sectional view showing an enlargement of the coil diameters of the flat speaker unit assembled in the above manner. Adjacent permanent magnets m18 and m28, and adjacent permanent magnets m28 and m38 are placed so that side faces of adjacent permanent magnets are in contact with each other with no gaps in between. The polarity of upper magnetic pole faces of adjacent magnets alternates for each of the adjacent magnets in the upwards direction as does the polarity of lower magnetic pole faces in the downwards direction. Therefore, the magnetic flux generated from each permanent magnet travels from the N polarity magnetic pole face to the S polarity magnetic pole face. Moreover, the magnetic flux in the area between adjacent permanent magnets travels in a direction substantially parallel to the surface of the vibrating membrane and is at the maximum, in particular, above and below those portions where the permanent magnets are in contact with each other.

Because coil pairs L18, L28, and L38 are placed on the front and rear surfaces of the upper and lower vibrating membranes 26, magnetic flux traveling in a direction substantially parallel to the surface of the vibrating membrane interlinks in each coil. When current I is supplied to the coils in the direction shown in FIG. 13, then, as is shown in FIG. 36, the current flows in the same direction in adjacent coil portions extending from the inner peripheries to the outer peripheries of adjacent coils. Moreover, all of the coils are affected by a unidirectional force F acting in a direction perpendicular to the surface of the vibrating membranes so that the upper and lower vibrating membranes together with the sheet members and permanent magnets are displaced simultaneously in a direction perpendicular to the membrane surface. Consequently, by feeding an electrical signal representing the sound to be generated to a coil, the vibrating membranes, the sheet members, and the plurality of permanent magnets vibrate as an integrated whole in accordance with this electrical signal and a sound signal is able to be generated.

The flat speaker unit of the above eighth and ninth embodiments can output an even louder sound if it is adhered to a member capable of vibrating formed by a non-magnetic body such as a box housing, a board, or the like. The member capable of vibrating formed by a non-magnetic body such as a box housing, board, or the like can be formed from wood, corrugated fiberboard, polystyrene foam, plastic, glass, aluminum, plywood, honeycomb board, FRP, and the like. Further, because coils are provided on both surfaces of the permanent magnets, sound can be output from both surfaces of the flat speaker unit. It is preferable that the member that is capable of vibrating is larger than the flat speaker unit in order to increase the resonance effect.

In the above eighth and ninth embodiments, examples were described in which a plurality of permanent magnets were sandwiched between vibrating bodies. However, one vibrating body or one vibrating body and one sheet member may be omitted. Alternatively, instead of the vibrating body and sheet member, a sandwiching member such as an iron plate or the like may be used. Moreover, in the examples described above, the pair of vibrating bodies were vibrated in the same direction, but it is also possible to reverse the direction of the flow of the current from that described above in one vibrating body so that the pair of vibrating bodies vibrate in opposite directions to each other.

In the coils of the above eighth and ninth embodiments, the impedance of the speaker can be set to a predetermined value by connecting coils to each other in series or in parallel or by connecting coils to each other in a combination of serial and parallel connections. By connecting the coils freely in this way, it is possible to group voice coils together and vibrate each group as an integrated whole.

Figure 37:
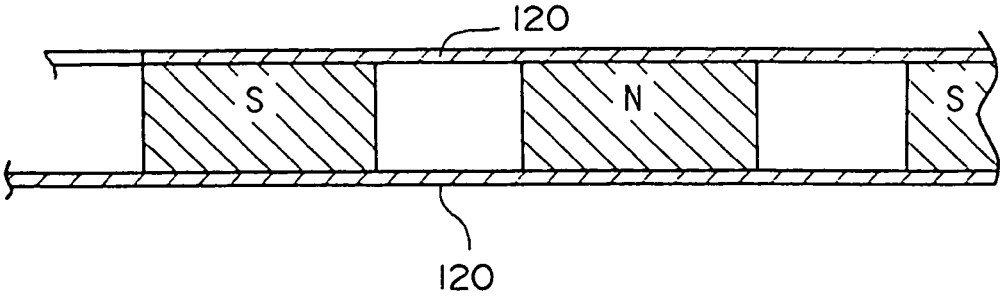
FIG. 37 is a cross-sectional view showing a variant example when permanent magnets are positioned with a predetermined spacing between each magnet.

Note that, in the above eighth and ninth embodiments, examples were described of when each of the permanent magnets was positioned in contact with other permanent magnets, however, it is also possible to position each permanent magnet adjacent to (i.e. a slight distance from) other permanent magnets, or, as is shown in FIG. 37, to position each permanent magnet a predetermined distance apart from other permanent magnets. When flat, square magnets are used, it is preferable if the gap between magnets is not more than approximately one third of the permanent magnet width. It is also possible to use a combination of permanent magnets which are in contact with other magnets and permanent magnets which are a slight distance away from other magnets or permanent magnets which are a predetermined distance away from other magnets.

Moreover, in each of the above eighth and ninth embodiments, descriptions were given of speakers which output sound when current is fed to a coil, however, if induction current is supplied to a coil and a vibrating membrane is vibrated according to Fleming's right-hand law, the speakers can also be used as microphones.

Figure 38:
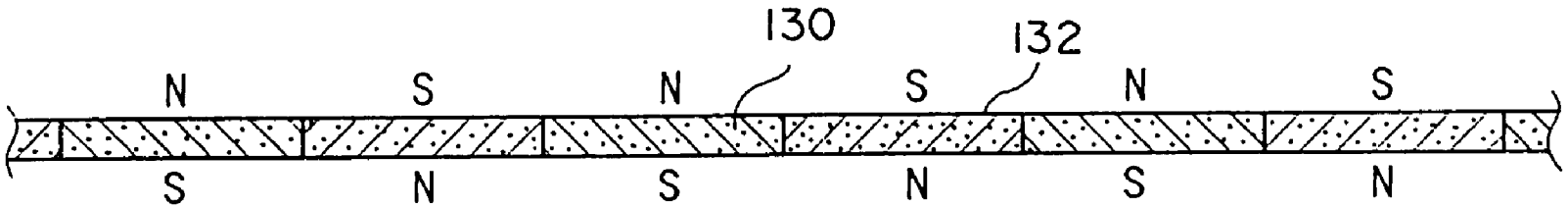
FIG. 38 is a cross-sectional view showing a variant example of a group of permanent magnets.

Further, in the example described above, a plurality of permanent magnets were each independently positioned, however, as is shown in FIG. 38, it is also possible to knead a magnetic powder 130 into a plastic or rubber to form a plate-shaped member 132. A plurality of permanent magnets placed in contact with each other, adjacent to each other, or a predetermined distance apart from each other are then formed by local polarization by magnetizing the magnetic powder of predetermined areas of the plate-shaped member 132 in alternating S and N polarities. It is also possible to perform local polarization on a plate-shaped member made from a magnetic material such as iron or the like so as to form a base in which the S and N polarities are arranged in a matrix pattern. In cases such as these, production is simplified because there is no need to position each of the plurality of permanent magnets independently.

As was described above, according to the present embodiment, because a first magnet and second magnet are mounted to a vibrating body or a first magnet and second magnet are sandwiched between a pair of vibrating bodies, the affect is achieved that the thickness of the flat acoustic conversion device itself can be made still thinner.

Moreover, because magnetic flux travels in a direction substantially parallel to the vibrating membrane surface and the magnetic flux traveling in a direction substantially parallel to the vibrating membrane surface interlinks in the first coil and second coil, when current is supplied to the first and second coil, the direction of the force which the current receives from the magnetic field is substantially perpendicular to the surface of the vibrating membrane. Force in a direction along the surface of the vibrating membrane is extremely small so that the effect is obtained that noise components can be reduced and the sound quality can be improved.

Moreover, if a plurality of first magnets and a plurality of second magnets are positioned in a matrix pattern either a predetermined distance apart from each other or in contact with each other, more magnets can be provided than when bar magnets are arranged in parallel and the number of coils can also be made to match the number of magnets or can be made a multiple of the number of magnets. Therefore, the effect is obtained that the total length of that portion of the coils which interlinks with the magnetic flux can be lengthened and the proportion of the surface of the vibrating membrane occupied by the coils can be increased, thus improving the sound conversion efficiency and further improving the sound quality.

Tenth Embodiment

Figure 39:
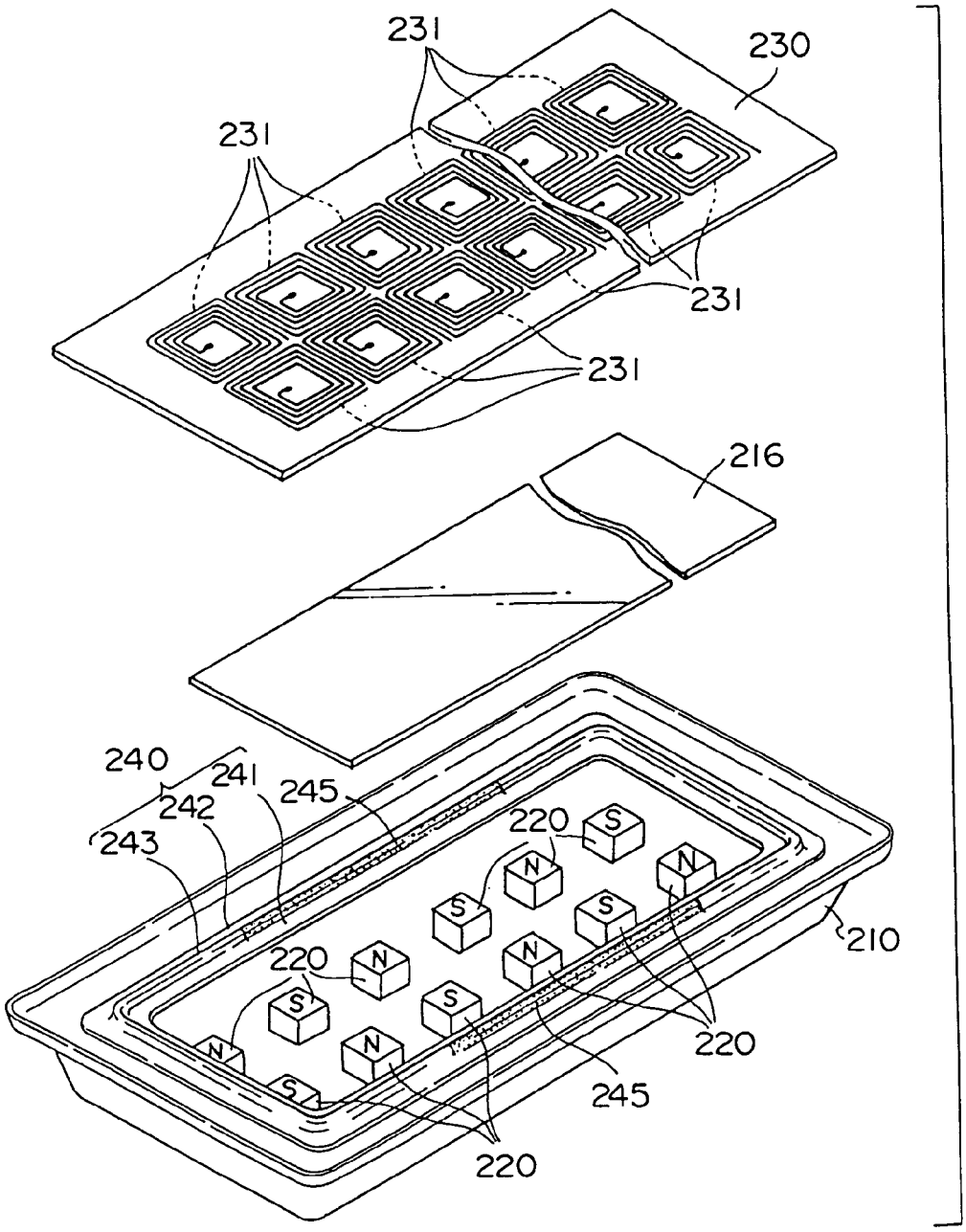
FIG. 39 is an exploded view of a flat speaker unit according to the embodiments of the present invention.

The tenth embodiment of the present invention will now be described. As is shown in FIG. 39, in this embodiment there is provided a frame 210 formed in a box shape, a vibrating membrane 230 for generating external sound through vibration, and an edge 240 by which the vibrating membrane is mounted on the frame 210.

Figure 40:
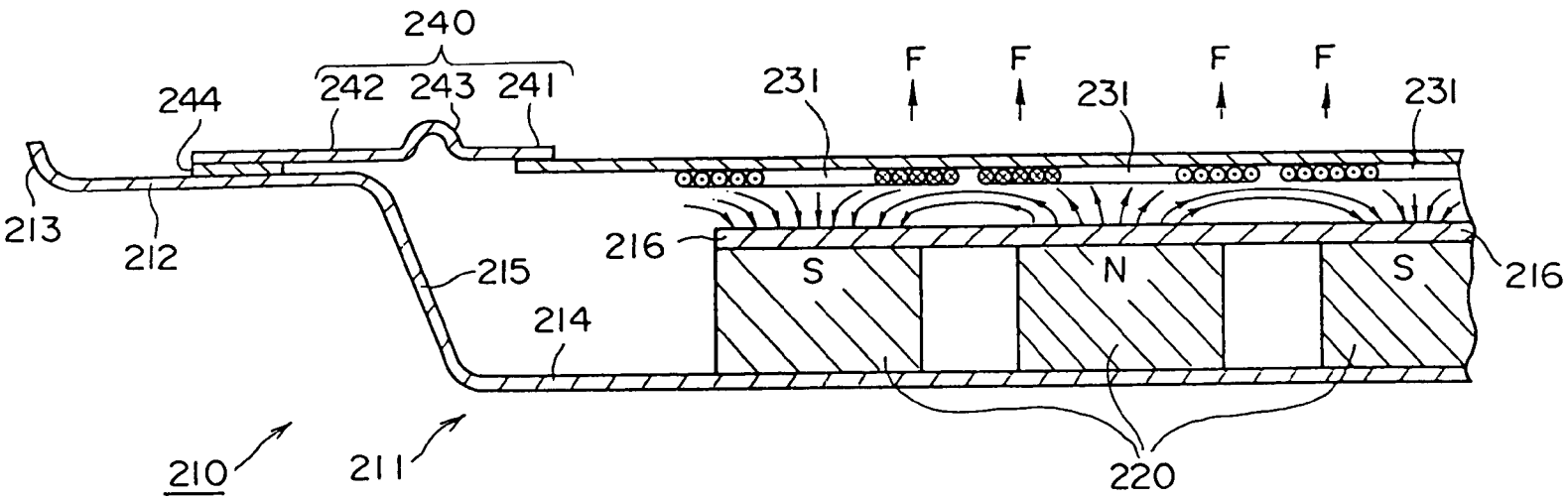
FIG. 40 is a cross-sectional view showing the main portions of the tenth embodiment of the present invention.

As is shown in FIG. 40, the frame 210 is provided with a concave portion 211 on which are placed a plurality of permanent magnets 220, a mounting face 212 which is parallel with the bottom surface of the concave portion 211 and is provided so as to close off the open end of the concave portion 211 from the open end of the concave portion 211, and an upright wall 213 provided at the outer edge of the mounting face 212 extending in a vertical direction from that surface.

The concave portion 211 comprises a base 214 which is the bottom surface of the concave portion 211 and on which are placed permanent magnets 220, and a peripheral wall 215 surrounding the base 214.

A plurality of permanent magnets 220 formed in a substantially rectangular parallelepiped shape are arranged in a matrix pattern a predetermined distance apart from each other on the base 214. Specifically, as was described in the first to ninth embodiments, each permanent magnet 220 is positioned on the base 214 such that the polarity facing the vibrating membrane of a permanent magnet 220 is different from the polarity facing the vibrating membrane of permanent magnets 220 adjacent to that magnet.

The magnetic flux exiting from the N pole of the permanent magnets 220 in the vicinity of the peripheral wall 215 passes through the peripheral wall 215 to reach the S pole. Because the peripheral wall 215 enclosing the permanent magnets 220 is provided in this manner, there is no leakage of magnetic flux to the outside and the magnetic flux can also be made to interlink at the helical coils 231 at the ends of the vibrating membrane 231. Note that NdFeB based magnets and neodymium based magnets are used for the permanent magnets 220.

A single sheet of a sheet member 216 formed from a non-magnetic material is adhered to the surface of the permanent magnets 220 facing the vibrating membrane 230. Accordingly, the base 214 is covered by the sheet member 216 with the permanent magnets 220 sandwiched between the two. The sheet member 216 may be made from a material having pliability and a degree of porousness such as rock wool, glass wool, non-woven fabric, Japanese paper, or the like. An air layer of a predetermined thickness is thus formed between the sheet member 216 and the vibrating membrane 230. The thickness of the air layer is preferably such that the vibrating membrane 230 comes into slight contact with the sheet member 216 when the vibrating membrane 230 is vibrating at maximum amplitude.

A plurality of helical coils 231 each wound in a helical shape are disposed on one surface of the vibrating membrane 230. When the vibrating membrane 230 is mounted on the frame 210, the center of each helical coil 231 is positioned substantially above the central axis of one of each of the permanent magnets 220. Moreover, each helical coil 231 is positioned so as not to overlap with adjacent helical coils 231.

The helical coils 231 are wound in a shape substantially the same as the outer edge of the surface of the permanent magnet 220 which it faces. Namely, the helical coils 231 are wound in a substantially square shape corresponding to the rectangular parallelepiped shape of the magnetic pole faces of the permanent magnets 220. Each helical coil 231 facing a permanent magnet 220 of the same polarity is wound in the same winding direction. When the polarity of the permanent magnet 220 is different, the winding direction of the helical coil 231 is also different. For example, when the helical coil 231 is positioned above a permanent magnet 220 whose N polarity faces upwards, the coil is wound in a right-hand direction from the outer periphery towards the inner periphery thereof. If the helical coil 231 is positioned above a permanent magnet 220 whose S polarity faces upwards, the coil is wound in a left-hand direction from the outer periphery towards the inner periphery thereof.

As a result, when current is supplied to each helical coil 231, as is shown in FIG. 40, the direction of the current in outer peripheral portions of adjacent coils is the same. Moreover, adjacent outer peripheral portions of the helical coils 231 pass through the center of the large magnetic flux described above. Therefore, by connecting the helical coils 231 in series or in parallel, or in a combination of serial and parallel connections, the direct current resistance value can be set to a predetermined value.

This type of helical coil 231 can be formed by depositing a thin copper film on the vibrating membrane 230 and etching the thin copper film so that it forms a coil shape. Instead of depositing a thin copper film, a copper film may be press adhered or bonded. Instead of etching a conductive copper film, copper plating may be laminated in a coil shape. Each helical coil 231 is then covered with an insulating material.

Note that the vibrating membrane 230 is formed from a high polymer film or the like such as polyimide, polyethylene terephthalate, or the like. The portion of the vibrating membrane 230 where the helical coils 231 are placed is given increased hardness through a coating of ceramic or resist (e.g., epoxy based).

As is shown in FIG. 39, the edges 240 are formed in a frame shape. Specifically, the internal peripheral portion 241 of the edge 240 is the same shape as the outer edge of the vibrating membrane 230 and is formed slightly smaller than the outer periphery of the vibrating membrane 230. The outer peripheral portion 242 of the edge 240 is larger than the outer edge of the top end of the concave portion 211, but smaller than the outer edge of the mounting face 212. As is shown in FIG. 40, a curved portion 243 is formed between the inner peripheral portion 241 and the outer peripheral portion 242. The curved portion 243 is formed from urethane foam, synthetic rubber, or the like and is curved so as to have a semicircular, arc-shaped cross section curving upwards in a vertical direction from the surface of the vibrating membrane 230. Note that, in this example, the curved portion 243 is formed in a substantially semicircular, arc shape, but may also be formed in a peak shape, as a continuous series of peak shapes, or in some other shape.

The inner peripheral portion 241 of the edge 240 is fixed to the outer edge portion of the top surface of the vibrating membrane 230. The outer peripheral portion 242 of the edge 240 is fixed to the periphery of the top end of the concave portion 211 by being fixed from the top face of the mounting face 212 with a spacer 244 sandwiched in between. At this time, the vibrating membrane 230 is fixed to the edge 240 while a predetermined tension is applied to the vibrating membrane 230.

The curved portion 243 of the edge 240 is provided with a hardened portion 245 extending across a predetermined area of the longitudinal sides so that there is no sagging of the curved portion 243 due to the load of the vibrating membrane 243. The hardened portion 245 has a higher modulus of elasticity than the other portions of the curved portion 243. Accordingly, the amount of deformation of the hardened portion 245 due to external forces is less than that of other portions.

When the edge 240 is made from urethane foam, for example, it is manufactured in the following manner. Note that, as is shown in FIG. 41A, a description is given below of the formation of a hardened portion in elongated, plate-shaped urethane foam 246.

Figure 41A:
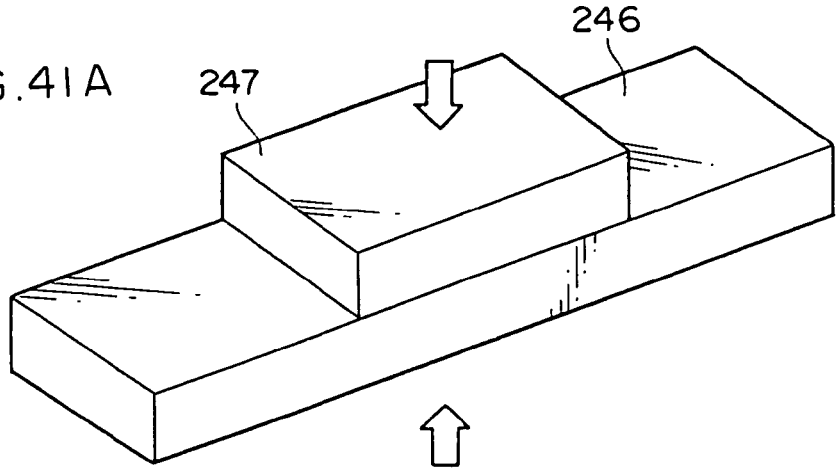
FIGS. 41A to 41C are views explaining a method of producing the edge of the tenth embodiment.
Figure 41B:
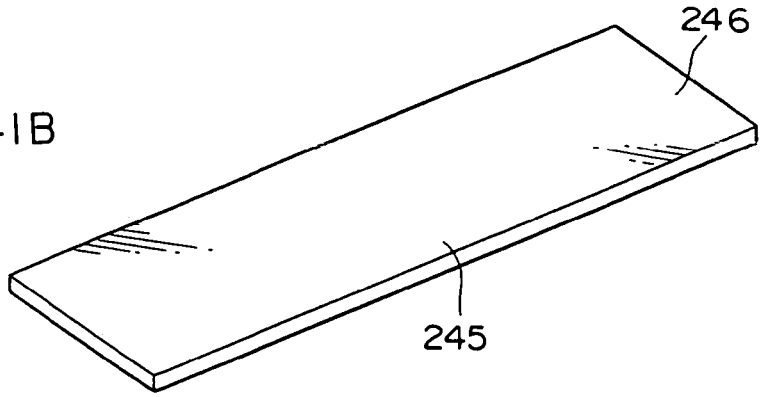

Firstly, as is shown in FIG. 41A, one piece or plural pieces of urethane foam 247 for a hardened portion is superposed on the central portion of the plate-shaped urethane foam 246 (i.e. the portion used to form the hardened portion). Next, the plate-shaped urethane foam 246 and the piece of urethane foam 247 for a hardened portion are compressed. After further compression, as is shown in FIG. 41B, the plate-shaped urethane foam 246 becomes a predetermined thickness. As a result, the density of the central portion of the plate-shaped foam urethane 246 is higher than the other portions creating a hardened portion 245.

Figure 41C:
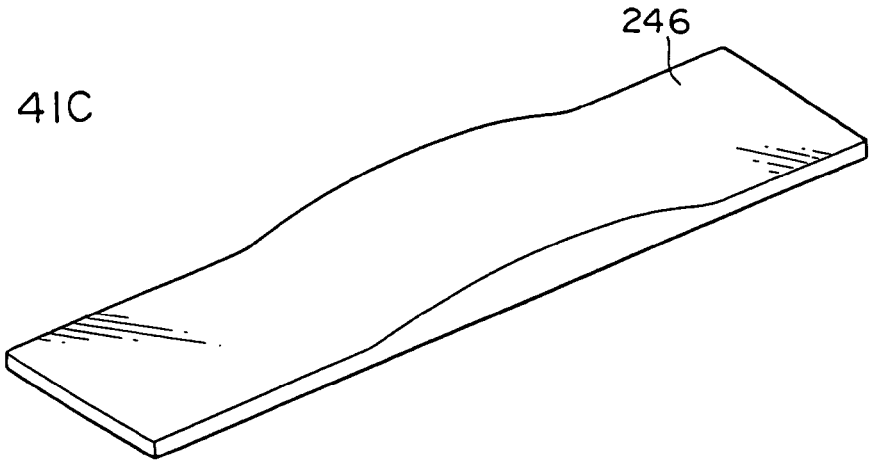

Note that, if synthetic rubber is used, it is not possible to increase the density of only one portion of the synthetic rubber. Therefore, as is shown in FIG. 41C, the central portion of the plate-shaped synthetic rubber foam 248 (i.e. the portion used to form the hardened portion) may be formed to have a greater thickness.

Even when the vibrating membrane 230 is mounted on the edge 240 having the curved portion 243 in which the hardened portion 245 is formed as described above, the curved portion 243 can thus be prevented from sagging due to the weight of the vibrating membrane. As a result, when the vibrating membrane 230 is mounted on the edge 240, the vibrating membrane 230 can be kept parallel to the surface of the sheet member 216 covering the surface of the side of the permanent magnets 220 which the vibrating membrane 230 faces.

When current for a sound signal is supplied to the helical coils 231 of a flat speaker unit having this structure, the direction of the current flowing through each helical coil 231 is as shown in FIG. 40. Namely, the direction of the current in adjacent outer peripheral portions of adjacent helical coils 231 is the same. At this time, according to Fleming's right-hand law, a force F is generated which is equal in an upward direction in each helical coil 231. As a result, the vibrating membrane 230 is displaced in a direction perpendicular to the surface thereof thereby generating sound.

At this time, the vibrating membrane 230 is displaced in a direction perpendicular to the surface thereof from a state of being parallel to the surface of the sheet member 216 covering one surface of the facing permanent magnets 220. The result of this is that, regardless of which location of the vibrating membrane 230 is taken as the starting point, the phase from the vibrating membrane 230 to the sheet member 216 can be made the same and a flat wave generated.

Thus, in the present embodiment, because the central portion of the edge 240 was thickened and the density thereof increased so as to form a hardened portion 245, it is possible to make the phase from the vibrating membrane 230 to the sheet member 216 always the same. As a result, there is no twisting of the vibrating membrane 230 due to the sound distribution of a phase difference between the vibrating membrane 230 and the sheet member 216, and sound of a high quality with no noise components can be output.

Furthermore, in the present embodiment, because the magnetic pole faces of the permanent magnets 220 which have a high density are covered by the sheet member 216, reflected sound from the sheet member 216 is reduced, and noise generated by this reflected sound can be suppressed. Moreover, because the flat speaker unit has an air layer interposed between the vibrating membrane 203 and the sheet member 216, the phase of the sound reflected from the sheet member 216 is made the same and twisting of the vibrating membrane 230 is prevented. Thus it is possible to output sound of a high quality.

Figure 42:
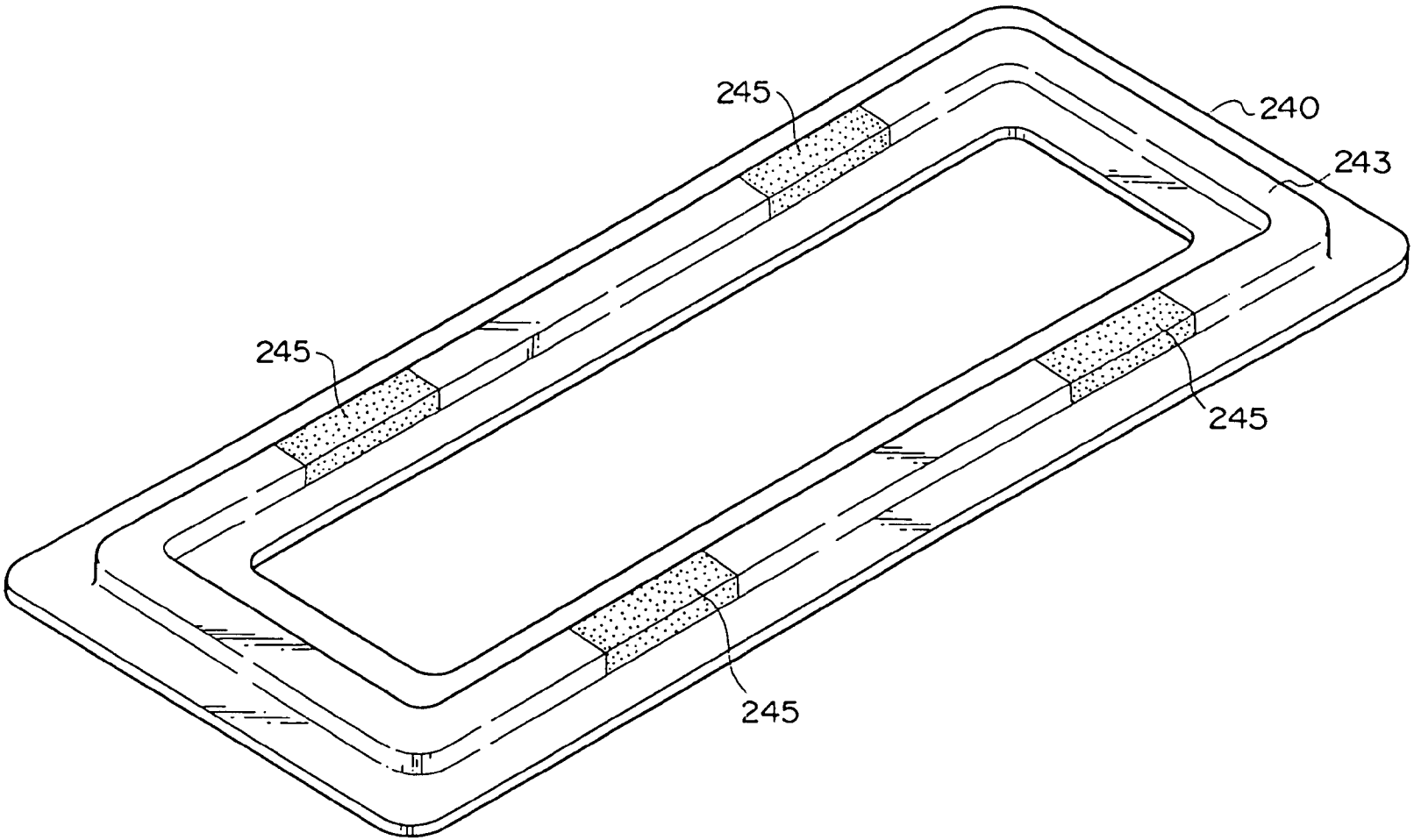
FIG. 42 is a perspective view showing another example of an edge.
Figure 43:
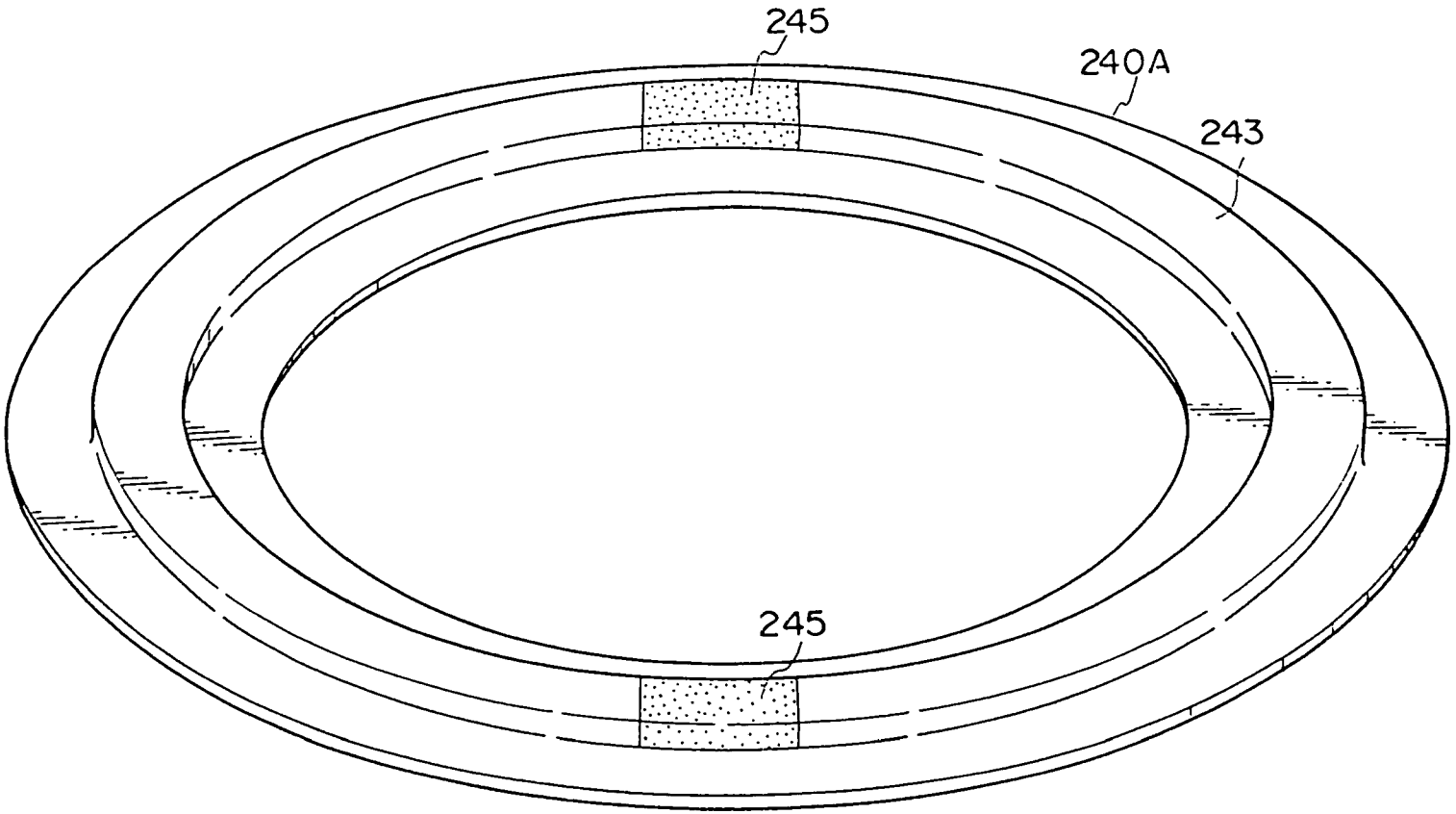
FIG. 43 is a perspective view showing yet a further example of an edge.

Note that the hardened portion 245 of the edge 240 does not have to be formed in only one location in the central portion of the longitudinal sides thereof, but, as is shown in FIG. 42, may be formed in several locations. Furthermore, as is shown in FIG. 43, instead of a frame-shaped edge 240, an edge 240A, which is formed in an oval shape and whose outer periphery and inner periphery are similar, may also be provided. At this time, a plurality of hardened portions 245 may be provided.

Figure 44:
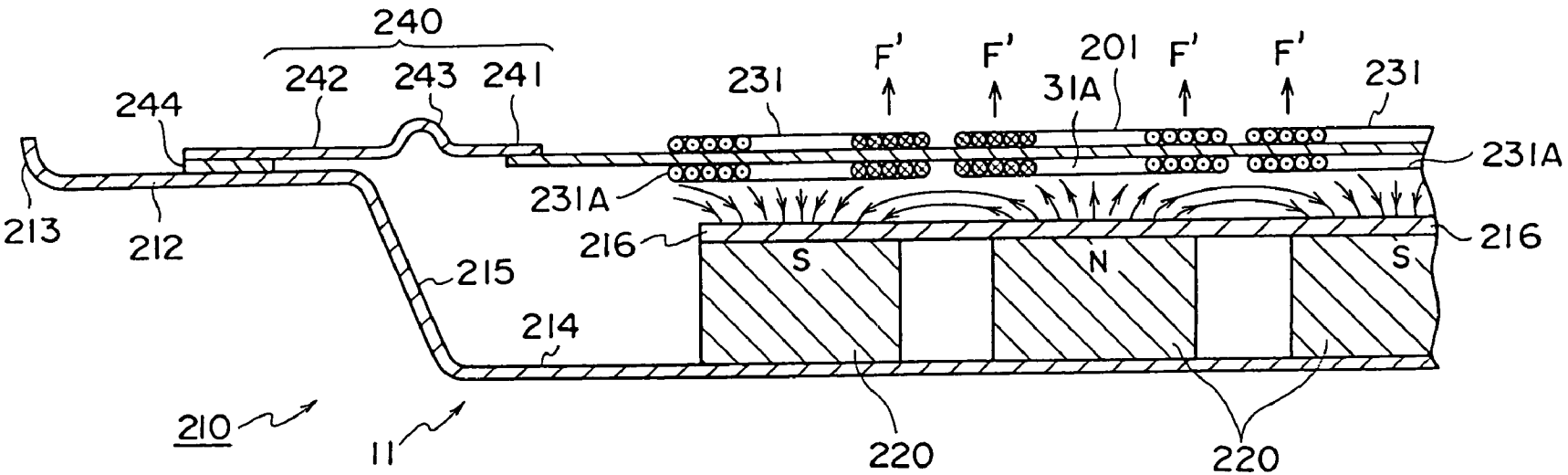
FIG. 44 is a cross-sectional view showing another example of a vibrating membrane.

Instead of the vibrating membrane 230, as is shown in FIG. 44, it is possible to use a vibrating membrane 230A which has helical coils 231 and 231A placed on the front and rear thereof. Specifically, helical coils 231 are provided on the upper surface of the vibrating membrane 230A, while helical coils 231A are provided on the lower surface of the vibrating membrane 230A. The helical coils 231A are wound and positioned on the vibrating membrane 230A such that the direction of the current in the outer peripheral portions of each helical coil 231A is the same as the direction of the current in the outer peripheral portions of the opposite helical coil 231 on the upper surface of the vibrating member 230A.

As a result, when current is supplied to the helical coils 231 and 231A, in accordance with Fleming's left-hand law, a force F' (>F) acts on the vibrating membrane 230A and the sound output can be increased.

Furthermore, in the above described embodiment, each permanent magnet 220 was placed on the mounting face 212 with a predetermined distance between each magnet, however, the embodiment is not limited to this. For example, it is also possible to slightly increase the size of the permanent magnets 220 and place the magnets on the mounting surface 212 with no gap between magnets.

In the above embodiment, an example was described in which magnetic pole faces of the permanent magnets 220 were covered with a sheet member 216, however, it is also possible to use a non-magnetic member such as plate-shaped plastic or the like instead of the sheet member 216 so that the magnetic pole faces of the permanent magnets 220 and the surfaces between magnetic poles are the same surface.

Note that, in the above embodiment, a description was given of a flat speaker which outputs sound when current is fed to the helical coil 231, however, if induction current is supplied to the helical coil 231 and the vibrating membrane 230 is vibrated according to Fleming's right-hand law, the speaker can also be used as a microphone.

By providing the speaker edge according to the present embodiment with a curved portion comprising an elastic member having a curved portion between an outer peripheral portion and an inner peripheral portion thereof and by providing a high elastic modulus portion having a higher modulus of elasticity than that of the surrounding portions in at least one portion in the longitudinal direction of the curved portion, the amount of deformation of the high elastic modulus portion from external force can be reduced and, regardless of the size of the vibrating membrane, the vibrating membrane can be supported without causing any sagging thereof. As a result, the vibrating membrane outputs a flat wave with no phase difference and a high quality sound can be output.

By providing a speaker edge in the flat speaker unit according to the present embodiment with a curved portion comprising an elastic member having a curved portion between an outer peripheral portion and an inner peripheral portion thereof and by reducing the amount of deformation from external force in at least one portion in the longitudinal direction of the curved portion, it is possible to make the vibrating membrane and the base substantially parallel at all times even if the vibrating membrane is large or has an elongated shape. The result of this is that, because it becomes possible to support the vibrating membrane without causing any sagging thereof, a flat wave having no phase difference can be output and a high quality sound can be output.

The edge described in the present embodiment can also be suitable applied to the above seventh embodiment.

In each of the above-described embodiments, examples using the vibrating membrane are described. However, instead of the vibrating membrane, a vibrating plate formed of a plate made of aluminum, a phenol resin-impregnated paper, or the like may be used. Further, in the above-described embodiments, when the permanent magnets are disposed so as to contact one another, it is preferable for holes, which allow the passage of sound, to be formed at the portions at which the corner portions of the four permanent magnets contact one another.

Eleventh Embodiment

Figure 45:
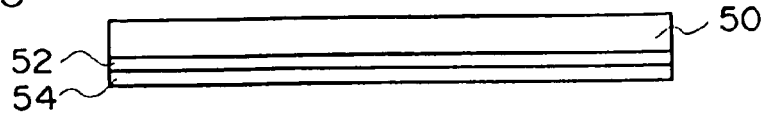
FIG. 45 is a cross-sectional view of the eleventh embodiment of the present invention.

The eleventh embodiment of the present invention will now be described. As is shown in FIG. 45, the flat speaker unit of the present embodiment is constructed from a first base 50 comprising a rectangular, plate-shaped member made from a magnetic material, a non-magnetic sheet member 52 having pliability and a degree of porousness, such as rock wool, glass wool, non-woven fabric, Japanese paper, or the like, and a second base 54 on which conductors are provided. The sheet member 52 is interposed between the first base 50 and the second base 54, and the first base 50, the sheet member 52, and the second base 54 are mounted together integrally.

Figure 46:
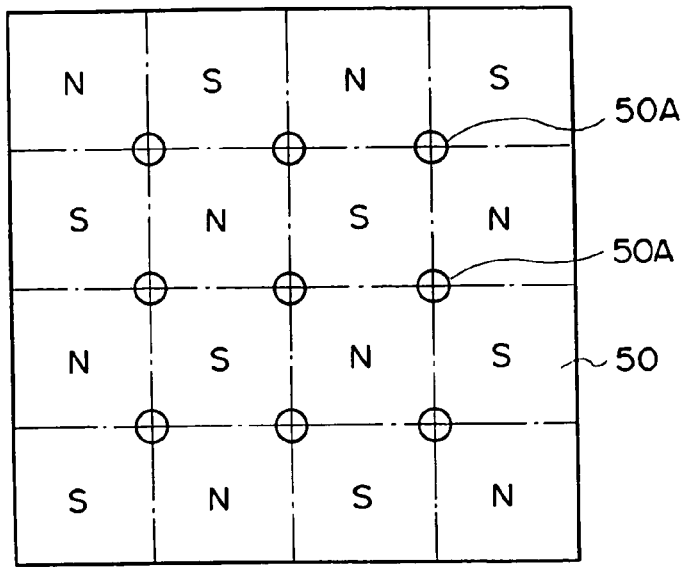
FIG. 46 is a plan view of a first base of the eleventh embodiment.

As is shown in FIG. 46, S polarity magnetic pole faces and N polarity magnetic pole faces are arranged in a matrix pattern so as to alternatingly face upwards by local magnetization. A circular hole 50A is punched at each position where four magnetic pole faces come in contact.

Figure 47:
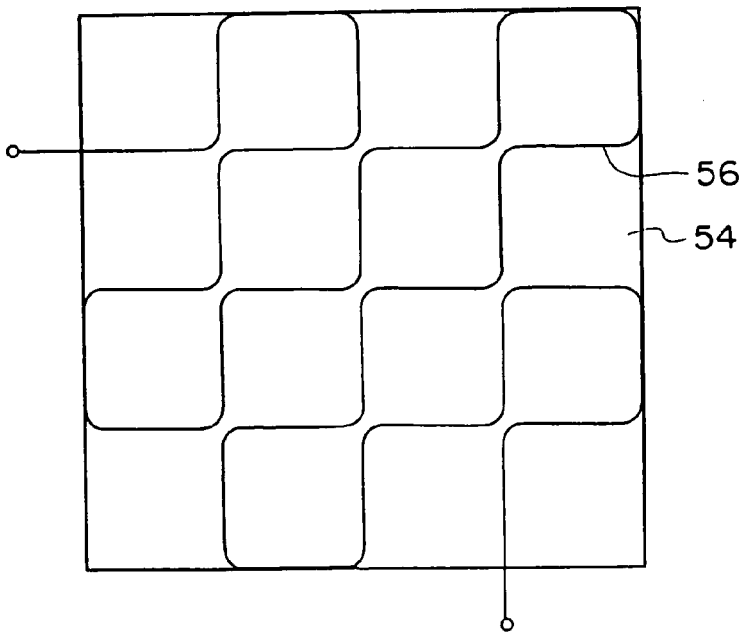
FIG. 47 is a plan view of a second base provided with conducting wires of the eleventh embodiment.

In addition to the pliable sheet made from a non-magnetic material such as that used for the above described vibrating membrane, a lightweight, hard board such as a balsa material or the like can be used for the second base 54. In addition to the coils formed in a helical shape which were used in each of the above embodiments, as is shown in FIG. 47, the conducting members provided on the second base can be formed from conducting wires 56 provided at positions where the magnetic flux interlinks, namely, along positions corresponding to the boundaries of adjacent magnetic pole faces. These conducting wires are formed from either one or a plurality of conductors and are positioned such that the direction of the current flow and the direction in which the magnetic flux interlinks are the same on the second base. Therefore, magnetic flux substantially parallel to the main surface of the first base interlinks in the conducting wires.

Because the direction of the current flow and the direction in which the magnetic flux interlinks are the same, when current is supplied to the conducting wires in which magnetic flux is interlinking, the current flowing through the conducting wires is affected by force from the magnetic flux in the same direction. Therefore, the first base 50, the sheet member 52, and the second base 54 vibrate together integrally and a flat wave with no phase difference is output from the speaker unit of the present embodiment.

By adhering the surface of the second base of this speaker unit that does not face the first base to a member capable of vibrating made from a non-magnetic material larger than the second base, the member capable of vibrating resonates and a high output sound can be generated. A box housing, board, snow board, or calender constructed from wood, corrugated fiberboard, polystyrene foam, plastic, aluminum, FRP, plywood or the like can be used for the member capable of vibrating. Further, the member capable of vibrating, of the speaker unit, may be mounted to a member larger than the member capable of vibrating, such as a ceiling, a floor, a wall, a unit-bathroom, a show window, or the like.

What is claimed is:

1. A flat acoustic conversion device comprising:

a first magnet disposed so that a first magnetic pole face is substantially parallel to a predetermined surface;

a second magnet disposed at a predetermined distance apart from the first magnet such that a second magnetic pole face having a polarity different from the polarity of the first magnetic pole face is substantially parallel to the predetermined surface and faces towards the same side as the first magnetic pole face of the first magnet;

a vibrating member disposed so as to face towards the first magnetic pole face and the second magnetic pole face;

a first coil which is helically wound and is disposed such that an outer periphery and an inner periphery of a winding of the first coil are positioned substantially within an outer peripheral edge of the first magnetic pole face so as to sandwich a portion of the vibrating member, which corresponds to the outer peripheral edge of the first magnetic pole face, therebetween; and a second coil which is helically wound and is disposed such that an outer periphery and an inner periphery of a winding of the second coil are positioned substantially within an outer peripheral edge of the second magnetic pole face so as to sandwich a portion of the vibrating member, which corresponds to the outer peripheral edge of the second magnetic pole face, therebetween.

2. The flat acoustic conversion device according to claim 1, wherein current flows in the same direction in a portion of the first coil which is adjacent to the second coil and in a portion of the second coil which is adjacent to the first coil.

3. The flat acoustic conversion device according to claim 1, wherein when the coil winding directions from the outer periphery to the inner periphery of the first and second coils are the same, either the inner peripheries of the first and second coils are connected to each other, or the outer peripheries of the first and second coils are connected to each other.

4. The flat acoustic conversion device according to claim 1, wherein when the coil winding directions from the outer periphery to the inner periphery of the first and second coils are different from each other, either the inner periphery of one of the first and second coils is connected to the outer periphery of the other of the first and second coils, or the inner peripheries of both the first and second coils are connected to each other and the outer peripheries of both the first and second coils are connected to each other.

5. The flat acoustic conversion device according to claim 1, further comprising a pliable air layer forming member disposed so as to form together with the vibrating member an air layer of a predetermined thickness on the first magnetic pole face and the second magnetic pole face sides of the vibrating member.

6. A flat acoustic conversion device comprising:

a first magnet disposed so that a first magnetic pole face is substantially parallel to a predetermined surface;

a second magnet disposed at a predetermined distance from the first magnet such that a second magnetic pole face having a polarity that is different from the polarity of the first magnetic pole face is substantially parallel to the predetermined surface and faces toward a same side as the first magnetic pole face of the first magnet;

a vibrating member disposed so as to face toward the first magnetic pole face and the second magnetic pole face;

a first coil which is a helical shape and is disposed such that an outer periphery and an inner periphery of a winding of the first coil are positioned substantially within an outer peripheral edge of the first magnetic pole face so as to sandwich a portion of the vibrating member, which corresponds to the outer peripheral edge of the first magnetic pole face, therebetween;

a second coil which is a helical shape and is disposed such that an outer periphery and an inner periphery of a winding of the second coil are positioned substantially within an outer peripheral edge of the first magnetic pole face so as to sandwich a portion of the vibrating member, which corresponds to the outer peripheral edge of the first magnetic pole face, therebetween;

a third coil which is formed in a helical shape and is wound in a same direction as the second coil, and which is disposed such that an outer periphery and an inner periphery of a winding of the third coil are positioned substantially within an outer peripheral edge of the second magnetic pole face so as to sandwich a portion of the vibrating member, which corresponds to the outer peripheral edge of the second magnetic pole face, therebetween and whose outer peripheral end is connected to an outer peripheral end of the second coil; and a fourth coil which is formed in a helical shape and is wound in a same direction as the second coil, and which is disposed such that an outer periphery and an inner periphery of a winding of the fourth coil are positioned substantially within an outer peripheral edge of the second magnetic pole face so as to sandwich a portion of the vibrating member, which corresponds to the outer peripheral edge of the second magnetic pole face, therebetween and which is provided at a position on the vibrating member to overlap with the third coil, and whose inner peripheral end is connected to an inner peripheral end of the third coil.

7. The flat acoustic conversion device according to claim 6, further comprising a pliable air layer forming member disposed so as to form together with the vibrating member an air layer of a predetermined thickness on the first magnetic pole face side and the second magnetic pole face side of the vibrating member.

8. The flat acoustic conversion device according to claim 6, wherein the first coil is provided on a first surface of the vibrating member and the second coil is provided on a second surface of the vibrating member and the inner peripheral end of the second coil passes through the vibrating member and connects with the inner peripheral end of the first coil, and the third coil is provided on the second surface of the vibrating member and the fourth coil is provided on the first surface of the vibrating member and the inner peripheral end of the fourth coil passes through the vibrating member and connects with the inner peripheral end of the third coil.

9. The flat acoustic conversion device according to claim 6, wherein a plurality of rows of magnets with each row comprising alternating first and second magnets in a first direction are positioned such that the first and second magnets alternate in a second direction which intersects the first direction.

10. The flat acoustic conversion device according to claim 6, wherein a hardness of a placement portion of the vibrating membrane where at least one of the first coil, the second coil, the third coil and the fourth coil are placed is harder than a hardness of portions of the vibrating membrane other than the placement portion.

11. The flat acoustic conversion device according to claim 6, wherein the first magnet and the second magnet are provided on a plate-shaped member that is made from a magnetic material.

12. A flat acoustic conversion device comprising:

a first magnet disposed so that a first magnetic pole face is substantially parallel to a predetermined surface;

a second magnet disposed in contact with the first magnet such that a second magnetic pole face having a polarity different from the polarity of the first magnetic pole face is substantially parallel to the predetermined surface and faces toward a same side as the first magnetic pole face of the first magnet;

a vibrating member disposed so as to face toward the first magnetic pole face and the second magnetic pole face;

a first coil which is formed in a helical shape and is disposed such that an inner periphery of a coil spiral of the first coil is positioned outside an area which includes a position on the vibrating member which corresponds to a center of the first magnetic pole face of the vibrating member; and a second coil which is formed in a helical shape and is disposed such that an inner periphery of a coil spiral of the second coil is positioned outside an area which includes a position on the vibrating member which corresponds to a center of the first magnetic pole face of the vibrating member, and such that the outer periphery of the second coil does not overlap with the first coil.

13. A flat acoustic conversion device comprising:

a first magnet disposed so that a first magnetic pole face is substantially parallel to a predetermined surface;

a second magnet disposed in contact with the fist magnet such that a second magnetic pole face having a polarity different from the polarity of the fist magnetic pole face is substantially parallel to the predetermined surface and faces toward a same side as the first magnetic pole face of the fist magnet;

a vibrating member disposed so as to face toward the predetermined surface;

a fist coil which is formed in a helical shape and is disposed on the vibrating member such that an inner periphery of a coil spiral of the fist coil is positioned outside an area which includes a position on the vibrating member that corresponds to a center of the first magnetic pole face;

a second coil which is formed in a helical shape and is disposed on the vibrating member such that an inner periphery of a coil spiral of the second coil is positioned outside an area which includes a position on the vibrating member that corresponds to a center of the first magnetic pole face, and such that an outer periphery of the second coil does not overlap with the first coil located on the vibrating member and overlaps with the first coil on the vibrating member;

a third coil which is formed in a helical shape and is wound in a same direction as the second coil, and which is disposed on the vibrating member such that an inner periphery of a coil spiral of the third coil is positioned outside an area which includes a position on the vibrating member which corresponds to a center of the second magnetic pole face, and such that an outer periphery of the third coil does not overlap with the second coil, wherein an inner peripheral end of the second coil is connected to an inner peripheral end of the third coil and wherein the outer peripheral end of the third coil is connected to an outer peripheral end of the second coil; and a fourth coil which is formed in a helical shape and is wound in a same direction as the first coil, and which is disposed on the vibrating member such that an inner periphery of the coil spiral of the fourth coil is positioned outside an area which includes a position on the vibrating member which corresponds to a center of the second magnetic pole face, and such that an outer periphery of the fourth coil does not overlap with the third coil and overlaps with the third coil, wherein an inner peripheral end of the fourth coil is connected to an inner peripheral end of the third coil.

* * * * *